US009555641B2

(12) United States Patent
Miyamoto et al.

(10) Patent No.: US 9,555,641 B2
(45) Date of Patent: Jan. 31, 2017

(54) LIQUID SUPPLY SYSTEM

(71) Applicant: Seiko Epson Corporation, Tokyo (JP)

(72) Inventors: Yuji Miyamoto, Shiojiri (JP); Soshi Okawa, Shiojiri (JP); Nobuyuki Nishi, Hara-mura (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/843,105

(22) Filed: Sep. 2, 2015

(65) Prior Publication Data

US 2016/0067981 A1 Mar. 10, 2016

(30) Foreign Application Priority Data

Sep. 5, 2014 (JP) ..... 2014-181175

(51) Int. Cl.
*B41J 2/175* (2006.01)
*B41J 29/13* (2006.01)

(52) U.S. Cl.
CPC ..... *B41J 2/17596* (2013.01); *B41J 2/1752* (2013.01); *B41J 2/17513* (2013.01); *B41J 2/17546* (2013.01); *B41J 2/17553* (2013.01); *B41J 29/13* (2013.01)

(58) Field of Classification Search
CPC ..... B41J 2/175; B41J 2/1752; B41J 2/17596
See application file for complete search history.

(56) References Cited

U.S. PATENT DOCUMENTS 7,240,999 B2 * 7/2007 Kumagai ..... B41J 2/17556 347/14
2012/0212526 A1 * 8/2012 Karasawa ..... B41J 2/17509 347/7

FOREIGN PATENT DOCUMENTS

JP 2012-139852 A 7/2012
WO 9742035 11/1997

* cited by examiner

*Primary Examiner* — Sarah Al Hashimi

(57) ABSTRACT

Complication and an increase in size of an apparatus when suppressing precipitation of a precipitating component contained in liquid are suppressed. In a liquid supply apparatus 20, ink containing pigment, which is a precipitating component, is contained in a liquid containing portion 52, and the ink contained in the liquid containing portion 52 is guided from a liquid supply portion of a holding portion 54 to a printer. A liquid containing body 50 is configured with the liquid containing portion 52 fixed to the holding portion 54, and is attached to an attachment/detachment unit 30 in a detachable manner. The attachment/detachment unit 30 supports the liquid containing body 50 by the holding portion 54 thereof in a state where the liquid containing portion 52 is exposed, and transmits an X-axis reciprocating movement XM along an X-axis, for example, to the liquid containing portion 52 of the liquid containing body 50 that is thus supported.

8 Claims, 36 Drawing Sheets

CROSS-SECTIONAL VIEW
TAKEN ALONG LINE F13-F13

AS VIEWED ALONG ARROW F17B

PARTIAL CROSS-SECTIONAL VIEW
TAKEN ALONG LINE F18-F18

PARTIAL CROSS-SECTIONAL VIEW TAKEN ALONG LINE F20-F20

LIQUID SUPPLY SYSTEM

BACKGROUND

1. Technical Field

The present invention relates to liquid supply systems.

2. Related Art

As a liquid supply system capable of supplying liquid to a liquid consuming apparatus, a mode of supplying ink to a printer, which is an exemplary liquid consuming apparatus, has been known hitherto. In recent years, a large ink capacity has been demanded. For this reason, it has been proposed to house a large-capacity container bag for containing ink in a case on a printer side face and supply, via a tube, the ink to a cartridge having a head on a carriage (e.g., WO97/42035). Since ink contains a precipitating component in some cases, it has also been proposed to house an ink pack that contains ink in a casing and vibrate or rotate the ink pack together with the casing to stir the precipitating component (e.g., JP-A-2012-139852).

In WO97/42035, if the ink contained in a containing bag contains a precipitating component, since the precipitating component is not stirred, there is a possibility that the ink cannot be provided to the printer, which is an exemplary liquid consuming apparatus, in an appropriate concentration condition. If the technique proposed in JP-A-2012-139852 is applied, the concentration condition can be improved by stirring the precipitating component. However, a problem arises in that the apparatus becomes complicated since the ink cartridge, which serves as a casing for containing the ink pack, is vibrated or rotated using a magnetic vibrator and a generator coil.

SUMMARY

The invention deals with at least a part of the foregoing problem, and an object of the invention is to provide a system capable of suppressing complication and an increase in size of an apparatus, and efficiently suppressing precipitation of a precipitating component.

The invention has been made in order to solve at least a part of the foregoing problem, and can be achieved in the following modes.

(1) According to a mode of the invention, a liquid supply system capable of supplying liquid is provided. This liquid supply system includes: a liquid containing body including a liquid containing portion that contains liquid containing a precipitating component, and a liquid supply portion that guides the liquid contained in the liquid containing portion from the liquid containing portion to the outside; and a liquid containing body attachment portion to which the liquid containing body is attached in a detachable manner. The liquid containing body attachment portion includes: a support portion that supports a part of the liquid containing body in a state where the liquid containing portion is exposed, when attaching the liquid containing body; and an operating portion that applies a movement to the liquid containing portion of the liquid containing body supported by the support portion. In the liquid supply system in this mode, the liquid containing body is supported by the support portion of the liquid containing body attachment portion without using a casing, and at the time of the supporting, a part of the liquid containing body is supported, rather than the overall liquid containing body. Accordingly, the structure for supporting the liquid containing body can be simplified, and it is also possible, through this simplification of the configuration, to reduce the number of members, suppress an increase in the size of the system, and suppress complication thereof. Furthermore, in the liquid supply system in this mode, the liquid containing body need only be supported and attached to the liquid containing body attachment portion in a state where the liquid containing portion is exposed. Accordingly, it is possible to easily apply the movement to the liquid containing portion, easily and reliably stir the liquid contained in the liquid containing portion, and reduce a load placed on the operating portion, as compared with a liquid containing body in which the liquid containing portion is covered with a case. As a result, a device configuration of the operating portion can be simplified, and simplification and a reduction in the size of the system are also possible. Furthermore, the movement can be easily applied directly to the liquid containing portion as compared with a liquid containing body in which the liquid containing portion is covered with a case. In this regard as well, this mode is advantageous for simplification of the device configuration of the operating portion, and simplification or a reduction in the size of the system.

(2) In the liquid supply system in the above mode, the operating portion may apply a movement to the liquid containing portion along a linear trajectory. With this configuration, the operating portion need only be driven along the linear trajectory, and accordingly the device configuration can be further simplified, and the degree of freedom in a device installation space also increases.

(3) In the liquid supply system in any of the above modes, the support portion may support the liquid containing body such that the liquid supply portion of the liquid containing body is separate from a portion at which a movement is applied to the liquid containing portion by the operating portion. This configuration has the following advantage. If the liquid supply portion is close to a portion at which the movement is applied to the liquid containing portion by the operating portion (this portion will be hereinafter referred to as a movement applying portion, for the sake of convenience), liquid pressure may possibly be immediately and directly applied to this liquid supply portion with the movement applied to the liquid containing portion by the operating portion. In this case, there is a possibility of leakage of the liquid from the liquid supply portion or breakage of the liquid supply portion. In contrast, in the liquid supply system in this mode, the liquid supply portion is separate from the movement applying portion. Accordingly, the liquid pressure generated with the movement applied to the liquid containing portion by the operating portion will be applied to the liquid supply portion after the liquid containing portion is expanded between the movement applying portion and the liquid supply portion. Therefore, the liquid pressure is not easily applied to the liquid supply portion that is separate from the movement applying portion, as compared with a liquid supply portion that is close to the movement applying portion. As a result, with the liquid supply system in this mode, leakage of the liquid from the liquid supply portion and breakage of the liquid supply portion can be suppressed. In this case, if the liquid supply portion is located above the liquid containing portion and separate from the movement applying portion, the weight of the liquid is exerted such that the liquid pressure is not easily applied to the liquid supply portion separate from the movement applying portion. Accordingly, this mode is advantageous in suppressing leakage of the liquid from the liquid supply portion and breakage of the liquid supply portion.

(4) In the liquid supply system in any of the above modes, the operating portion may apply a movement to the liquid containing portion by moving the support portion. With this configuration, it is possible to efficiently vibrate the liquid containing portion, and easily and reliably stir the liquid contained in the liquid containing portion.

(5) In the liquid supply system in any of the above modes, the operating portion may include an abutting portion that abuts against a bottom portion of the liquid containing portion to apply an up-and-down movement to the liquid containing portion. With this configuration, since the up-and-down movement is applied to the bottom portion onto which the precipitating component precipitates and accumulates, the precipitating component can also be efficiently dispersed to the upper side of the liquid containing portion. For example, if the bottom portion of the liquid containing portion has a gusset, the abutting portion acts for folding the gusset to the inside along a crease. Accordingly, this mode is also advantageous in reducing the liquid remaining on the side of the bottom portion of the liquid containing portion.

(6) In the liquid supply system in any of the above modes, the operating portion may include a roller that moves along a predetermined trajectory at a flexible portion that the liquid containing portion has. With this configuration, the portion at which the movement is applied to the liquid containing portion is moved along a predetermined trajectory by being driven by the roller, and accordingly the precipitating component can be efficiently stirred and dispersed. In this case, if the roller is configured to move along a predetermined trajectory in the up-down direction, the moving direction of the roller coincides with the precipitating direction of the precipitating component, and accordingly the precipitating component is also reliably dispersed to the upper side.

(7) In the liquid supply system in any of the above modes, the support portion may support the liquid containing portion from a lower side so as to provide underlying support, and the operating portion may include a press member that presses the liquid containing portion from above. With this configuration, the support portion, the liquid containing portion supported thereby, and the press member that is the operating portion and performs pressing overlap one another in a plan view. Accordingly, the device installation space in a plan view direction can be reduced, and an increase in the size of the system can be suppressed.

(8) In the liquid supply system in the above mode, a plurality of the press members may be arranged along the liquid containing portion, and the plurality of press members may operate at different operation timings. With this configuration, the precipitating component can be efficiently stirred and dispersed.

(9) The liquid supply system in any of the above modes may further include: a valve that is provided in the middle of a flow path through which the liquid supply portion guides the liquid from the liquid containing portion to the outside, the valve opening and closing the flow path; and a valve opening/closing portion that closes the valve before the operating portion operates, and opens the valve after an operation of the operating portion is completed. With this configuration, even if the movement is applied to the liquid containing portion by the operating portion, leakage of the liquid to the side of a flow path extending from the valve and of the liquid consuming apparatus that receives a supply of the liquid from this flow path is prevented, and transmission of movement of the liquid in the liquid containing portion to the liquid consuming apparatus is also suppressed. Furthermore, since the liquid containing portion is closed by the valve, the precipitating component is actively stirred and dispersed, and the precipitation of the precipitating component is more effectively suppressed.

Not all of a plurality of constituent components provided in the above-described modes of the invention are essential, and some of the plurality of constituent components may be modified, deleted, or replaced with a new constituent component, or the content of limitation may be partially deleted as appropriate, in order to solve a part of or the entire problem described above, or to achieve some or all of the effects described in this specification. It is also possible to combine some or all of the technical features included in one of the above-described modes of the invention with some or all of the technical features included in the other of the above-described modes of the invention to make an independent mode of the invention, in order to solve a part of or the entire problem described above, or to achieve some or all of the effects described in the specification.

The invention can be achieved in various modes, and for example, the invention can be achieved in modes such as a liquid consuming apparatus that receives a supply of liquid from a liquid supply system, a system including a liquid supply system and a liquid consuming apparatus, and the like.

BRIEF DESCRIPTION OF THE DRAWINGS

The invention will be described with reference to the accompanying drawings, wherein like numbers reference like elements.

DESCRIPTION OF EXEMPLARY EMBODIMENTS

Next, embodiments of the invention will be described in the following order.

A to E. First to Fifth Embodiments:

F. Various modifications:

A. First Embodiment

A-1. Configuration of Liquid Consuming System

Figure 1:
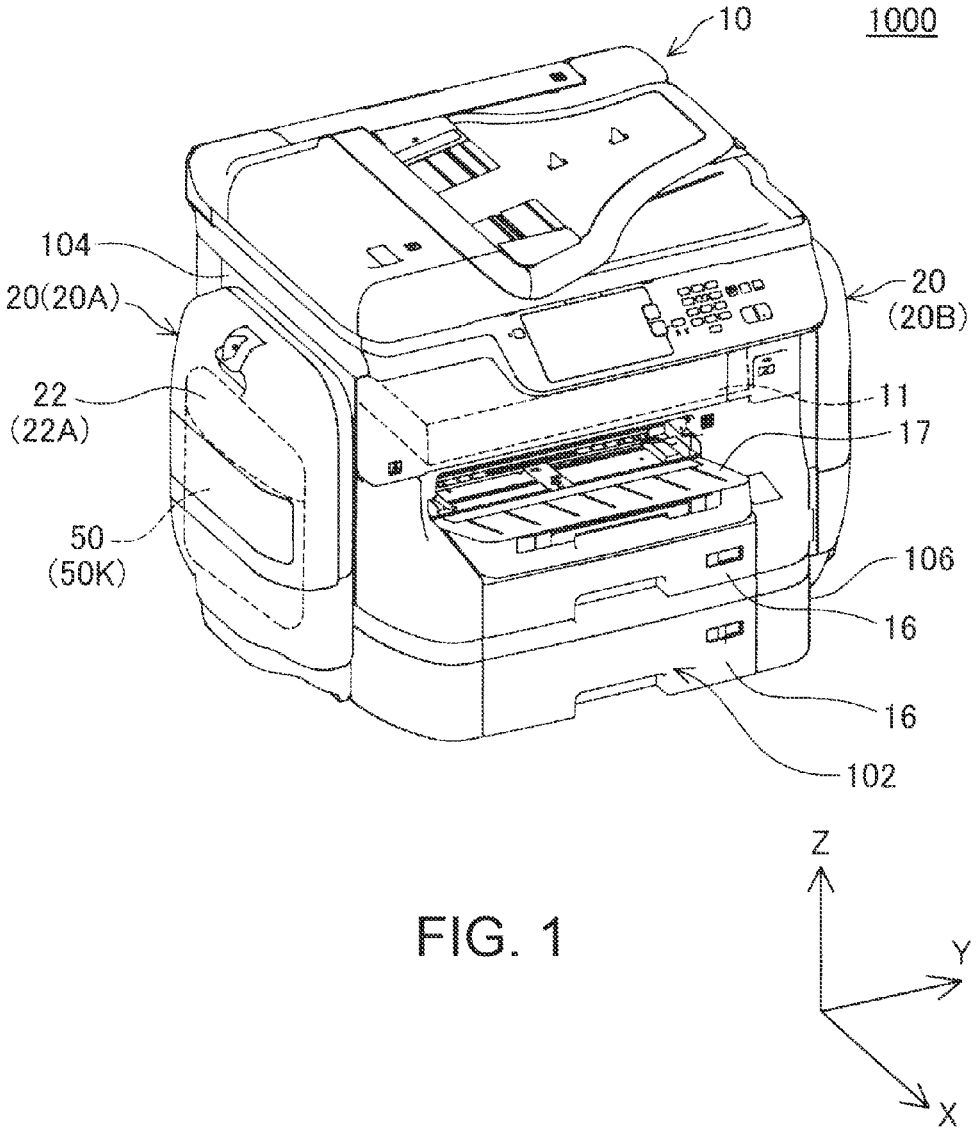
FIG. 1 is a first perspective view showing an outline configuration of a liquid consuming system 1000 in a first embodiment.
Figure 2:
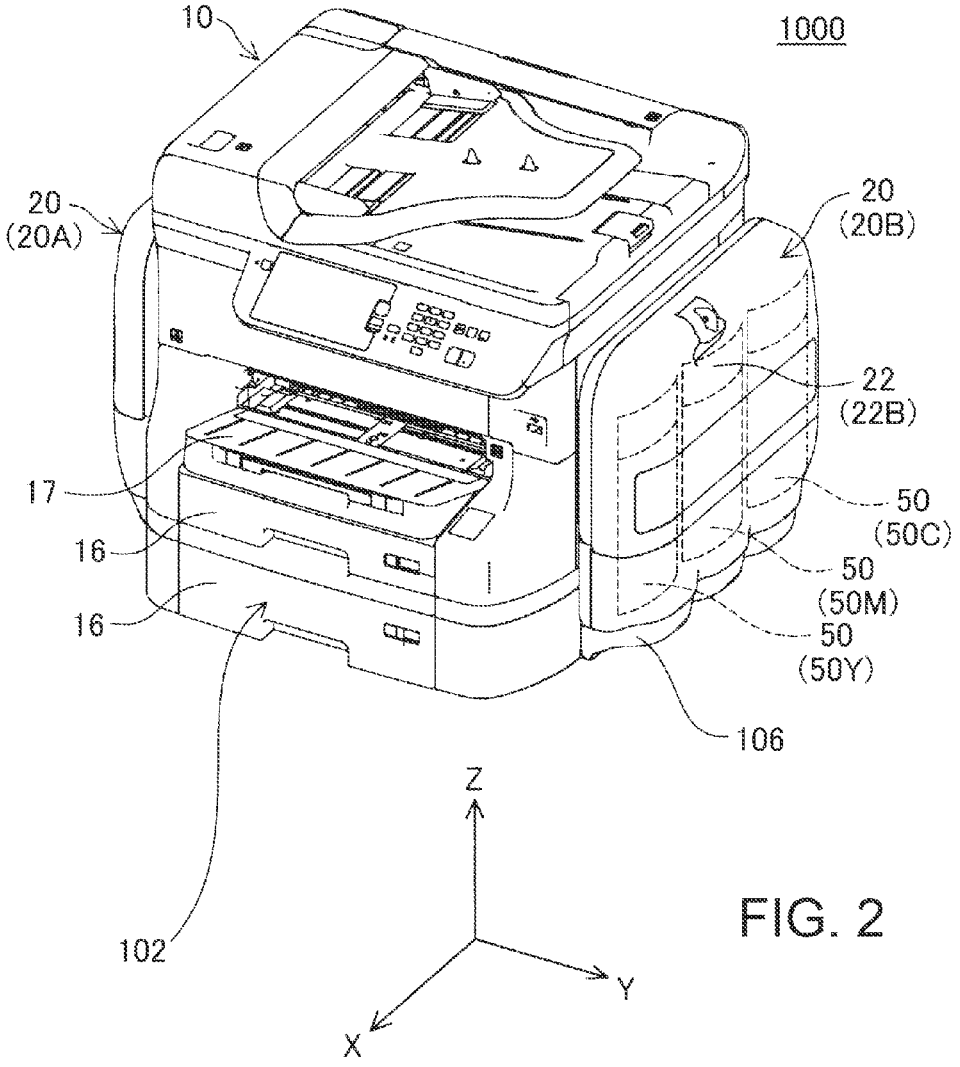
FIG. 2 is a second perspective view showing an outline configuration of the liquid consuming system 1000.
Figure 3:
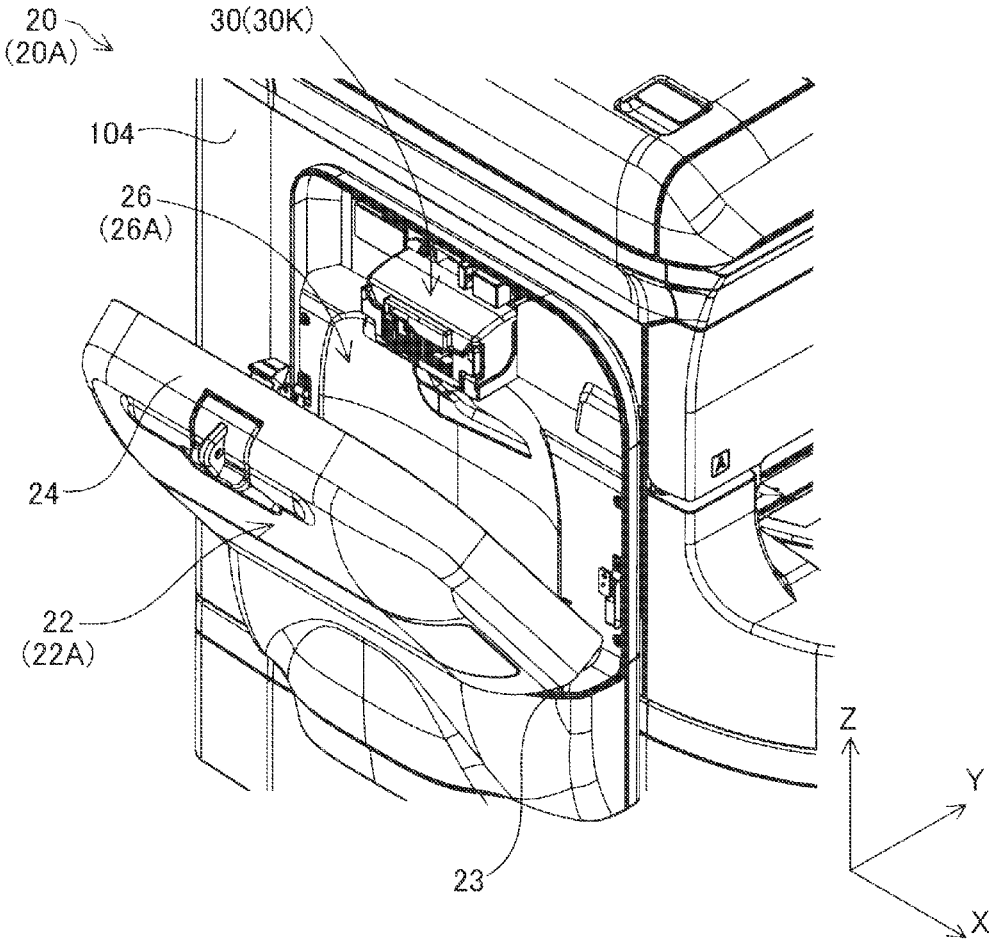
FIG. 3 is a first view for illustrating a liquid supply apparatus 20.
Figure 4:
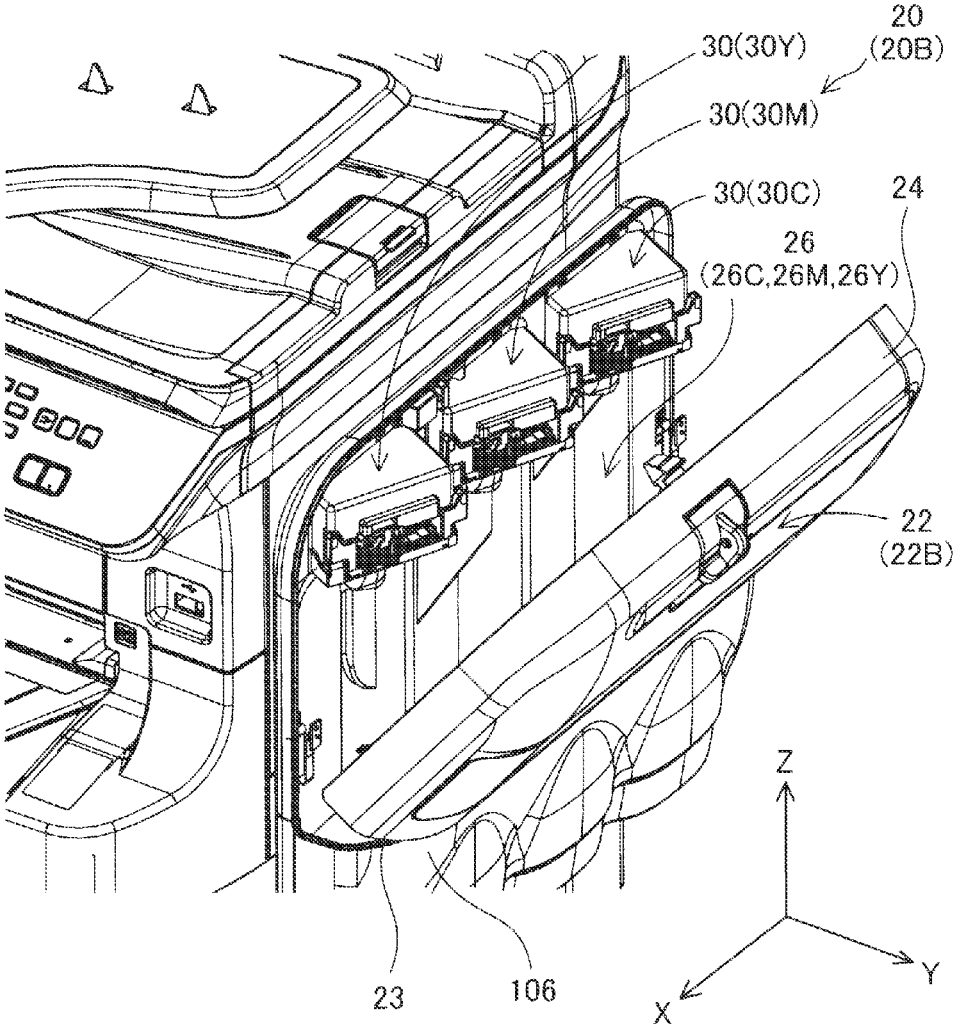
FIG. 4 is a second view for illustrating the liquid supply apparatus 20.

FIG. 1 is a first perspective view showing an outline configuration of a liquid consuming system 1000 in a first embodiment. FIG. 2 is a second perspective view showing an outline configuration of the liquid consuming system 1000. FIG. 3 is a first view for illustrating a liquid supply apparatus 20. FIG. 4 is a second view for illustrating the liquid supply apparatus 20. Note that FIGS. 3 and 4 each show a state where a later-described liquid containing body is removed. In FIGS. 1 to 4, XYZ axes orthogonal to one another are indicated.

As shown in FIG. 1, the liquid consuming system 1000 includes a printer 10 serving as a liquid consuming apparatus, and two liquid supply apparatuses 20. When the liquid consuming system 1000 is used, the printer 10 is installed on a horizontal surface defined by an X-axis direction and a Y-axis direction. That is to say, a Z-axis direction is the vertical direction (up-down direction). A −Z-axis direction is a vertically downward direction, and a +Z-axis direction is a vertically upward direction. The liquid supply apparatus 20 constitutes a liquid supply system that supplies ink, which serves as liquid, to the printer 10. Liquid containing bodies 50 included in the liquid supply apparatus 20 can be connected (attached) to the printer 10 in a detachable manner.

The printer 10 is an inkjet printer. The printer 10 includes a recording mechanism 11, paper feed trays 16, and a discharge tray 17. A plurality of paper feed trays 16 are provided at different height positions in the vertical direction. The paper feed trays 16 are provided in an apparatus first face (apparatus front face) 102 of the printer 10. Recording media (e.g., paper) on which an image such as a character is printed (recorded) by the printer 10 are contained in the paper feed trays 16.

The recording mechanism 11 includes a recording head (not shown) that discharges ink. The recording head is in communication with the liquid supply apparatus 20 via a flow tube. The recording head performs recording (printing) by discharging ink onto the recording media, using the ink supplied from the liquid supply apparatus 20. The recording media onto which the recording has been performed is discharged to the discharge tray 17.

The two liquid supply apparatuses 20 are provided respectively in an apparatus second face (also called an apparatus first side face or an apparatus first side wall) 104 and an apparatus third face (also called as an apparatus second side face or an apparatus second side wall) 106 that intersect the apparatus first face (also called an apparatus front face or an apparatus front wall) 102 of the printer 10. The apparatus first face 102 to the apparatus third face 106 are faces that are substantially vertical to the installation surface when the printer 10 is used. The apparatus second face 104 is opposed to the apparatus third face 106. Here, the liquid supply apparatus 20 provided in the apparatus second face 104 will also be called a first liquid supply apparatus 20A, and the liquid supply apparatus 20 provided in the apparatus third face 106 will also be called a second liquid supply apparatus 20B. Note that the two liquid supply apparatuses 20 will be simply called the liquid supply apparatuses 20 when not distinguishing between the first and second liquid supply apparatuses 20A and 20B.

As shown in FIG. 1, the first liquid supply apparatus 20A includes a cover member 22, a liquid containing body 50, and an attachment/detachment unit 30 (FIG. 3). As shown in FIG. 2, the second liquid supply apparatus 20B includes a cover member 22, three liquid containing bodies 50, and three attachment/detachment units (FIG. 4) corresponding to the respective liquid containing bodies 50. Here, reference numerals "22A" and "22B" will be used when distinguishing between the two cover members 22. Also, reference numerals "50K", "50C", "50M", and "50Y" will be used when distinguishing among the four liquid containing bodies 50. Reference numerals "30K", "30C", "30M", and "30Y" will be used when distinguishing among the four attachment/detachment units 30. Note that the number of cover members 22, liquid containing bodies 50, and attachment/detachment units 30 is not limited to the above. For example, the number of liquid containing bodies 50 may be three or smaller, or may be five or larger. The attachment/detachment units 30 may be provided so as to correspond to the number of liquid containing bodies 50. The number of cover members 22 may be one, or may be three or larger.

The four liquid containing bodies 50 contain (are filled with) different types of ink. In this embodiment, yellow (Y), magenta (M), cyan (C), and black (K) inks are contained in different liquid containing bodies 50. The liquid containing body 50K has a liquid containing portion containing the black ink, the liquid containing body 50C has a liquid containing portion containing the cyan ink, the liquid containing body 50M has a liquid containing portion containing the magenta ink, and the liquid containing body 50Y has a liquid containing portion containing the yellow ink. As shown in FIGS. 3 and 4, the liquid containing bodies 50 are housed in housing space portions 26 demarcated by the cover members 22. Specifically, the liquid containing body 50K is housed in a housing space portion 26A (FIG. 3), and the liquid containing bodies 50C, 50M, and 50Y are housed in a housing space portion 26B (FIG. 4).

In this embodiment, the aforementioned respective color inks contained in the liquid containing body 50K, the liquid containing body 50C, the liquid containing body 50M, and the liquid containing body 50Y are inks containing pigment, and the pigment contained in the color inks precipitates due to its own weight in the respective containing bodies. That is to say, the liquid containing bodies 50 each contain ink containing the pigment, which is a precipitating component, in the liquid containing portion 52.

The attachment/detachment units 30 shown in FIGS. 3 and 4 allow the liquid containing bodies 50 to be detachably attached thereto. The attachment/detachment unit 30K is arranged within the cover member 22A, and the attachment/detachment units 30C, 30M, and 30Y are arranged within the cover member 22B. As shown in FIG. 3, the attachment/detachment unit 30K is provided on the apparatus second face 104 of the printer 10. As shown in FIG. 4, the attachment/detachment units 30C, 30M, and 30Y are provided in the apparatus third face 106 of the printer 10. When each liquid containing body 50 is attached to the corresponding detachable unit 30, the ink contained in the liquid containing body 50 is supplied to the recording head of the printer 10 by a supply mechanism (not shown) having a pump function of the printer 10.

As shown in FIGS. 3 and 4, each cover member 22 is configured to be able to be opened and closed by rotating a second end portion 24 located on the side in the vertically upward direction with a first end portion 23 located on the side in the vertically downward direction as a fulcrum. After the ink contained in each liquid containing body 50 is consumed, a user opens the corresponding cover member 22 and removes the liquid containing body 50 in which the ink has been consumed, from the attachment/detachment unit 30. The user then attaches a new liquid containing body 50 to the attachment/detachment unit 30 and thereafter closes the cover member 22.

A-2. Configuration of Attachment/Detachment Unit 30

Figure 5:
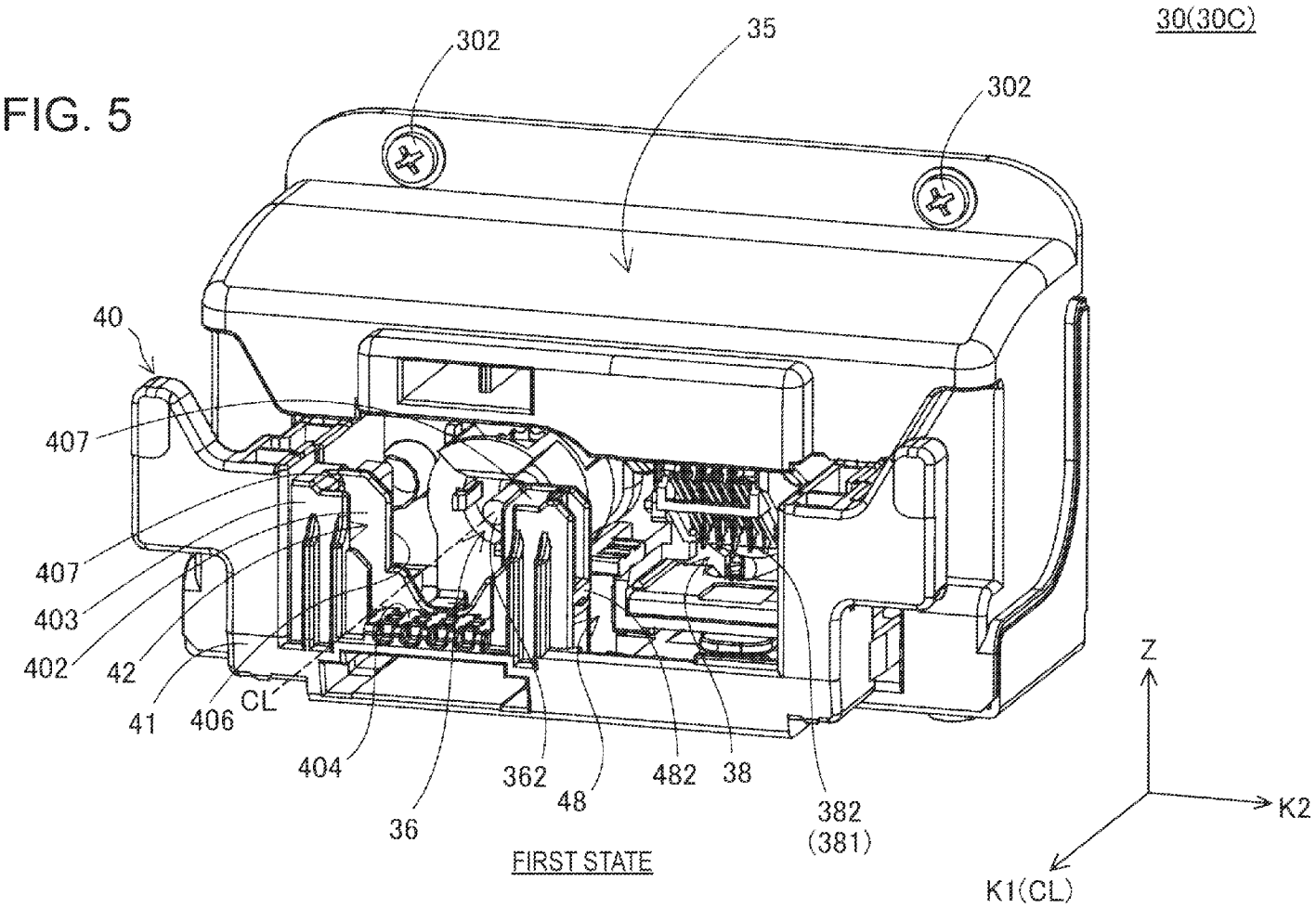
FIG. 5 is a first perspective view for illustrating an attachment/detachment unit 30.
Figure 6:
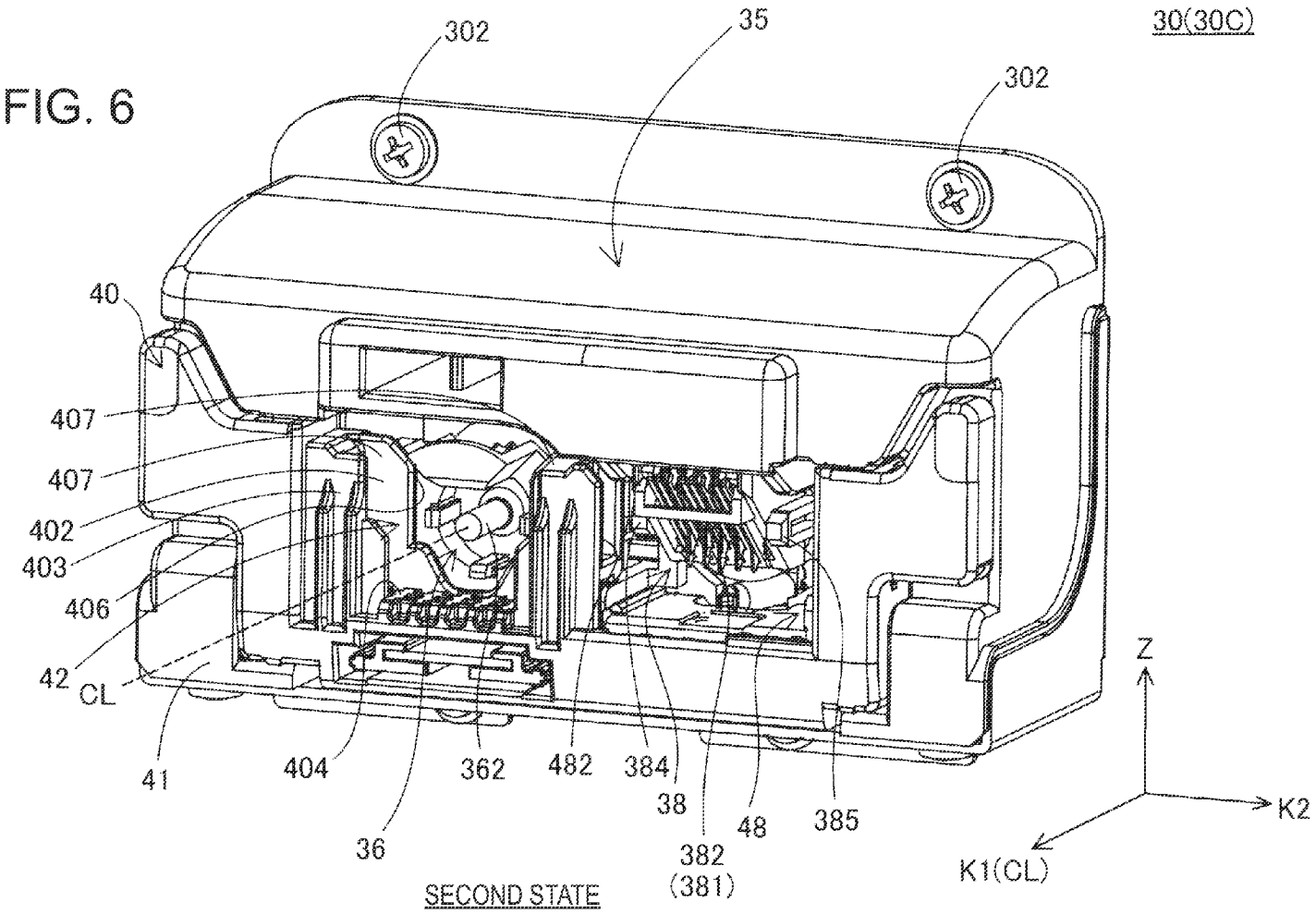
FIG. 6 is a second perspective view for illustrating the attachment/detachment unit 30.

FIG. 5 is a first perspective view for illustrating the attachment/detachment unit 30. FIG. 6 is a second perspective view for illustrating the attachment/detachment unit 30. FIG. 5 shows a first state (state at the time of setting) in which a movable member 40 projects outward of a fixed member 35. FIG. 6 shows a second state (state at the time of attachment) in which the movable member 40 is housed in the fixed member 35. Although the configuration will be described, taking the attachment/detachment unit 30C as an example in FIGS. 5 and 6, the other attachment/detachment units 30K, 30M, and 30Y also have the same configuration as the attachment/detachment unit 30C. As shown in FIG. 5, the attachment/detachment unit 30 includes the fixed member 35 and the movable member 40.

The liquid containing body 50 is detachably attached to the attachment/detachment unit 30 by executing the following two operations. The state where the liquid containing body 50 is attached to the attachment/detachment unit 30 will also be called an "attached state (connected state)". The attached state (connected state) refers to a state where a later-described liquid supply portion 57 in the liquid containing body 50 is connected to a liquid introduction portion (liquid introduction needle) 362 in the attachment/detachment unit 30, and a circuit board 582 in the liquid containing body 50 is electrically connected to an electric connection portion (apparatus-side electric connection portion) 382 in the attachment/detachment unit 30. In the attached state, the ink contained in the liquid containing body 50 is in a state of being able to flow toward the side of the printer 10.

First Operation:

The user brings the attachment/detachment unit 30 into the first state (see FIG. 5), and thereafter sets the liquid containing body 50 to the movable member 40.

Second Operation:

After the first operation, the user presses the movable member 40 toward the side of the fixed member 35 via the liquid containing body 50, and thereby brings the attachment/detachment unit 30 into the second state (see FIG. 6).

In the second state of the attachment/detachment unit 30, movement of the movable member 40 toward the side in a K1-axis direction with respect to the fixed member 35 is restricted by a lock mechanism. Note that, in the second state, the locking by the lock mechanism is cancelled by pressing the movable member 40 against the fixed member 35 in an inward direction (−K1-axis direction). It is thereby possible to switch the state of the attachment/detachment unit 30 from the second state to the first state by moving the movable member 40 so as to project outward (+K1-axis direction) of the fixed member 35.

The fixed members 35 are fixed respectively to the apparatus second face 104 and the apparatus third face 106 (FIGS. 3 and 4) of the printer 10 by a plurality of screws 302, each of which serves as a fixing portion. Specifically, the attachment/detachment unit 30K (FIG. 3) is fixed to the apparatus second face 104 by the plurality of screws 302, and the attachment/detachment units 30C, 30M, and 30Y (FIG. 4) are attached to the apparatus third face 106 by the plurality of screws 302.

Each fixed member 35 includes a liquid introduction mechanism 36 and a contact point mechanism 38. The liquid introduction mechanism 36 has a liquid introduction portion 362. A later-described liquid supply portion (specifically, a later-described liquid supply unit 55) provided in each liquid containing body 50 is connected to the liquid introduction portion 362, and as a result, the ink contained in the liquid containing body 50 flows. The liquid introduction portion 362 is in communication with the recording head of the printer 10.

The liquid introduction portion 362 has a needle shape within which the ink can flow. The liquid introduction portion 362 extends along a center axis CL. A direction parallel with this center axis CL (i.e., an extending direction of the liquid introduction portion 362) is assumed to be the K1-axis direction. The K1-axis direction is orthogonal to the Z-axis direction. The direction orthogonal to the K1-axis direction and the Z-axis direction is assumed to be a K2-axis direction. A face defined by the K1-axis direction and the K2-axis direction is parallel with a face defined by the X-axis direction and the Y-axis direction shown in FIG. 1. Of the K1-axis direction, a direction extending to the outside of the printer 10 is the +K1-axis direction, and a direction extending to the inside of the printer 10 is the −K1-axis direction.

The liquid introduction mechanism 36 and the contact point mechanism 38 are arranged side-by-side in the K2-axis direction. Of the K2-axis direction, a direction extending from the liquid introduction mechanism 36 toward the contact point mechanism 38 is a +K2-axis direction, and a direction extending from the contact point mechanism 38 toward the liquid introduction mechanism 36 is a −K2-axis direction. Regarding the attachment/detachment unit 30, the Z-axis direction will also be called a "height direction", the K1-axis direction will also be called a "width direction", and the K2-axis direction will also be called a "depth direction".

As shown in FIGS. 5 and 6, the contact point mechanism 38 includes an electric connection portion (apparatus-side electric connection portion) 382 having a plurality of (in this embodiment, nine) apparatus-side terminals 381, and a plurality of (in this embodiment, two) apparatus-side board positioning portions 384 and 385. In the attached state of the liquid containing body 50, the apparatus-side terminals 381 of the electric connection portion 382 come into contact with (i.e., are electrically connected to) the circuit board of the liquid containing body 50. The circuit board of the liquid containing body 50 and the printer 10 can thereby communicate various kinds of information (e.g., the ink color and the date of manufacture of the liquid containing body 50) with each other. The apparatus-side terminals 381 are each formed by a metal flat spring that can undergo elastic deformation. The apparatus-side board positioning portions 384 and 385 are arranged on both sides of the electric connection portion 382 in the K2-axis direction (the direction in which the liquid introduction mechanism 36 and the contact point mechanism 38 are arranged side-by-side). The apparatus-side board positioning portions 384 and 385 perform final positioning of the circuit board of the liquid containing body 50 with respect to the electric connection portion 382 when the liquid containing body 50 is attached to the attachment/detachment unit 30. The apparatus-side board positioning portions 384 and 385 are members extending in the K1-axis direction.

The movable member 40 is configured to be able to move in the K1-axis direction with respect to the fixed member 35. The movable member 40 includes a base portion 41, a supply portion support portion 42, and a board support portion 48. The supply portion support portion 42 and the board support portion 48 are connected to the base portion 41. The supply portion support portion 42 and the board support portion 48 are members extending from the base portion 41 toward the side (upper side) in the +Z-axis direction.

The supply portion support portion 42 is a member for determining the position of the liquid containing body 50 (specifically, the liquid supply portion) with respect to the liquid introduction portion 362. When the attachment/detachment unit 30 is viewed in the K1-axis direction, the supply portion support portion 42 is provided at a position overlapping the liquid introduction portion 362. The supply portion support portion 42 is provided so as to form a shape denting in the −Z-axis direction. Groove portions 407 are formed on both sides of the supply portion support portion 42 in the K2-axis direction. As a result of later-described positioning portions of the liquid containing body 50 entering the groove portions 407, movement of the liquid supply portion provided in the liquid containing body 50 is restricted. That is to say, movement of the liquid supply portion provided in the liquid containing body 50 is restricted by a plurality of face portions (e.g., a first support face portion 402, a second support face portion 403, and a third support face portion 404) that demarcate and form the supply portion support portion 42, and the liquid containing body 50 is roughly positioned with respect to the attachment/detachment unit 30. In the supply portion support portion 42, a cutout portion 406 is formed in the first support face portion 402 located on the side of the liquid introduction portion 362. The cutout portion 406 has a dent shape opening on the side in the +Z-axis direction. When the attachment/detachment unit 30 is viewed in the K1-axis direction, the cutout portion 406 is provided at a position overlapping the liquid introduction portion 362. In the first state where the movable member 40 has been moved to the maximum in the +K1-axis direction with respect to the fixed member 35, the cutout portion 406 is located further on the side in the +K1-axis direction than the liquid introduction portion 362. As shown in FIG. 6, in the second state, the tip of the liquid introduction portion 362 is located within the cutout portion 406.

The board support portion 48 is a member for determining the position of the liquid containing body 50 (specifically, the circuit board) with respect to the contact point mechanism 38. When the attachment/detachment unit 30 is viewed in the K1-axis direction, the board support portion 48 is provided at a position overlapping the contact point mechanism 38. The board support portion 48 is provided so as to form a shape denting in the −Z-axis direction. Movement of the circuit board of the liquid containing body 50 is restricted by a plurality of face portions (e.g., a first board support face portion 482) demarcating and forming the board support portion 48.

A-3. Configuration of Liquid Containing Body 50

Figure 7:
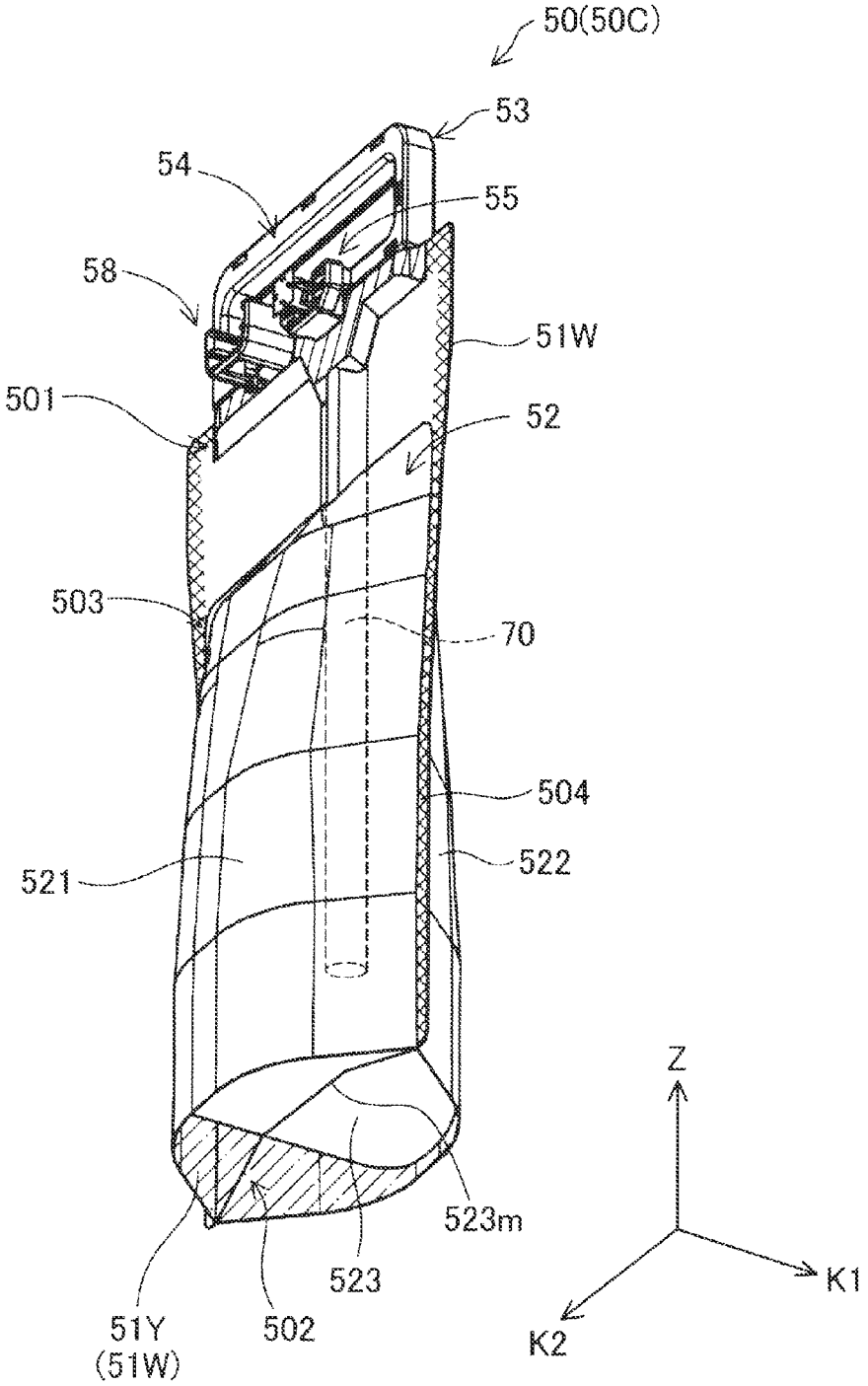
FIG. 7 is a first perspective view of a liquid containing body 50.
Figure 8:
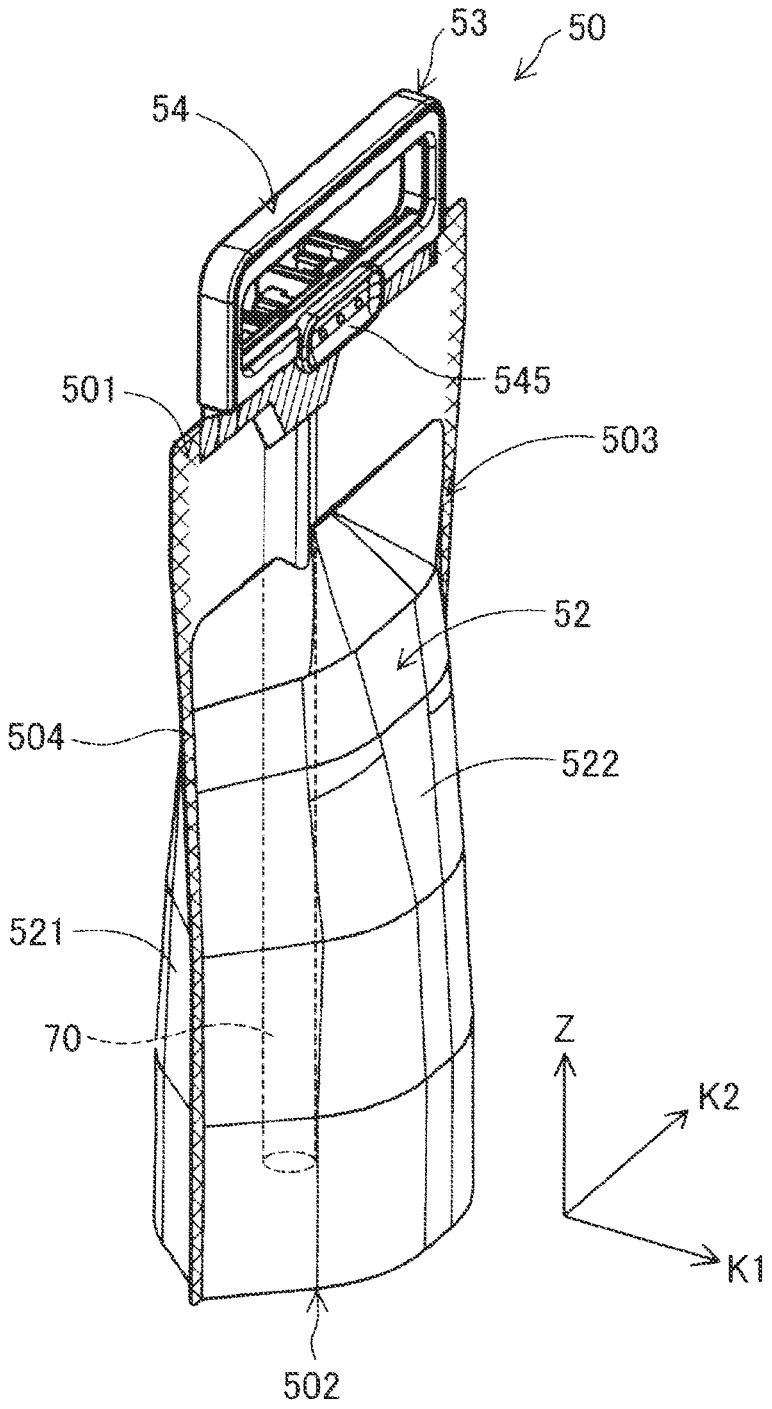
FIG. 8 is a second perspective view of the liquid containing body 50.

FIG. 7 is a first perspective view of the liquid containing body 50. FIG. 8 is a second perspective view of the liquid containing body 50. In FIGS. 7 and 8, the Z axis, the K1 axis, and the K2 axis in a state (attached state) where the liquid containing body 50 is attached to the attachment/detachment unit 30 are indicated. FIGS. 7 and 8 show the liquid containing body 50 in a state (unused state) of being filled with the ink serving as liquid before being attached to the attachment/detachment unit 30. Note that the Z axis, the K1 axis, and the K2 axis orthogonal to one another are also indicated as necessary in the later-described drawings for illustrating the liquid containing body 50. Although the configuration will be described while taking the liquid containing body 50C as an example in FIG. 7 and the subsequent drawings, the liquid containing bodies 50K, 50M, and 50Y also have the same configuration as the liquid containing body 50C.

As shown in FIG. 7, the liquid containing body 50 includes the liquid containing portion 52 and an operation member (handle portion) 53. The operation member 53 is attached to the liquid containing portion 52. The operation member 53 includes a holding portion 54, a liquid supply unit 55, a board unit (containing body-side electric connection portion) 58, and a press portion 545 (FIG. 8). The holding portion 54 is a portion for a user holding the liquid containing body 50. The liquid supply unit 55 is a portion corresponding to the liquid introduction portion 362 and the supply portion support portion 42 (FIG. 6) that are included in the attachment/detachment unit 30. The board unit 58 is a portion corresponding to the electric connection portion 382 and the board support portion 48 (FIG. 6) included in the attachment/detachment unit 30. Although the holding portion 54 of the operation member 53 is formed in a rectangular shape in this embodiment, it should be noted that the holding portion 54 may be formed in a "C" shape or a "T" shape.

The liquid containing portion 52 can contain the ink serving as the liquid. The liquid containing portion 52 is attached to the operation member 53 in a state where a bag face (outer surface) is exposed. That is to say, the liquid containing portion 52 is configured not to be housed in a case or the like and to be visible from the outside. The internal volume of the liquid containing portion 52 decreases with a decrease of the contained ink.

The liquid containing portion 52 has a first film 521, a second film 522, a third film 523. The first to third films 521 to 523 demarcate a space portion for containing the ink on the inside thereof. Here, of the liquid containing portion 52, the side to which the operation member 53 is attached is the side of a first end portion (upper end portion) 501, and the side opposed to the first end portion 501 is the side of a second end portion (bottom end portion) 502. Furthermore, of the liquid containing portion 52, the first end portion side (the side in the +K2-axis direction) is the side of the first side end portion 503, and the second end portion side (the side in the −K2-axis direction) is the side of the second side end portion 504. The bottom end portion 502 serves as a gusset that can be folded to the inside at a crease 523*m* provided as a folding line in the third film 523 such that the first film 521 and the second film 522 overlap each other.

In the attached state of the liquid containing body 50, the first film 521 and the second film 522 constitute side faces of the liquid containing portion 52. Also, in the attached state of the liquid containing body 50, the third film 523 constitutes a bottom face of the liquid containing portion 52. The first film 521 and the second film 522 are arranged so as to face each other. A part of a peripheral region 51W of the first film 521 is adhered to that of the second film 522. Specifically, of the peripheral region 51W, a portion on the side of the first end portion 501, a portion on the side of the first side end portion 503, and a portion on the side of the second side end portion 504 are adhered. In order to facilitate understanding, in FIGS. 7 and 8, the portions where the first and second films 521 and 522 are adhered to each other are cross-hatched. The operation member 53 is adhered to the first end portion 501 (specifically, one end portion of the first and second films 521 and 522) of the liquid containing portion 52. That is to say, the operation member 53 is a member located at the first end portion 501 of the liquid containing portion 52. In order to facilitate understanding, in FIGS. 7 and 8, the adhered portions of the operation member 53 and the first and second films 521 and 522 are single-hatched with solid lines.

In the third film 523, a peripheral region 51Y of the third film 523 and a part of the peripheral regions 51W of the first film 521 and the second film 522 are adhered to each other. The portion at which the third film 523 is adhered to the first and second films 521 and 522 is single-hatched with alternate long and short dashed lines. Thus, the liquid containing portion 52 in this embodiment is of a type in which the three films 521, 522, and 523 are adhered by adhesion or the like (a so-called pouch type with a bottom face).

The first to third films 521 to 523 are flexible members. As the material of the first to third films 521 to 523, polyethylene terephthalate (PET), nylon, polyethylene, or the like is used, for example. The first to third films 521 to 523 may also be formed using a laminate structure in which a plurality of films made of the aforementioned material are laminated. In this laminate structure, for example, a configuration may be employed in which an outer layer is formed by PET or nylon that has excellent shock resistance, and an inner layer is formed by polyethylene that has an excellent anti-ink property. Furthermore, a film having a layer to which aluminum or the like is deposited may be used as a constituent member of the laminate structure. The gas barrier property can thereby be enhanced, and therefore, a concentration change of the ink contained in the liquid containing portion 52 can be suppressed, for example. Thus, the material of the liquid containing portion 52 can be arbitrarily set.

The shape and the size of the liquid containing portion 52 can be arbitrarily set. For example, the liquid containing portion 52K that contains the black ink may have a larger volume than the volume (size) of the liquid containing portion 52C that contains the other (e.g., cyan) color ink. Furthermore, for example, the liquid containing portion 52 in this embodiment is of a type in which the first to third films 521 to 523 are adhered by adhesion or the like. However, the liquid containing portion 52 may be of a type (so-called pillow type) in which the third film 523 is omitted, and the first and second films 521 and 523 are adhered by adhesion or the like. Here, as mentioned above, the liquid containing portion 52 and the operation member 53 are different members. Accordingly, the type (shape, size, material) of the liquid containing portion 52 can be easily changed while using the same parts for the operation member 53. That is to say, the shape, size, and material of the liquid containing portion 52 can be set in accordance with the characteristics, amount, and the like of the liquid to be contained in the liquid containing portion 52, and accordingly the degree of freedom in design can be improved.

The liquid containing body 50 further has a flow path member 70 for causing the ink contained in the liquid containing portion 52 to flow into the liquid supply unit 55 (specifically, the later-described liquid supply portion). In this embodiment, the flow path member 70 is a tube. The flow path member 70 is arranged within the liquid containing portion 52.

Figure 9:
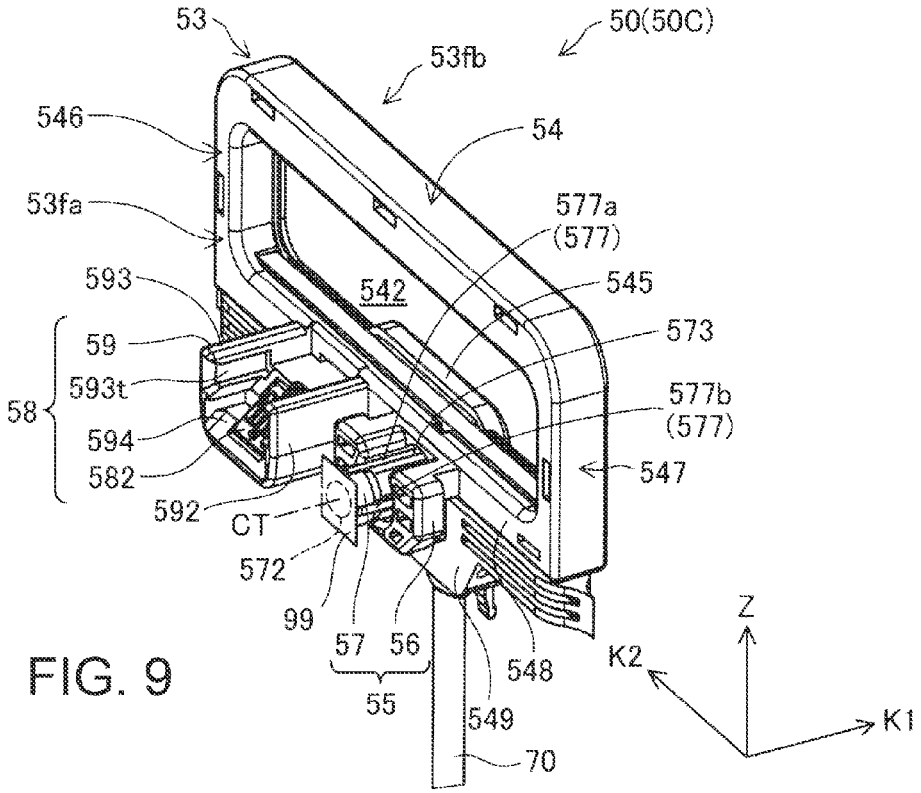
FIG. 9 is a first perspective view showing a part of the liquid containing body 50.
Figure 10:
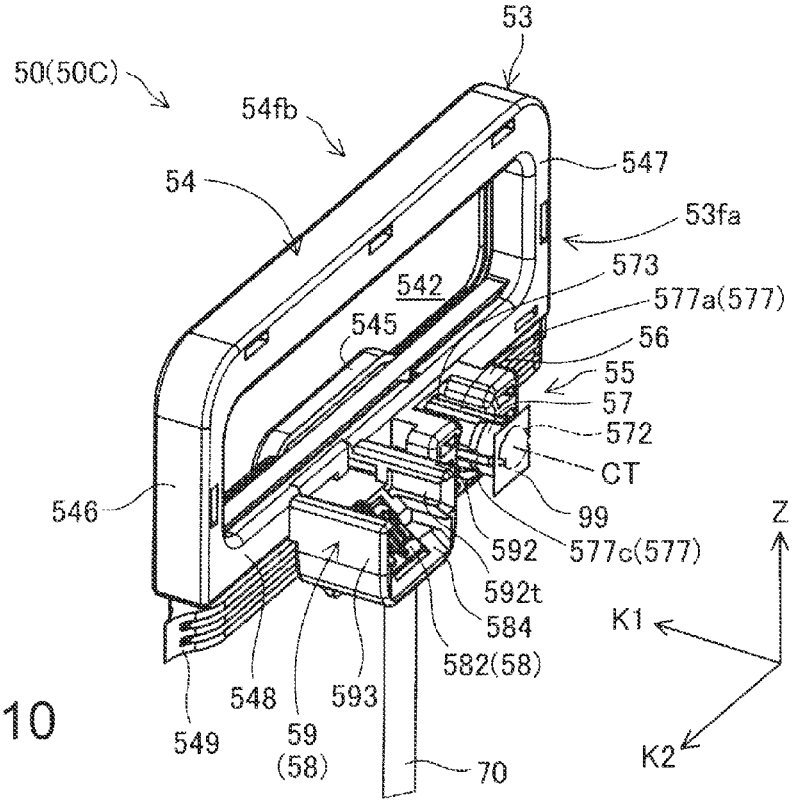
FIG. 10 is a second perspective view showing a part of the liquid containing body 50.
Figure 11:
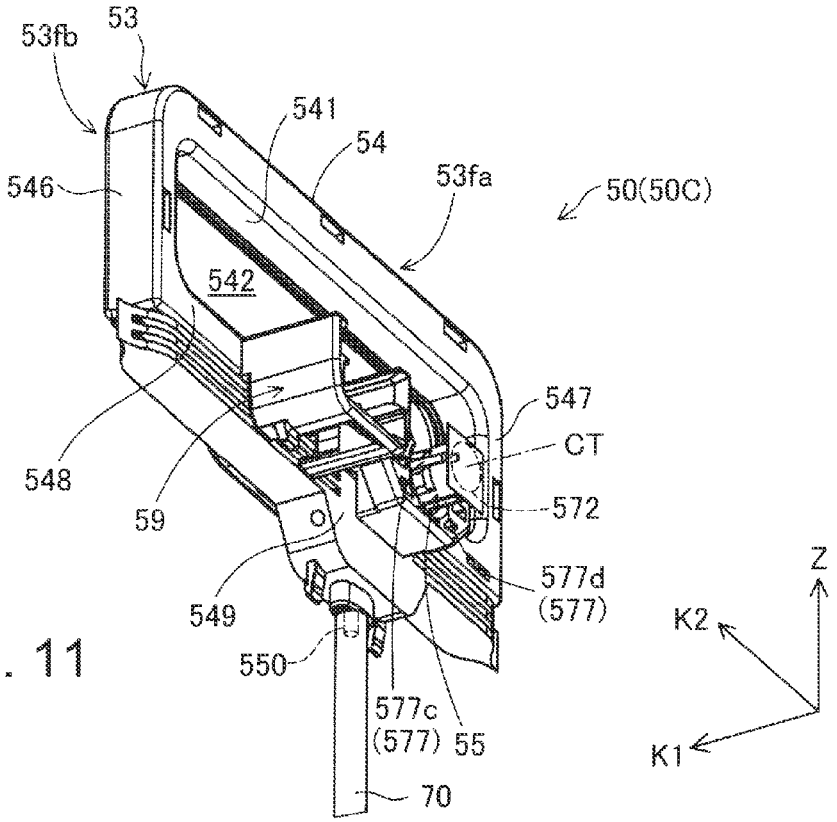
FIG. 11 is a third perspective view showing a part of the liquid containing body 50.
Figure 12:
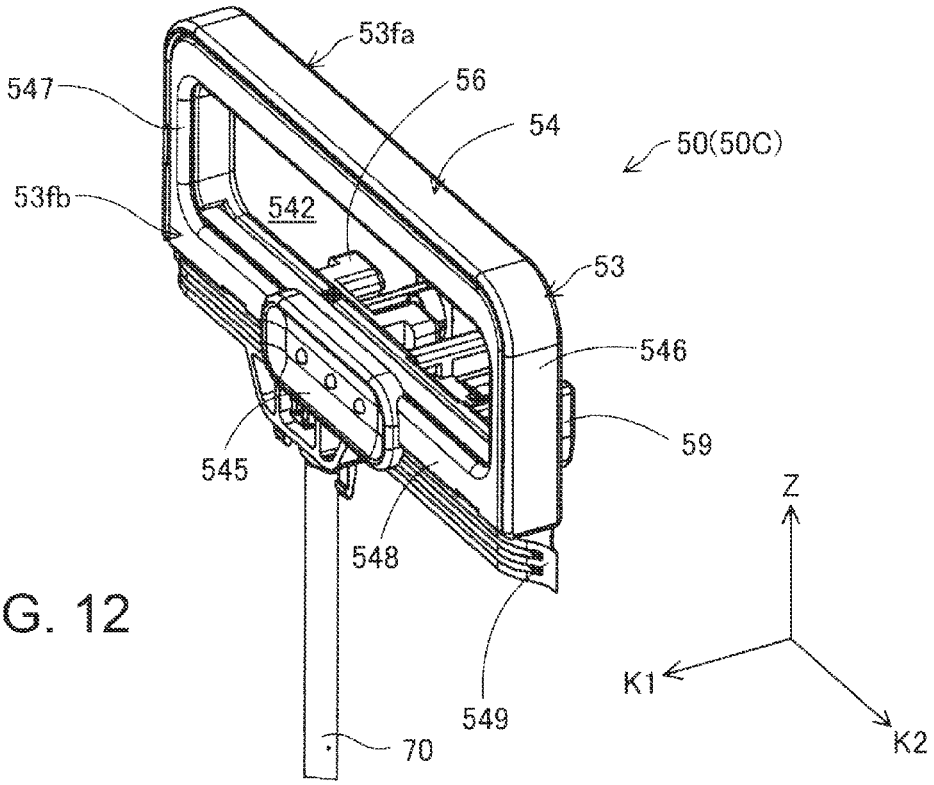
FIG. 12 is a fourth perspective view showing a part of the liquid containing body 50.
Figure 13:
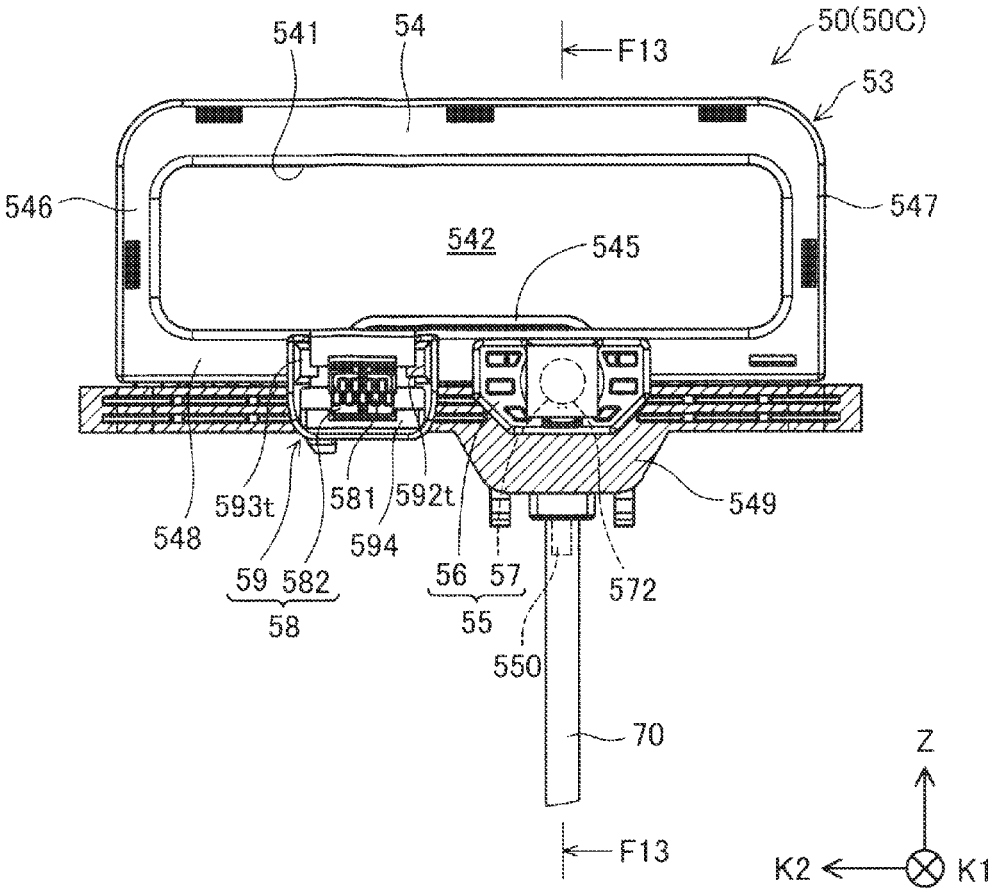
FIG. 13 is a front view of a part of the liquid containing body 50.
Figure 14:
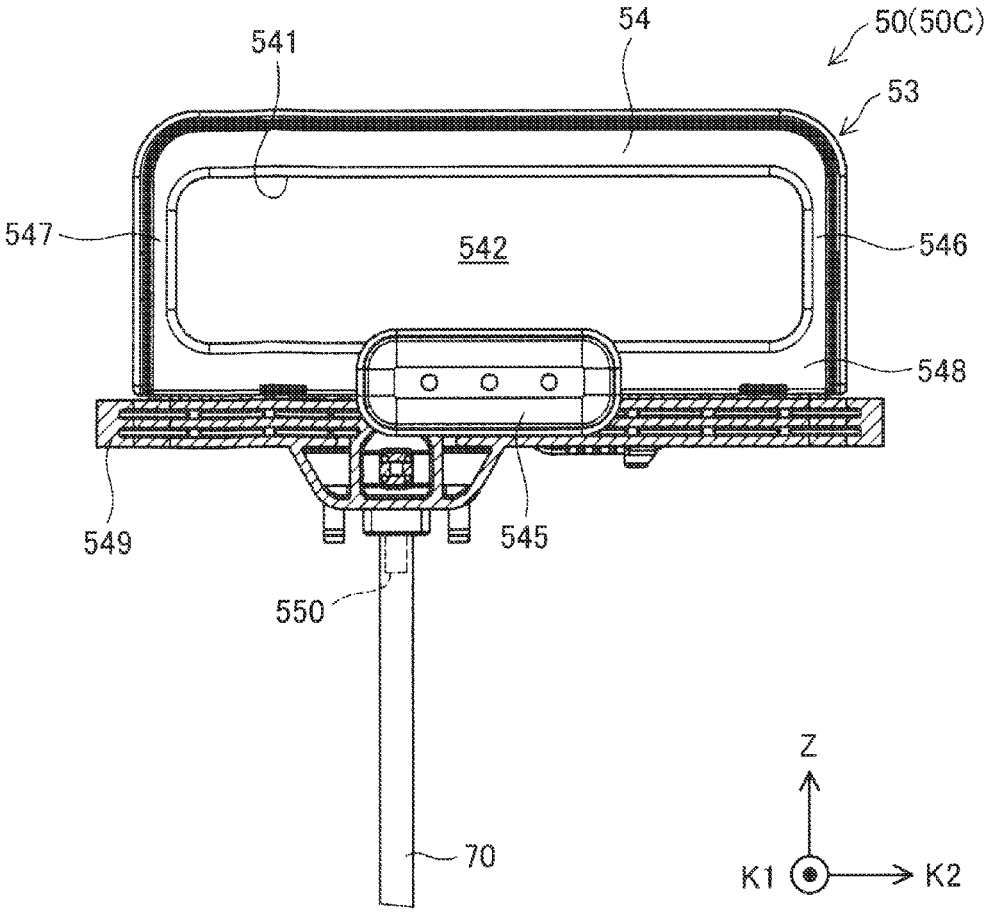
FIG. 14 is a back view of a part of the liquid containing body 50.
Figure 15:
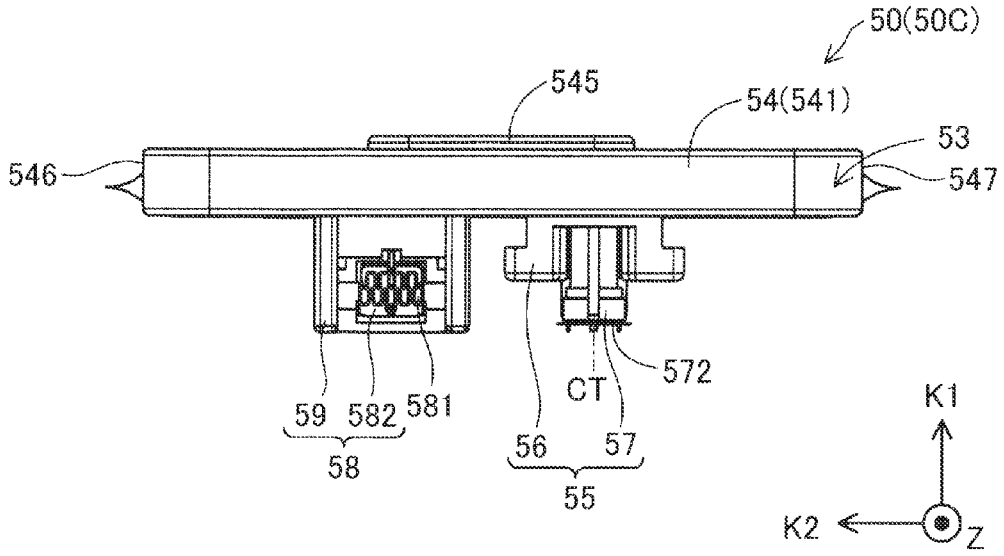
FIG. 15 is a top view of a part of the liquid containing body 50.
Figure 16:
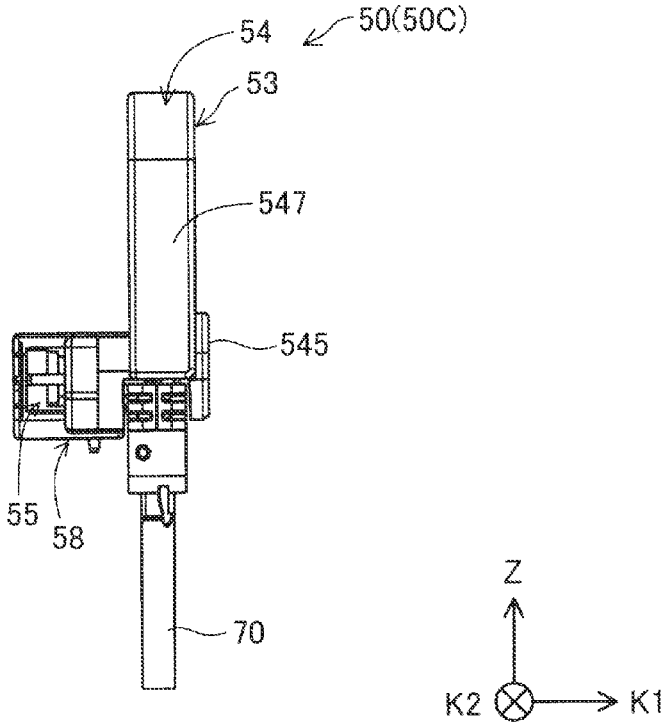
FIG. 16 is a right side view of a part of the liquid containing body 50.
Figure 17A:
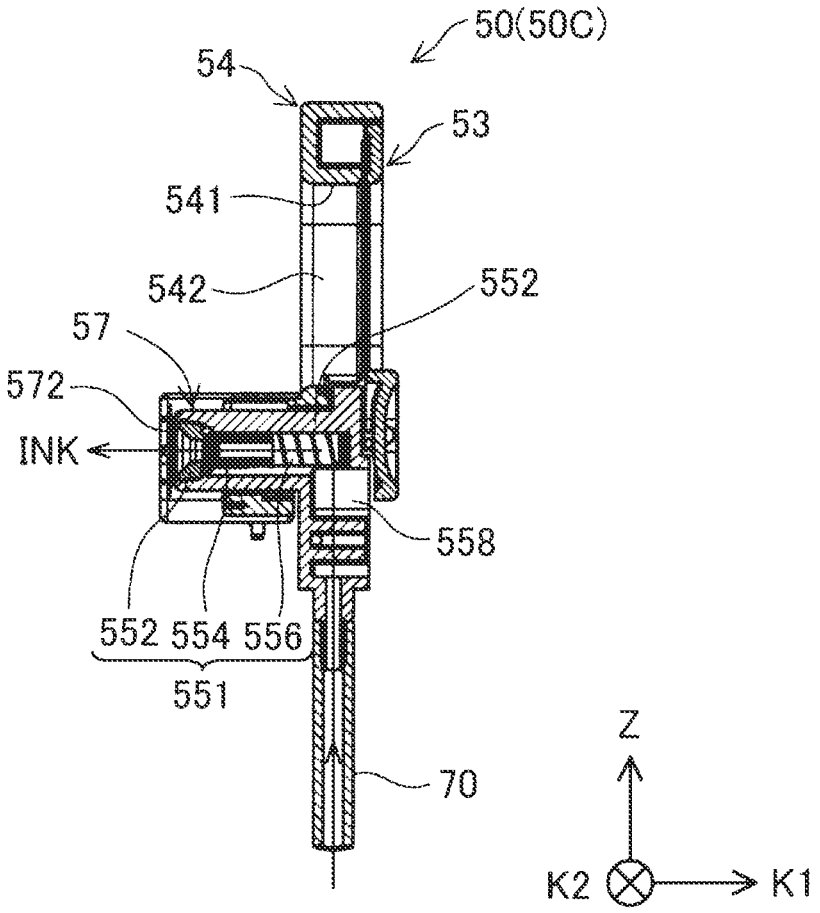
FIG. 17A is a cross-sectional view taken along line F13-F13 in FIG. 13.
Figure 17B:
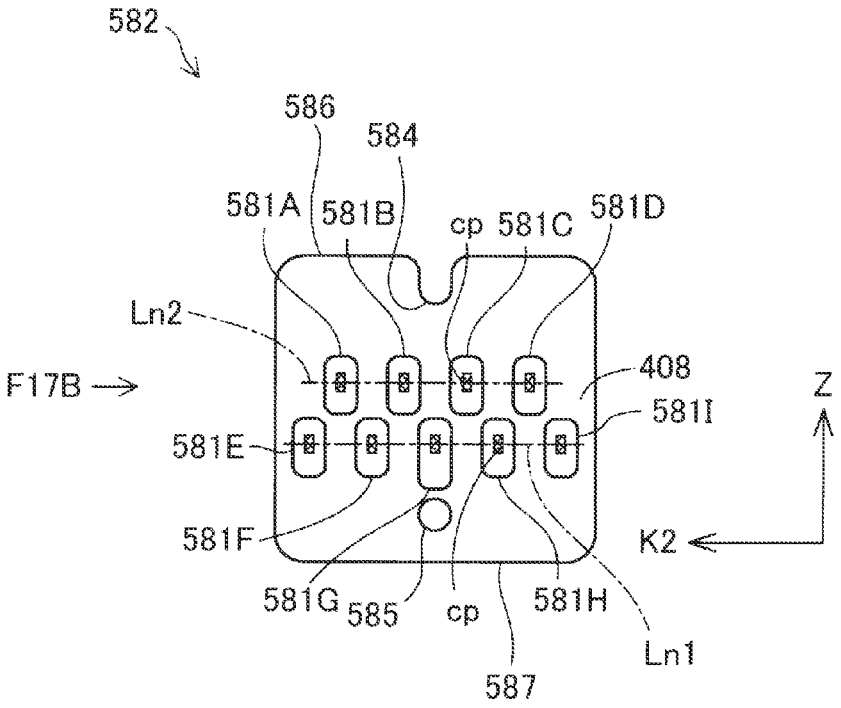
FIG. 17B is a front view of a circuit board 582.
Figure 17C:
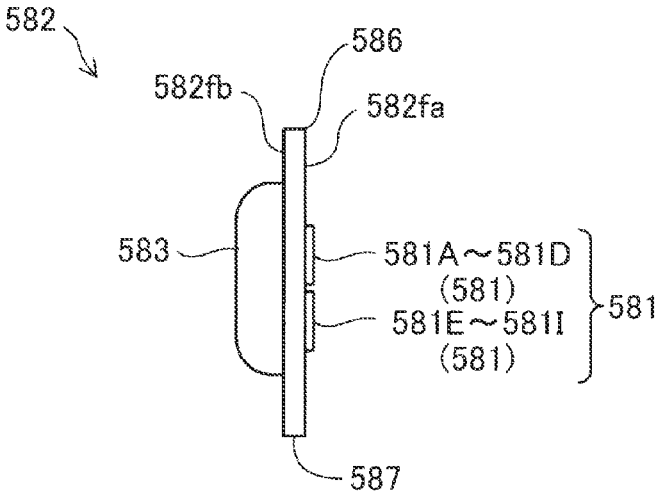
FIG. 17C shows the circuit board 582 as viewed along arrow F17B in FIG. 17B.

FIG. 9 is a first perspective view showing a part of the liquid containing body 50. FIG. 10 is a second perspective view showing a part of the liquid containing body 50. FIG. 11 is a third perspective view showing a part of the liquid containing body 50. FIG. 12 is a fourth perspective view showing a part of the liquid containing body 50. FIG. 13 is a front view of a part of the liquid containing body 50. FIG. 14 is a back view of a part of the liquid containing body 50. FIG. 15 is a top view of a part of the liquid containing body 50. FIG. 16 is a right side view of a part of the liquid containing body 50. FIG. 17A is a cross-sectional view taken along line F13-F13 in FIG. 13. FIG. 17B is a front view of the circuit board 582. FIG. 17C shows the circuit board 582 as viewed along arrow F17B in FIG. 17B. In FIGS. 9 to 17A, the liquid containing portion 52 included in the liquid containing body 50 is omitted.

As shown in FIGS. 9 and 10, the operation member 53 includes the holding portion 54, a first connection portion 546, a second connection portion 547, a base portion 548, and an attachment portion 549. Here, regarding the operation member 53, the Z-axis direction will also be called a "height direction", the K1-axis direction will also be called a "thickness direction", and the K2-axis direction will also be called a "width direction".

The holding portion 54, the first connection portion 546, the second connection portion 547, and the base portion 548 each have a bar shape. A frame-shaped member is formed by the holding portion 54, the first connection portion 546, the second connection portion 547, and the base portion 548. A receiving space portion 542 having a substantially rectangular shape for receiving a hand of the user is thereby demarcated and formed in the operation member 53.

The holding portion 54 is a portion at which the user holds the liquid containing body 50. The holding portion 54 extends in the K2-axis direction. As shown in FIG. 11, the holding portion 54 has a holding face (support face) 541 that is in contact with the receiving space portion 542. The holding face 541 is a portion that is directly supported (held) by the user. The holding face 541 is a flat surface that is substantially vertical to the Z-axis direction when in the attached state.

As shown in FIG. 9, the first connection portion 546 is a member extending from one end portion of the holding portion 54 in the K2-axis direction toward the side of the base portion 548 (the side in the −Z-axis direction, the side of the liquid containing portion 52 shown in FIG. 7). The second connection portion 547 is a member extending from the other end portion of the holding portion 54 in the K2-axis direction toward the side of the base portion 548 (the side in the −Z-axis direction, the side of the liquid containing portion 52 shown in FIG. 7). The base portion 548 is a portion opposed to the holding portion 54 with the receiving space portion 542 therebetween. The base portion 548 extends in the K2-axis direction. A positioning portion 56, a circuit board holding portion (contact portion arrangement portion) 59, and the press portion 545 (FIG. 12), which will be described later, are attached to the base portion 548.

The attachment portion 549 is located on the side opposite to the side on which the holding portion 54 is located with the base portion 548 therebetween. The attachment portion 549 is adjacent to the base portion 548. The attachment portion 549 extends in the K2-axis direction. The attachment portion 549 is a portion to which a first end portion 501 (FIG. 7) of the liquid containing portion 52 is attached by adhesion or the like. As shown in FIGS. 13 and 17A, the attachment portion 549 has a lead-out portion 550 for causing the ink contained in the liquid containing portion 52 to flow into the liquid supply portion 57. As a result of the lead-out portion 550 being connected to the flow path member 70, the ink that has flown through the flow path member 70 flows into the liquid supply portion 57 via the lead-out portion 550. Note that, in order to facilitate understanding, a portion of the attachment portion 549 to which the liquid containing portion 52 is attached is single-hatched in FIGS. 13 and 14.

As shown in FIGS. 9 and 10, the liquid supply unit 55 includes the liquid supply portion 57 and the positioning portion 56. Here, the positioning portion 56 is configured as a body separate from the liquid supply portion 57, and a small gap is formed between the positioning portion 56 and the liquid supply portion 57. The liquid supply unit 55 is provided so as to project outward (in the −K1-axis direction) of the operation member 53.

The liquid supply portion 57 has a liquid supply port 572, which is one end, and a supply connection portion 573, which is the other end. The liquid supply port 572 is in communication with the inside of the liquid containing portion 52, and guides the ink contained in the liquid containing portion 52 to the outside (printer 10). The liquid supply port 572 defines a flat surface (a face defined by the Z-axis direction and the K2-axis direction) vertical to the holding face 541. The supply connection portion 573 is connected to the operation member 53. The liquid supply portion 57 is a tubular member (ring-shaped member) extending in the K1-axis direction (the direction of a center axis CT). The liquid supply unit 57 is provided so as to project outward (in the −K1-axis direction) of the operation member 53.

The liquid supply portion 57 has the center axis CT. The center axis CT is parallel with the K1-axis direction. Here, of the K1-axis direction, the direction extending from the liquid supply port 572 toward the supply connection portion 573 is a +K1-axis direction, and the direction extending from the supply connection portion 573 toward the liquid supply port 572 is a −K1-axis direction. The liquid supply unit 55 having the above-described configuration guides the ink contained in the liquid containing body 50 from the liquid containing body 50 to the outside in cooperation with the flow path member 70.

As shown in FIG. 15, the holding face 541 is arranged on the side in a direction (+Z-axis direction) vertical to the direction (K1-axis direction) of the center axis CT of the liquid supply portion 57. The operation member 53 including the holding face 541 is provided so as to be offset in the direction of the center axis CT with respect to the liquid supply port 572. In other words, when the liquid containing body 50 is viewed from the side in the direction that is orthogonal to the holding face 541 and extends from the liquid supply port 57 toward the holding face 541 (+Z-axis direction), the liquid supply port 572 is arranged at a position that does not overlap the holding face 541 (operation member 53). That is to say, when the liquid containing body 50 is projected onto a plane parallel with the holding face 541, the holding face 541 and the liquid supply port 572 are in a positional relationship in which they do not overlap each other.

As shown in FIG. 9, in an unused liquid containing body 50, the liquid supply port 572 is closed by a film 99. It is thereby possible to suppress leakage of the ink from the liquid supply port 572 to the outside before the liquid containing body 50 is attached to the attachment/detachment unit 30 (FIG. 5). The film 99 is torn by the liquid introduction portion 362 (FIG. 5) when the liquid containing body 50 is attached to the attachment/detachment unit 30.

As shown in FIG. 17A, a valve mechanism 551 for opening and closing a liquid flow path formed by the liquid supply portion 57 is arranged within the liquid supply portion 57. The valve mechanism 551 includes a valve seat 552, a valve body 554, and a spring 556. The valve seat 552, the valve body 554, and the spring 556 are housed in this order within the liquid supply portion 57 from the liquid supply port 572 toward the supply connection portion 573 in the liquid supply portion 57.

The valve seat 552 is a substantially ring-shaped member. The valve seat 552 is constituted by an elastic body such as rubber or elastomer, for example. The valve seat 552 is press-fit to the inside of the liquid supply portion 57. The valve body 554 is a member having a substantially circular column shape. The valve body 554 blocks a hole (valve hole) formed in the valve seat 552 in a state before the liquid containing body 50 is attached to the attachment/detachment unit 30. The spring 556 is a compression coil spring. The spring 556 biases the valve body 554 in a direction extending toward the side of the valve seat 552. In the attached state of the liquid containing body 50, the valve body 554 moves toward the side of the supply connection portion 573 by the liquid introduction portion 362 (FIG. 5) pressing the valve body 554 toward the side of the supply connection portion 573. The valve body 554 thereby moves away from the valve seat 552, and the valve mechanism 551 enters an open state. When the valve mechanism 551 is in an open state, the ink contained in the liquid containing portion 52 (FIG. 7) can flow to the outside through the flow path member 70, and an inner flow path 558 and the liquid supply portion 57 in the operation member 53.

As shown in FIG. 9, the positioning portion 56 positions the liquid containing body 50 including the liquid supply port 572 with respect to the printer 10 to some extent when the liquid containing body 50 (liquid containing body) is connected to the printer 10. The positioning portion 56 is integrally provided with the operation member 53. In this embodiment, the positioning portion 56 is integrally provided with the operation member 53 by being produced together with the operation member 53 by integral molding. Here, "to be integrally provided" means that the positioning portion 56 is provided in the operation member 53 so as to move with the movement of the operation member 53. In another embodiment, the positioning portion 56 may be integrally provided with the operation member 53 by attaching the positioning portion 56 to the operation member 53 by adhesion or the like. Although the positioning portion 56 is provided near the liquid supply port 572 so as to surround the liquid supply port 572 in the circumferential direction excluding the upper side thereof, if the operation member 53 is made of a material that does not easily deform, the positioning portion 56 may be provided at a position on the operation member 53 that is slightly separate from the liquid supply port 572. The positioning portion 56 projects in the −K1-axis direction from the operation member 53.

As shown in FIGS. 9 and 10, the positioning portion 56 is arranged near the liquid supply port 572. Also, as shown in FIG. 13, at least a part of the positioning portion 56 is provided on the side of the liquid containing portion 52 (FIG. 7) (the side in the −Z-axis direction) with respect to the liquid supply port 572. In this embodiment, the positioning portion 56 is arranged at the periphery of the liquid supply portion 57 with the center axis CT as the center. Specifically, the positioning portion 56 is arranged at the periphery of the liquid supply portion 57 excluding the periphery thereof on the side of the holding portion 54. The positioning portion 56 is arranged within the supply portion support portion 42 provided in the attachment/detachment unit 30 (FIG. 5), when the liquid containing body 50 is connected to the printer 10. Movement of the liquid supply portion 57 is thereby restricted as a result of a plurality of face portions (e.g., the first support face portion 402, the second support face portion 403, and the third support face portion 404 shown in FIG. 5) that demarcate and form the supply portion support portion 42 abutting against the positioning portion 56, and the liquid containing body 50 is positioned to some extent. Thereafter, the liquid supply port 572 is connected to the liquid introduction portion 362 in a state of having been positioned by protrusions 577*a* to 577*d* (FIGS. 9 to 11) each serving as a containing body-side positioning portion. The protrusions 577*a* to 577*d* are provided in the outer circumference of the liquid supply portion 57 with the center axis CT as the center. The protrusions 577*a* to 577*d* are provided in the liquid supply portion 57 at upper, lower, left, and right positions of the liquid supply port 572. Specifically, as shown in FIG. 9, a first protrusion 577*a* is arranged at a part of the liquid supply portion 57 on the side in the upward direction with respect to the gravity (the side in the +Z-axis direction). A second protrusion 577*b* is arranged in a part of the liquid supply portion 57 on the side in the −K2-axis direction. As shown in FIG. 10, a third protrusion 577*c* is arranged in a part of the liquid supply portion 57 on the side in the +K2-axis direction. As shown in FIG. 11, a fourth protrusion 577*d* is arranged in a part of the liquid supply portion 57 on the side in the downward direction with respect to the gravity (the side in the −Z-axis direction). Note that a reference numeral "577" will be used when not distinguishing among the first to fourth protrusions 577*a* to 577*d*.

The liquid supply unit 55 has a function of supplying the ink contained in the liquid containing portion 52 (FIG. 7) to the printer 10. Accordingly, the liquid supply unit 55 can be considered to be a "liquid supply portion". In this case, the liquid supply unit 55 serving as the liquid supply portion has the liquid supply portion 57 having the liquid supply port 572 at one end, and the positioning portion 56.

As shown in FIGS. 9 and 10, the board unit (containing body-side electric connection portion) 58 includes the circuit board 582 and the circuit board holding portion 59. The board unit 58 is provided so as to project outward (in the −K1-axis direction) of the operation member 53. The protruding direction of the board unit 58 is the same as the protruding direction (−K1-axis direction) of the liquid supply portion 57. Note that the protruding direction of the board unit 58 and the protruding direction of the liquid supply portion 57 may not be the same, and need only be substantially parallel with each other. Also, the board unit 58 and the liquid supply portion 57 protrude from the operation member 53 toward the same side (the side in the −K1-axis direction) with respect to the operation member 53.

As shown in FIG. 15, the board unit 58 and the liquid supply unit 55 are provided side-by-side in a direction parallel with the holding face 541. Specifically, the board unit 58 and the liquid supply unit 55 are arranged side-by-side in the K2-axis direction that is parallel with the holding face 541 and orthogonal to the center axis CT.

As shown in FIG. 9, the circuit board holding portion 59 positions the circuit board 582 with respect to the printer 10 when the liquid containing body 50 is connected to the printer 10. The circuit board holding portion 59 is integrally provided with the operation member 53. In this embodiment, the circuit board holding portion 59 is integrally provided with the operation member 53 by being produced together with the operation member 53 by integral molding. Here, "to be integrally provided" means that the circuit board holding portion 59 is provided in the operation member 53 so as to move with the movement of the operation member 53. In another embodiment, it should be noted that the circuit board holding portion 59 may be integrally provided with the operation member 53 by attaching the circuit board holding portion 59 to the operation member 53 by adhesion or the like.

The circuit board holding portion 59 has a dent shape opening on the side in the +Z-axis direction (the side on which the holding portion 54 is located). A bottom portion 594 of the dent shape inclines with respect to the holding face 541 (FIG. 11). As a result of the circuit board 582 being attached to the bottom portion 594, the circuit board 582 is held by the circuit board holding portion 59 so as to incline as mentioned above. At least a part (the bottom portion 594) of the circuit board holding portion 59 is provided on the side of the liquid containing portion 52 (FIG. 7) (the side in the −Z-axis direction) with respect to the circuit board 582. That is to say, at least a part (the bottom portion 594) of the board unit (containing body-side electric connection portion) 58 that is different from contact portions cp (FIG. 17B) is provided on the side of the liquid containing portion 52 with respect to the contact portions cp.

The circuit board holding portion 59 has a first side wall portion 592 and a second side wall portion 593 that extend from both sides of the bottom portion 594 in the K2-axis direction toward the side in the +Z-axis direction. As shown in FIG. 10, the first side wall portion 592 has a groove portion 592*t*. As shown in FIG. 9, the second side wall portion 593 has a groove portion 593*t*. When the liquid containing body 50 is connected to the printer 10, the circuit board holding portion 59 is first supported by the board support portion 48 (FIG. 5). The circuit board holding portion 59 and the circuit board 582 are thereby positioned with respect to the apparatus-side terminals 381 (FIG. 5) to some extent. Then, by moving the movable member 40 of the attachment/detachment unit 30 shown in FIG. 5 in the −K1-axis direction, the apparatus-side positioning portion 385 shown in FIG. 6 enters the groove portion 593*t* (FIG. 9) of the circuit board holding portion 59, and the apparatus-side board positioning portion 384 shown in FIG. 6 enters the groove portion 592*t* (FIG. 10) of the circuit board holding portion 59. The circuit board holding portion 59 and the circuit board 582 are thereby positioned with respect to the apparatus-side terminals 381.

As shown in FIG. 13, the circuit board 582 has a plurality of terminals 581 on the surface. In this embodiment, nine terminals 581 are provided so as to correspond to the number of (nine) apparatus-side terminals 381. In this embodiment, the outer shape of each terminal 581 is a substantially rectangular shape. A storage device 583 (FIG. 17C) is arranged on the back face of the circuit board 582. The storage device 583 stores information (e.g., the amount of remaining ink, ink color) regarding the liquid containing body 50. The storage device 583 is electrically connected to the plurality of terminals 581. In the attached state, the plurality of terminals 581 are electrically connected to the respective apparatus-side terminals 381 (FIG. 6) in the electric connection portion 382 provided in the printer 10.

As shown in FIG. 17B, a boss groove 584 is formed in an upper end portion 586 of the circuit board 582 on the side in the +Z-axis direction, and a boss hole 585 is formed in a lower end portion 587 of the circuit board 582 on the side in the −Z-axis direction. The circuit board 582 is fixed to the bottom portion (arrangement portion) 594 using the boss groove 584 and the boss hole 585.

As shown in FIGS. 17B and 17C, the circuit board 582 has a liquid containing body-side terminal group 580 provided in a front face 582*fa*, and the storage device 583 provided on a back face 582*fb*. The front face 582*fa* and the back face 582*fb* are flat surfaces.

The liquid containing body-side terminal group 580 includes nine terminals 581A to 581I. The storage device 583 stores information (e.g., the amount of remaining ink, ink color) and the like regarding the liquid containing body 50.

As shown in FIG. 17B, the nine liquid containing body-side terminals 581A to 581I are each formed in a substantially rectangular shape, and are arranged so as to form two lines Ln1 and Ln2 at different positions in the Z-axis direction. The lines Ln1 and Ln2 are parallel with the K2-axis direction.

The liquid containing body-side terminals 581A to 581I each have, at the center thereof, a contact portion cp that comes into contact with the corresponding apparatus-side terminal 381 (FIG. 6). The above lines Ln1 and Ln2 can be considered to be lines formed by the plurality of contact portions cp. Note that a reference numeral "581" will be used when not distinguishing among the nine liquid containing body-side terminals 581A to 581I.

Thus, the containing body-side electric connection portion 58 has the contact portions cp capable of coming into contact with the apparatus-side electric connection portion 382. As shown in FIG. 9, the containing body-side electric connection portion 58 is integrally provided with the operation member 53.

As shown in FIG. 15, the holding face 541 is arranged on the side in a direction (+Z-axis direction) vertical to the direction of the center axis CT of the liquid supply portion 57. The board unit 58 serving as the containing body-side electric connection portion is provided so as to be offset in the direction of the center axis CT with respect to the operation member 53 including the holding face 541. In other words, when the liquid containing body 50 is viewed from the side in the direction (+Z-axis direction) that is orthogonal to the holding face 541 and extends from the liquid supply portion 57 toward the holding face 541, the board unit 58 is arranged at a position that does not overlap the holding face 541 (operation member 53). That is to say, when the liquid containing body 50 is projected onto a plane parallel with the holding face 541, the holding face 541 and the board unit 58 are in a positional relationship in which they do not overlap each other. In this case, at least the circuit board 582 of the board unit 58 need only be arranged at a position that does not overlap the holding face 541 (the operation member 53).

As shown in FIGS. 9 and 12, it is assumed that the side of the operation member 53 in the −K1-axis direction is a first side 53*fa*, and the side of the operation member 53 on the side in the +K1-axis direction that is opposite to the first side 53*fa* is a second side 53*fb*. As shown in FIG. 9, the circuit board holding portion 59 (the board unit 58) and the positioning portion 56 are provided on the same side, i.e., the first side 53*fa*.

As shown in FIG. 12, the press portion 545 is provided on the second side 53*fb* that is opposed to the positioning portion 56 and the circuit board holding portion 59 (the board unit 58) with the operation member 53 therebetween. That is to say, as shown in FIG. 11, the positioning portion 56 and the circuit board holding portion 59 are provided on the surface of the base portion 548 on the first side 53*fa*, and on the other hand, as shown in FIG. 12, the press portion 545 is provided on the surface of the base portion 548 on the second side 53*fb*. Also, as shown in FIGS. 15 and 16, at least a part of the press portion 545 is opposed to the positioning portion 56 and the circuit board holding portion 59 with the operation member 53 therebetween.

The press portion 545 is a portion to be pressed by the user when connecting the liquid containing body 50 to the printer 10. That is to say, the press portion 545 is a portion to be manually pressed. As a result of the press portion 545 being pressed toward the side in the −K1-axis direction, the movable member 40 (FIG. 6) to which the liquid containing body 50 is set is moved toward the side in the −K1-axis direction.

The press portion 545 is provided so as to project from the operation member 53 in the +K1-axis direction. Thereby, the press portion 545 can be easily distinguished from other portions, and it is possible to prompt the user to perform an operation of pressing the press portion 545 when connecting the liquid containing body 50 to the printer 10. As shown in FIG. 14, when the operation member 53 is viewed in a direction parallel with the K1-axis direction, a part of the outer shape of the press portion 545 protrudes outward of the base portion 548. The surface area of the press portion 545 can thereby be increased, and accordingly the user can easily press the press portion 545.

The operation member 53, the circuit board holding portion 59, the positioning portion 56, the liquid supply portion 57, and the press portion 545 may be formed by the same material, or may be formed by different materials in accordance with the usage. The material of the operation member 53 may be a synthetic resin such as polyethylene (PE), polypropylene (PP), or ABS resin, for example.

A-4. Method for Attaching Liquid Containing Body 50 to Attachment/Detachment Unit 30

Figure 18:
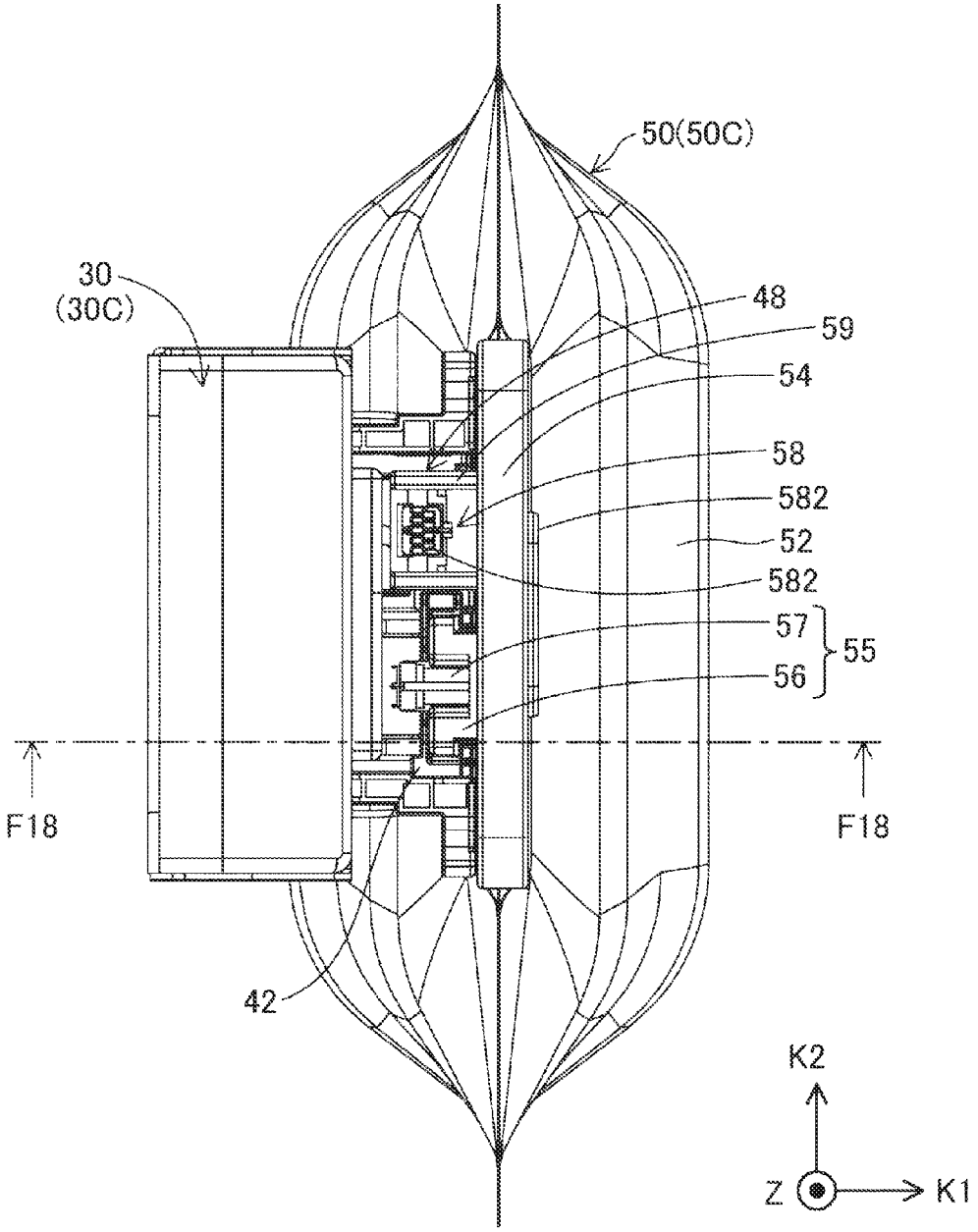
FIG. 18 is a view of the liquid containing body 50 when being set to the attachment/detachment unit 30.
Figure 19:
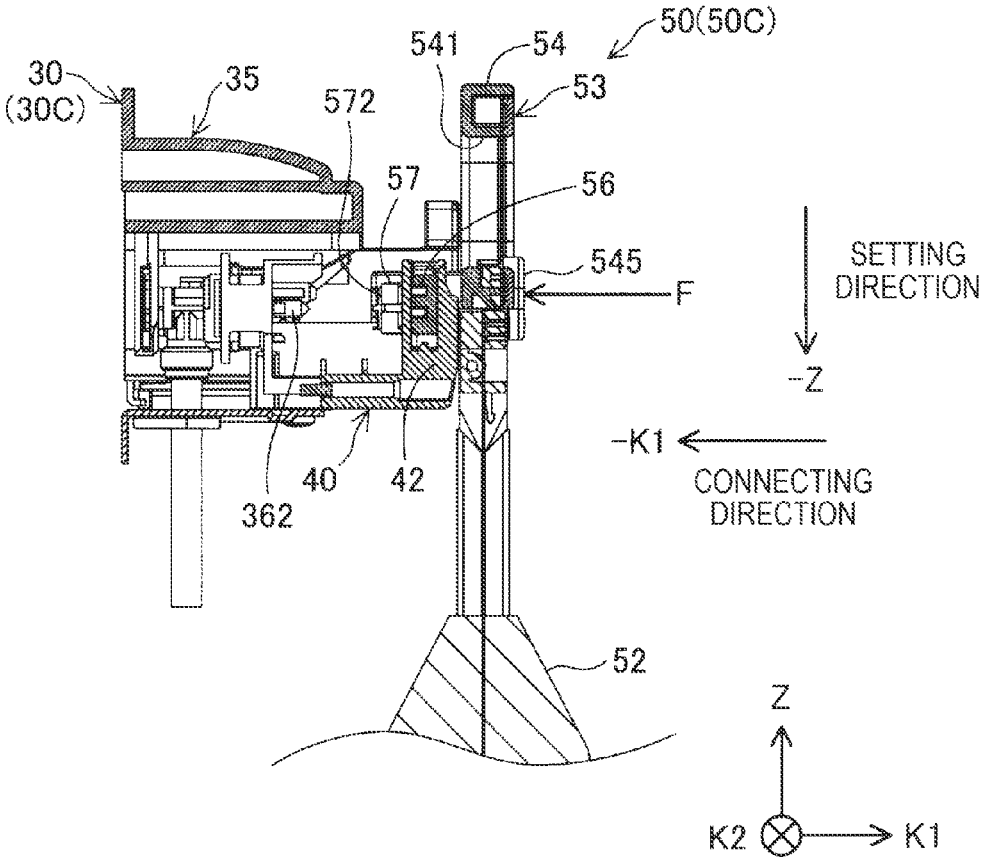
FIG. 19 is a partial cross-sectional view taken along line F18-F18 in FIG. 18.
Figure 20:
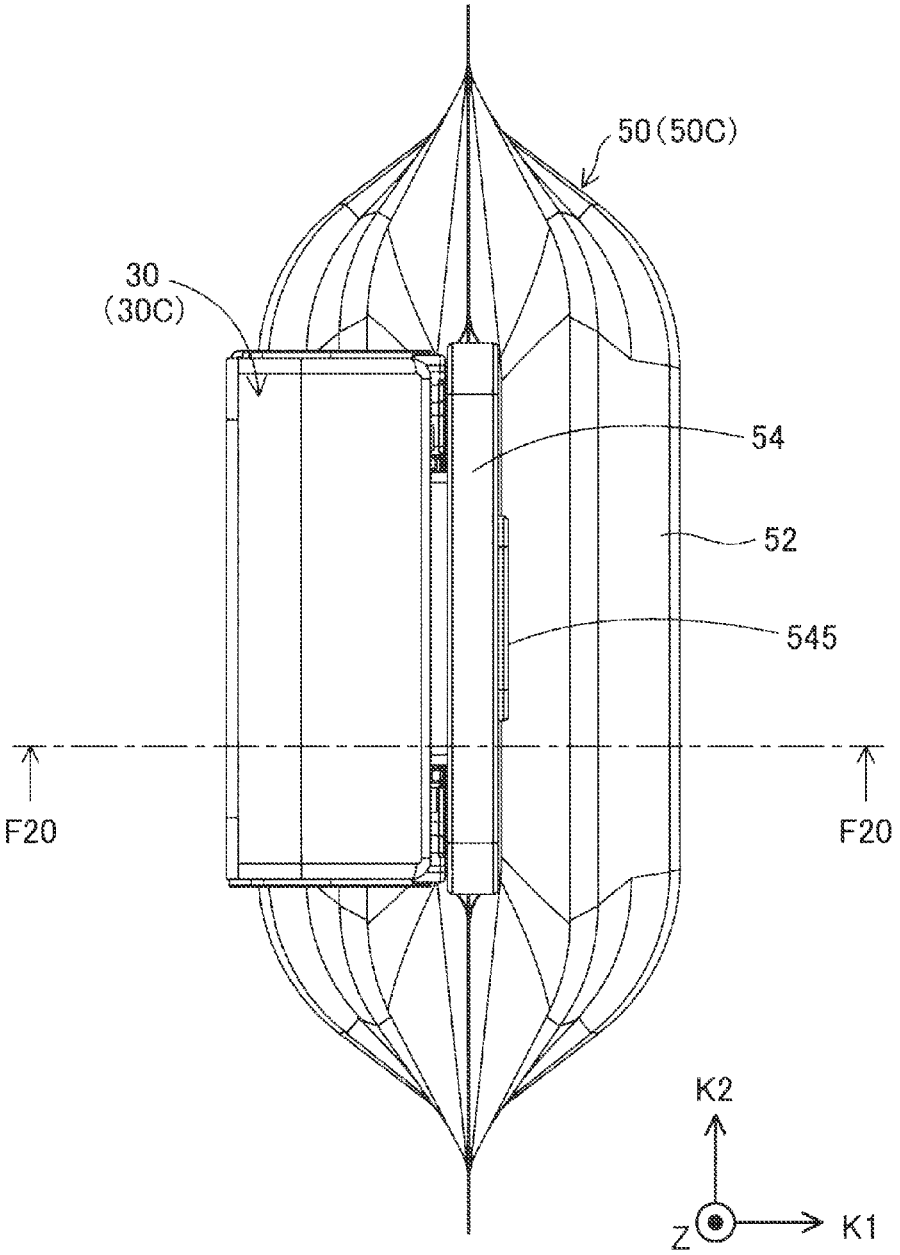
FIG. 20 is a view of the liquid containing body 50 when being attached to the attachment/detachment unit 30.
Figure 21:
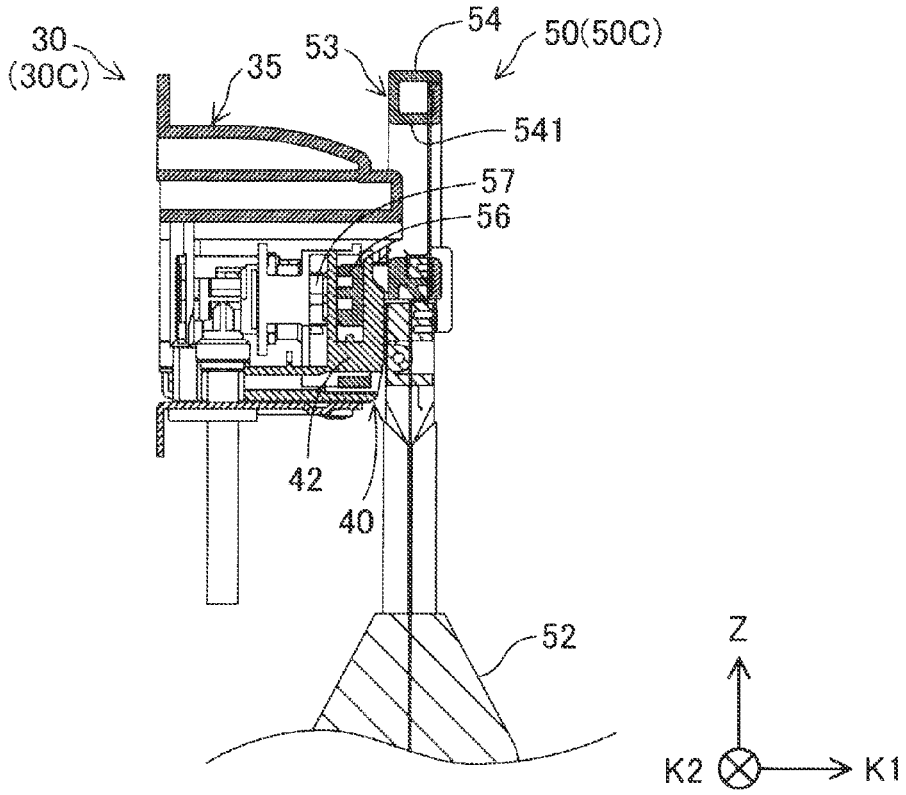
FIG. 21 is a partial cross-sectional view taken along line F20-F20 in FIG. 20.

FIG. 18 is a view of the liquid containing body 50 when being set to the attachment/detachment unit 30. FIG. 19 is a partial cross-sectional view taken along line F18-F18 in FIG. 18. FIG. 20 is a view of the liquid containing body 50 when being attached to the attachment/detachment unit 30. FIG. 21 is a partial cross-sectional view taken along line F20-F20 in FIG. 20. The state of the attachment/detachment unit 30 shown in FIGS. 18 and 19 is the first state as in FIG. 5. The state of the attachment/detachment unit 30 shown in FIGS. 20 and 21 is the second state as in FIG. 6.

As shown in FIG. 19, when attaching the liquid containing body 50 to the attachment/detachment unit 30, two operations are performed, which are an operation (a setting operation or a first operation) of moving the liquid containing body 50 in a setting direction, and an operation (a connecting operation or a second operation) of moving the liquid containing body 50 in a connecting direction. The setting direction is a direction including a component in the vertically downward direction (the −Z-axis direction). In this embodiment, the setting direction is the vertically downward direction.

The user sets the liquid containing body 50 to the movable member 40 of the attachment/detachment unit 30 that is in the first state. Specifically, the user holds the holding portion 54 in a state where the operation member 53 is further on the side in the vertically upward direction than the liquid containing portion 52. Then, as shown in FIGS. 18 and 19, the user arranges the positioning portion 56 of the liquid containing body 50 into the supply portion support portion 42, and arranges the circuit board holding portion 59 within the board support portion 48.

After the liquid containing body 50 is set to the movable member 40, the user presses the press portion 545 in the −K-axis direction toward the movable member 40, as indicated by arrow F in FIG. 19. The liquid containing body 50 and the movable member 40 thereby move in the connecting direction (the −K1-axis direction).

As shown in FIG. 21, in the second state of the attachment/detachment unit 30 with the movable member 40 housed in the fixed member 35, the liquid introduction portion 362 (FIG. 19) is inserted (connected) to the inside of the liquid supply portion 57. In the second state, the circuit board 582 is electrically connected to the electric connection portion 382 as a result of the terminals 581 (FIG. 13) of the circuit board 582 coming into contact with the apparatus-side terminals 381 (FIG. 6) of the electric connection portion 382.

The aforementioned connection of the liquid introduction portion 362 of the attachment/detachment unit 30 to the liquid supply portion 57 of the liquid containing body 50 and the electric connection between the circuit board 582 of the liquid containing body 50 and the electric connection portion 382 of the attachment/detachment unit 30 are simultaneously performed when attaching the liquid containing body 50. When attaching the liquid containing body 50, the attachment/detachment unit 30 supports a part, i.e., an upper end of the liquid containing body 50 in a state where the liquid containing body 50 is exposed, as shown in FIGS. 20 and 21.

A-5. Configuration of Stirring of Ink Contained in Liquid Containing Body 50

Figure 22:
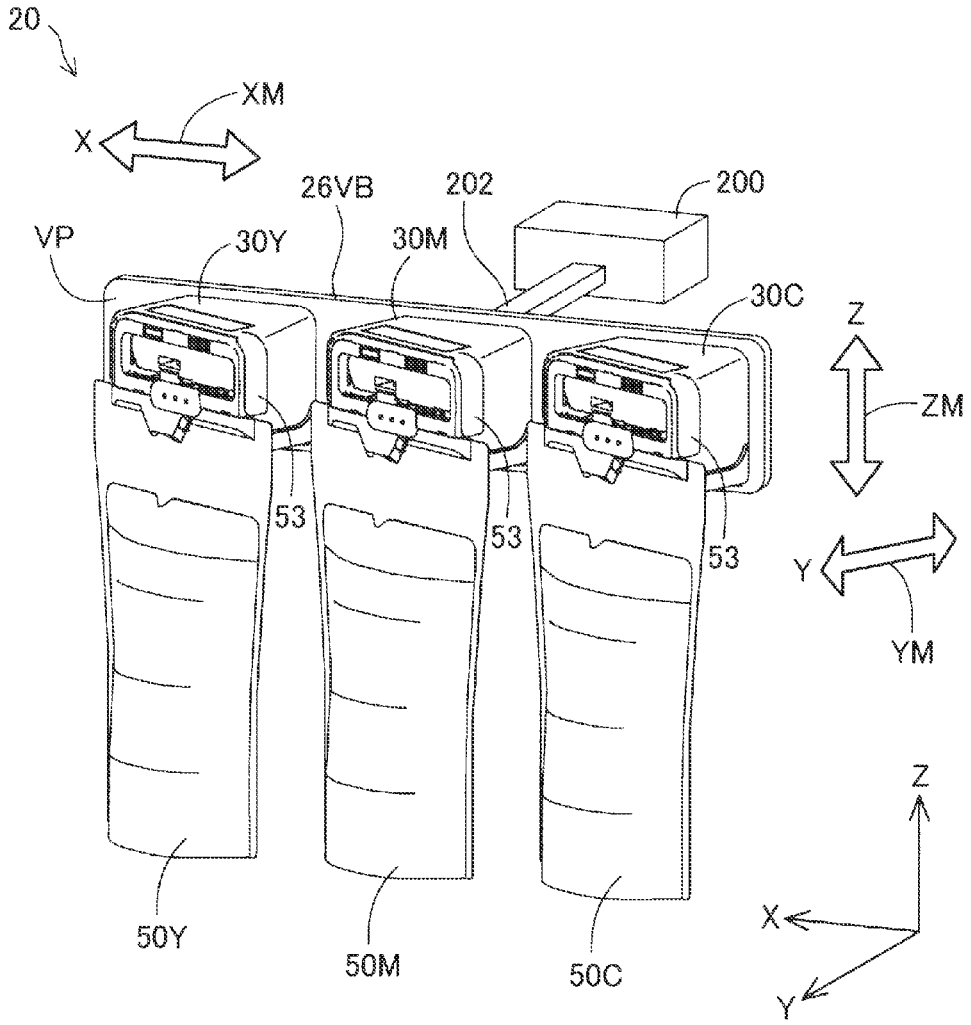
FIG. 22 is an illustrative view showing an outline of a stirring mechanism for stirring ink in the liquid containing body 50.
Figure 23:
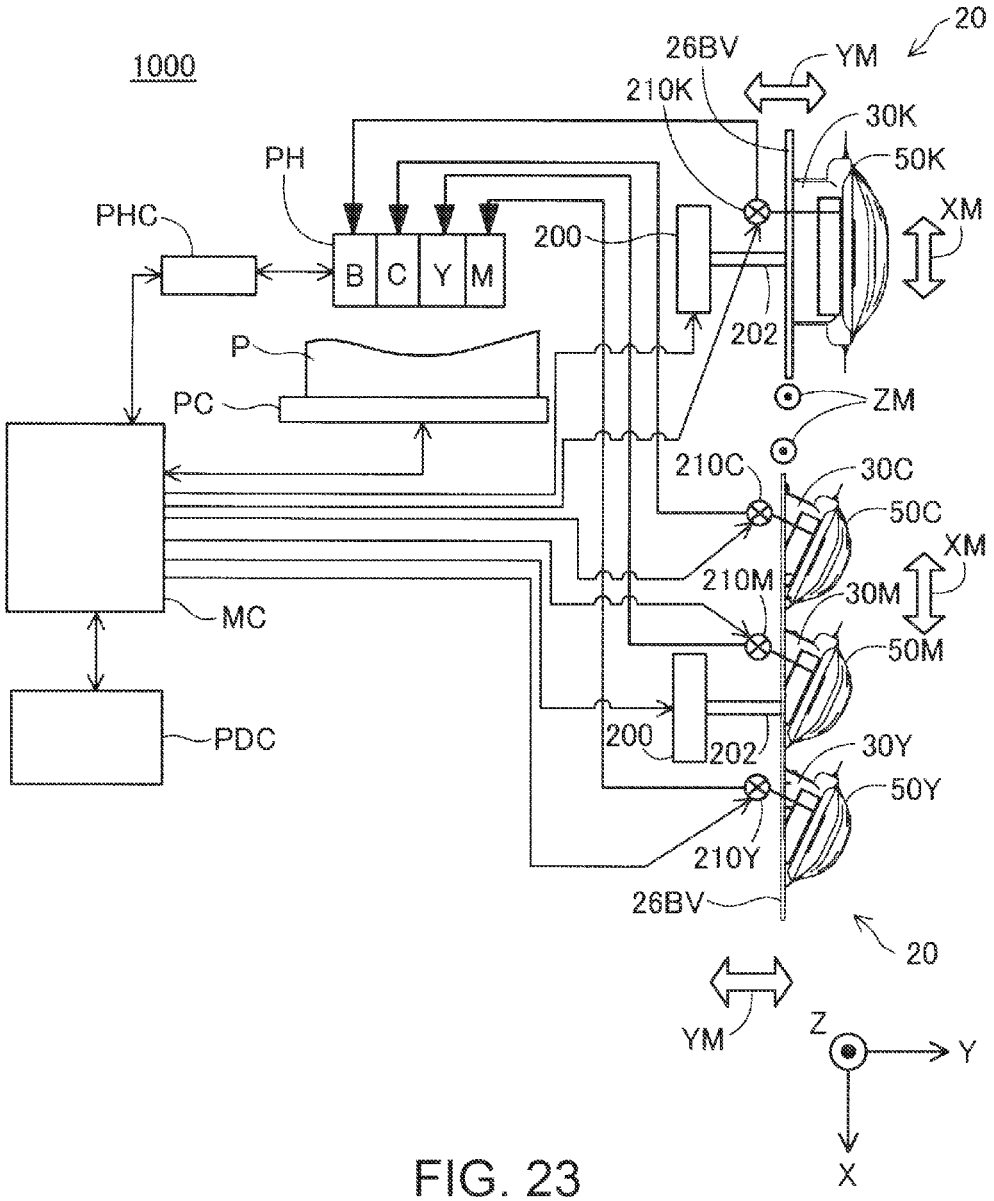
FIG. 23 is a device block diagram schematically showing an electric configuration involved in ink stirring.

FIG. 22 is an illustrative view showing an outline of a stirring mechanism for stirring ink in the liquid containing body 50, and FIG. 23 is a device block diagram schematically showing an electric configuration involved in ink stirring.

As shown in FIG. 22, the attachment/detachment unit 30C, the attachment/detachment unit 30M, and the attachment/detachment unit 30Y are fixed to a back board 26BV of the housing space portion 26 (see FIG. 4) by the screws 302 (see FIGS. 5 and 6). The back board 26BV is incorporated in the housing space portion 26B so as to be able to be driven to reciprocate in one of the X-axis direction, the Y-axis direction, and the Z-axis direction. This back board 26BV is joined to an axis direction drive unit 200 by a joint shaft 202. The axis direction drive unit 200 contains a driving source such as a piston or a motor, and a conversion mechanism for converting the driving thereof into reciprocating movement in the axis direction of the back board 26BV, and is driven by a later-described control apparatus MC so as to transmit the reciprocating movement in the axis direction to the back board 26BV through the joint shaft 202. For example, if the axis direction drive unit 200 is configured to reciprocate in the X-axis direction, the back board 26BV is driven by the axis direction drive unit 200 and thereby causes an X-axis reciprocating movement XM along a linear trajectory in the X-axis direction. Similarly, if the axis direction drive unit 200 is configured to reciprocate in the Y-axis direction or the Z-axis direction, the back board 26BV causes a Y-axis reciprocating movement YM along a linear trajectory in the Y-axis direction or a Z-axis reciprocating movement ZM along a linear trajectory in the Z-axis direction. The same applies to the attachment/detachment unit 30K shown in FIG. 3.

As shown in FIG. 22, in the above-described attachment/detachment units 30, the liquid containing body 50C, the liquid containing body 50M, and the liquid containing body 50Y are supported in a suspended manner in a state where the respective liquid containing portions 52 are exposed as described above. Accordingly, in the liquid supply apparatus 20 including the attachment/detachment units 30 and the liquid containing bodies 50 that are attached thereto, the axis direction drive unit 200, the joint shaft 202, and the back board 26BV are caused to function as an operating portion that applies a movement to the liquid containing portions 52 of the liquid containing bodies 50 supported by the respective attachment/detachment units 30.

As shown in FIG. 23, the liquid consuming system 1000 includes, as an electric configuration involved in the driving of the back board 26BV in the liquid supply apparatus 20, the control apparatus MC, a head controller PHC, a paper feed/discharge controller PC, and a print data controller PDC. These are each configured as a computer including a CPU, a ROM, a RAM, and the like, and the control apparatus MC comprehensively controls the overall liquid consuming system 1000. The head controller PHC causes print heads PH to reciprocate, and also controls discharge of ink from the print heads of the respective colors. The print data controller PDC reads out print data desired by the user from a memoly medium (not shown), and performs data processing and data management necessary for printing such as color conversion. The paper feed/discharge controller PC is involved in conveyance, feed, and discharge of printing paper P. The control apparatus MC performs control for driving the axis direction drive unit 200 that causes the aforementioned reciprocating movement of the attachment/detachment unit 30K, the attachment/detachment unit 30C, and the like via the back board 26BV, and performs control for opening and closing feed/discharge valves 210 for the respective color ink. The feed/discharge valves 210 are a feed/discharge valve 210K corresponding to the attachment/detachment unit 30K, a feed/discharge valve 210C corresponding to the attachment/detachment unit 30C, a feed/discharge valve 210M corresponding to the attachment/detachment unit 30M, and a feed/discharge valve 210Y corresponding to the attachment/detachment unit 30Y. These are incorporated in the respective attachment/detachment units 30, and open and close the ink flow paths from the liquid containing bodies 50 at the attachment/detachment units 30.

A-6. Ink Stirring Control of Liquid Containing Body 50

Figure 24:
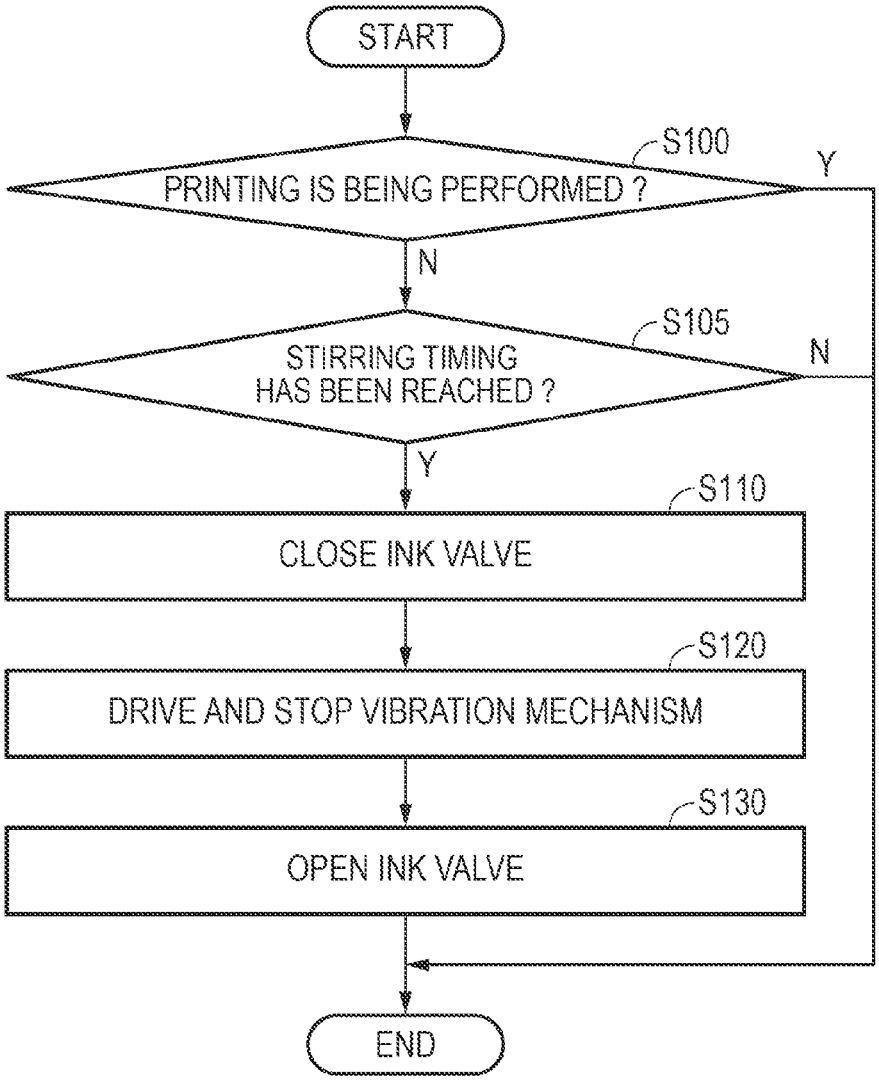
FIG. 24 is a flowchart showing stirring processing for causing ink stirring.

FIG. 24 is a flowchart showing stirring processing for causing ink stirring. The stirring processing shown in FIG. 24 is repeatedly executed by the control apparatus MC. The control apparatus MC first determines whether or not printing is being executed by the printer 10 (step S100), and if the printing is being executed, the control apparatus MC ends the processing here without performing subsequent processing. Thereby, later-described driving of the axis direction drive unit 200 is not caused during the printing, and accordingly the influence of vibration caused with the driving of the axis direction drive unit 200 exerted on print quality can be eliminated. If it is determined in step S100 that printing is not being performed, the control apparatus MC determines whether or not an ink stirring timing has come, based on elapsed time after replacement of the liquid containing bodies 50, the amount of consumed ink, the amount of remaining ink, and the like (step S105). Here, if it is determined that the stirring timing has not been reached, the control apparatus MC ends the processing here without performing subsequent processing. The determination in step S105 may be performed individually for the ink of the respective colors that are black, cyan, magenta, and yellow, or may be uniformly performed regardless of the ink color.

If it is determined in step S105 that the stirring timing has come, the control apparatus MC drives the respective feed/discharge valves 210 so as to close (step S110). Next, the control apparatus MC performs drive control of the respective axis direction drive units 200 for a predetermined time, and thereafter performs stop control (step S120). When performing the stirring processing of this routine for each color ink as mentioned above, the control apparatus MC drives the feed/discharge valve 210K corresponding to the ink of the color regarding which the stirring timing has come, e.g., corresponding to the liquid containing body 50K of the black ink so as to open (step S110), performs drive control of the axis direction drive unit 200 corresponding to the liquid containing body 50K for a predetermined time, and thereafter performs stop control (step S120). By this driving of the axis direction drive unit 200, the attachment/detachment units 30 themselves each cause the X-axis reciprocating movement XM, the Y-axis reciprocating movement YM, or the Z-axis reciprocating movement ZM as shown in FIG. 22. Accordingly, since the attachment/detachment units 30 each cause the liquid containing portion 52 of the corresponding liquid containing body 50 supported at the upper end thereof to reciprocate, the ink is stirred, and the pigment is dispersed and does not precipitate in the liquid containing portion 52.

Subsequently to the stop control of the axis direction drive units 200, the control apparatus MC performs control for opening the feed/discharge valves 210 (step S130), and ends this routine.

A-7. Effects

The liquid consuming system 1000 in this embodiment having the above-described configuration includes the liquid supply apparatuses 20 that use the attachment/detachment units 30 for attaching the liquid containing bodies 50. In each liquid supply apparatus 20, the liquid containing body 50 is supported using the fixed member 35 of the attachment/detachment unit 30 without using a casing, and at the time of the supporting, a part of the liquid containing body 50 is supported, rather than the entire liquid containing body 50. More specifically, the liquid containing body 50 is supported at the upper end thereof. Accordingly, with the liquid supply apparatuses 20 in this embodiment, the structure for supporting the liquid containing body 50 can be simplified as compared with a configuration in which the liquid containing portion is supported using a casing. It is possible, through this simplification of the configuration, to reduce the number of parts, and also suppress an increase in the size and complication of the system.

In each liquid supply apparatus 20 in this embodiment, the liquid containing body 50 need only be attached to the attachment/detachment unit 30 so as to be supported by the attachment/detachment unit 30 in a state where the liquid containing portion 52 of the liquid containing body 50 is exposed, and the axis direction drive unit 200 need only be driven so as to reciprocate. Accordingly, with the liquid supply apparatus 20 in this embodiment, it is possible to easily apply the reciprocating movement to the liquid containing portion 52 and easily and reliably stir the ink contained in the liquid containing portion 52, as compared with a liquid containing body in which the liquid containing portion 52 is covered with a casing. Accordingly, a load placed on the attachment/detachment unit 30, the back board 26BV, and the axis direction drive unit 200 can be reduced.

As a result, with the liquid supply apparatus 20 in this embodiment, the device configuration involved in ink stirring in the liquid containing portion 52 can be simplified, and simplification and a reduction in the size of the system are also possible. Furthermore, as compared with a liquid containing body in which the liquid containing portion is covered with a casing, the movement can be easily transmitted directly to the liquid containing portion 52. Therefore, in this regard as well, the simplification of devices constituting the axis direction drive unit 200, and the simplification and the reduction in the size of the system can be promoted with the liquid supply apparatus 20 in this embodiment.

In the liquid supply apparatus 20 in this embodiment, when stirring ink in the liquid containing portion 52 in the liquid containing body 50, the attachment/detachment unit 30 need only be caused, using the axis direction drive unit 200, to perform the X-axis reciprocating movement XM along a linear trajectory in the X-axis direction, the Y-axis reciprocating movement YM along a linear trajectory in the Y-axis direction, or the Z-axis reciprocating movement ZM along a linear trajectory in the Z-axis direction. This reciprocating movement along the linear trajectory can be caused with a plain device configuration. Accordingly, with the liquid supply apparatus 20 in this embodiment, omission of a device installation space and an improvement of the degree of freedom in device arrangement are possible by making the device configuration plain and simple. Furthermore, with the liquid supply apparatus 20 in this embodiment, the liquid containing portion 52 is efficiently vibrated by causing the aforementioned reciprocating movement of the attachment/detachment unit 30 that supports the liquid containing body 50 at the upper end thereof, and the ink contained in the liquid containing portion 52 can be easily and reliably stirred. The operation speed of the aforementioned reciprocating movement, i.e., the frequency in the case of assuming the reciprocating movement to be vibration may be determined as appropriate such that ink stirring is caused, in accordance with the maximum ink capacity and the amount of remaining ink in the liquid containing portion 52. Note that, in the liquid supply apparatus 20, the liquid introduction portion 362 of the attachment/detachment unit 30 is caused to enter the liquid supply portion 57 of the liquid containing body 50 after causing the positioning portion 56 of the liquid containing body 50 to enter the supply portion support portion 42 of the attachment/detachment unit 30. Therefore, even if the attachment/detachment unit 30 vibrates, leakage of the ink from the liquid supply portion 57 can be avoided.

In addition, the following advantages can be achieved with the liquid supply apparatus 20 in this embodiment. The liquid supply apparatus 20 in this embodiment integrally includes the positioning portion 56 and the containing body-side electric connection portion 58 in the operation member 53. Accordingly, with the liquid supply apparatus 20 in this embodiment, the liquid containing body 50 can be operated while holding the operation member 53 when connecting the liquid containing body 50 to the printer 10. Therefore, the operability is better than a liquid containing body that does not have the operation member 53. Moreover, it is possible to simultaneously achieve insertion of the liquid introduction portion 362 of the attachment/detachment unit 30 into the liquid supply portion 57 of the liquid containing body 50 and electric connection between the terminals of the circuit board 582 of the liquid containing body 50 and the electric connection portion 382 of the contact point mechanism 38 in the attachment/detachment unit 30, which is convenient.

B. Second Embodiment

B-1. Configuration of Liquid Supply Apparatus

Figure 25:
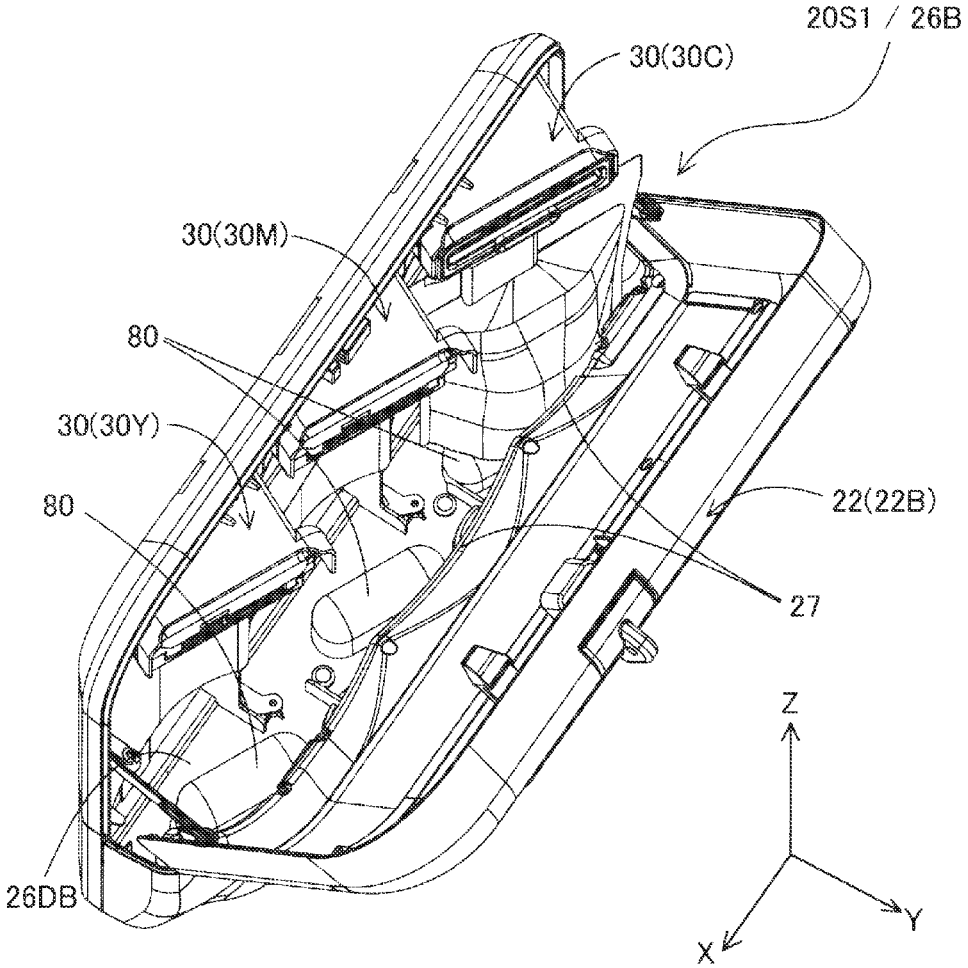
FIG. 25 is an illustrative view for illustrating a liquid supply apparatus 20S1 in a second embodiment.
Figure 26:
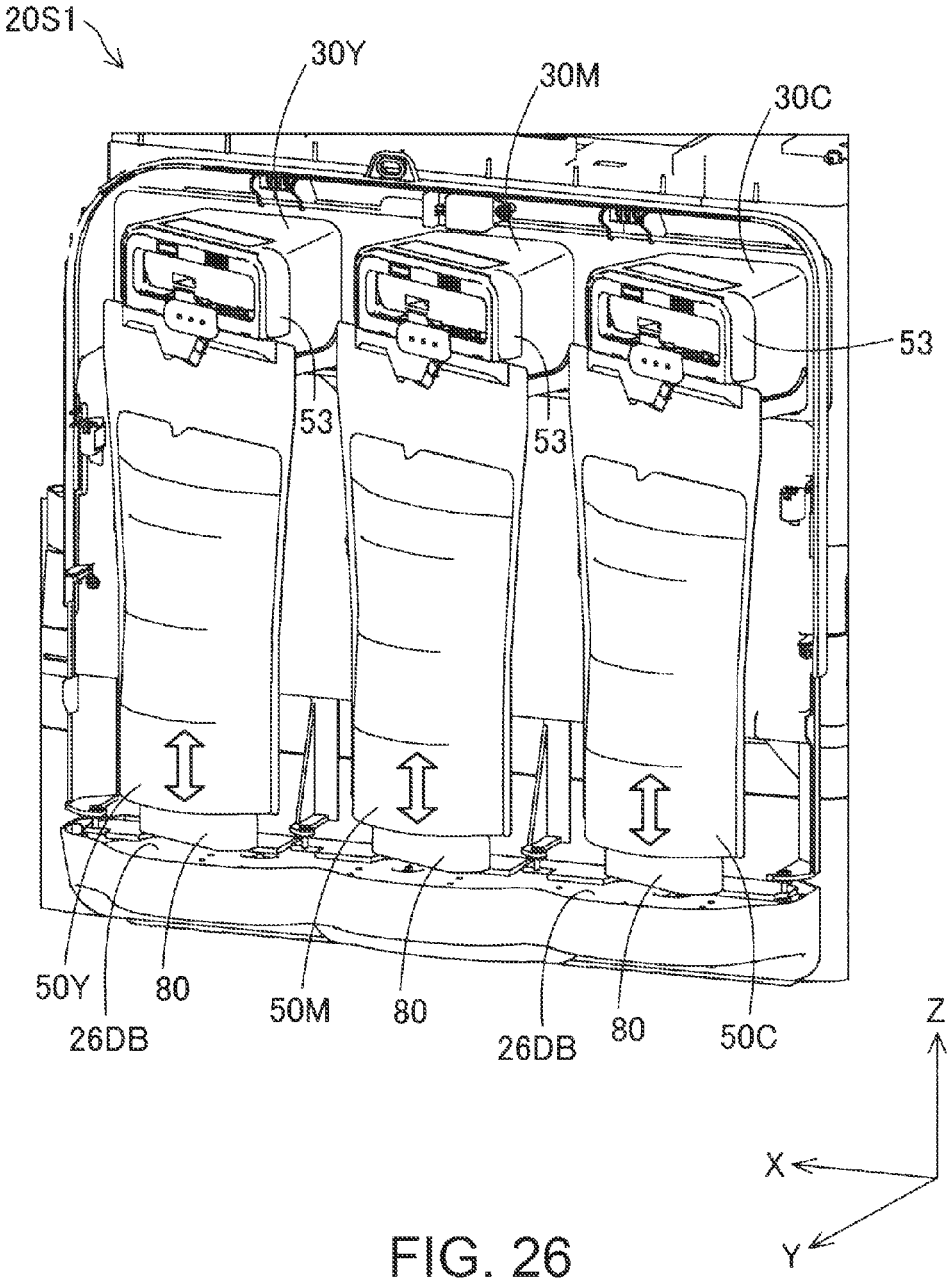
FIG. 26 is an illustrative view showing a main part of the liquid supply apparatus 20S1 as viewed from the front in a Y-axis direction.
Figure 27:
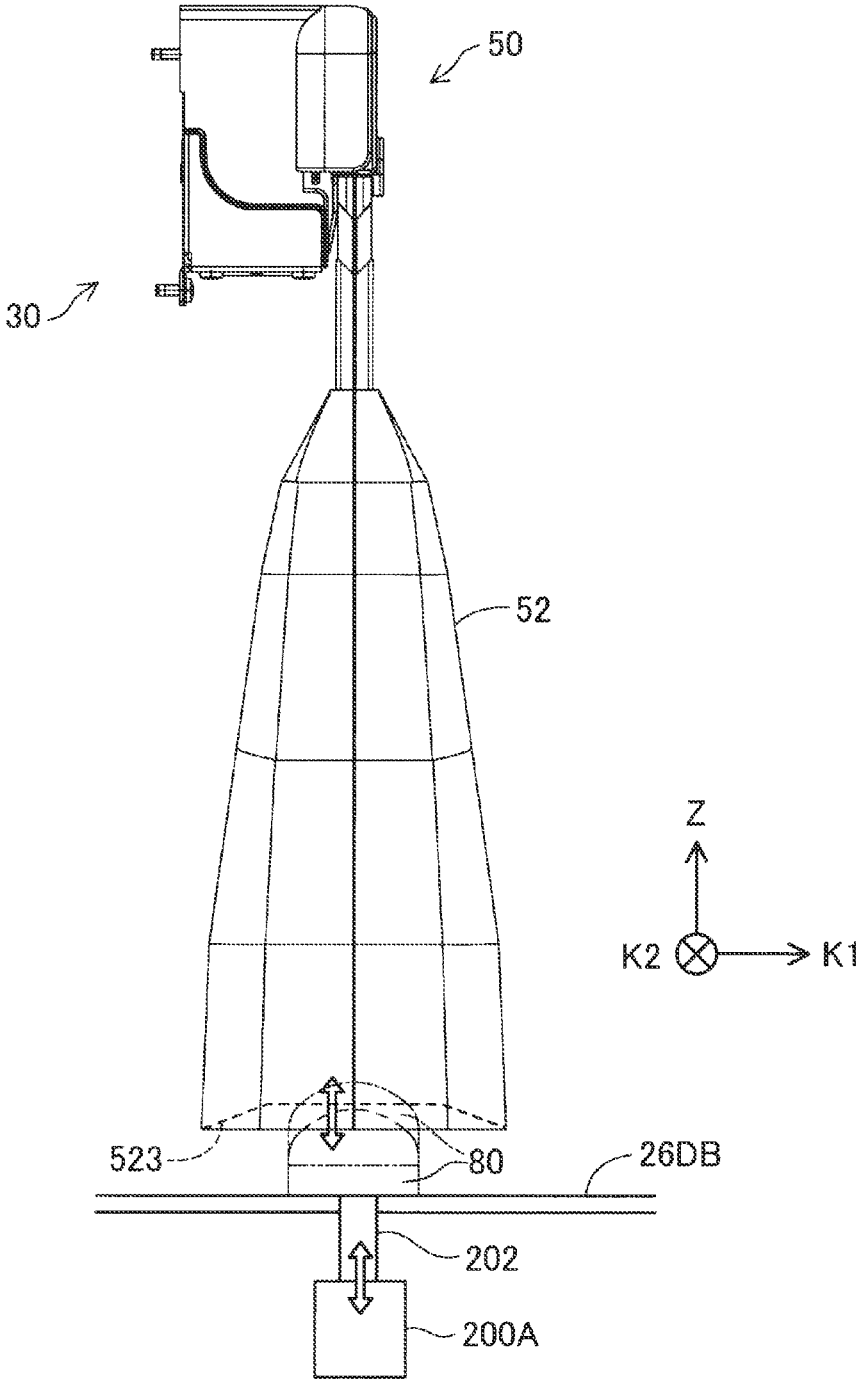
FIG. 27 is an illustrative view showing a relationship between the liquid containing body 50 supported by the attachment/detachment unit 30 and an assist rib 80, and a state of first driving of the assist rib 80.
Figure 28:
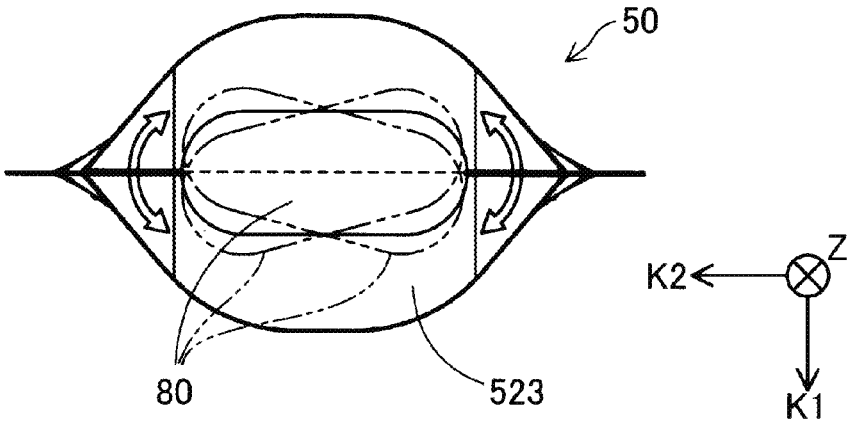
FIG. 28 is an illustrative view showing a state of second driving of the assist rib 80.

FIG. 25 is an illustrative view for illustrating a liquid supply apparatus 20S1 in a second embodiment. FIG. 26 is an illustrative view showing a main part of the liquid supply apparatus 20S1 as viewed from the front in the Y-axis direction. FIG. 27 is an illustrative view showing a relationship between a liquid containing body 50 supported by an attachment/detachment unit 30 and an assist rib 80, and a state of first driving of the assist rib 80. FIG. 28 is an illustrative view showing a state of second driving of the assist rib 80. In the following description, the same members as those in the already-described liquid supply apparatus 20 will be given the same reference numerals, and a detailed description thereof will be omitted.

As shown in FIGS. 25 and 26, the liquid supply apparatus 20S1 in this embodiment includes assist ribs 80 on a bottom plate 26DB in a housing space portion 26. These assist ribs 80 are prepared for the respective color ink, and each come into contact with a third film 523 forming the bottom face of the corresponding liquid containing body 50 supported at the upper end thereof by the attachment/detachment unit 30. Each assist rib 80 is joined to an axis direction drive unit 200A with the bottom plate 26DB therebetween by a joint shaft 202, as shown in FIG. 27. In the liquid supply apparatus 20S1 in this embodiment, the axis direction drive unit 200A has either a device configuration in which the axis direction drive unit 200A moves up and down as shown in FIG. 27, or a device configuration in which the axis direction drive unit 200A pivots as shown in FIG. 28. The axis direction drive unit 200A performs driving in the procedure shown in FIG. 24 under the control of the control apparatus MC, as in the already-described liquid supply apparatus 20, and moves the assist rib 80 up and down or pivots the assist rib 80 with respect to the liquid containing portion 52. The liquid containing portion 52 thereby receives the up-and-down movement or the pivoting of the assist rib 80 through the third film 523 and stirs the contained ink at an ink stirring timing. As described above, in this embodiment, the assist rib 80, the axis direction drive unit 200A, the joint shaft 202, and the like function as an operating portion that applies a movement to the liquid containing portion 52.

B-2. Effects

In the liquid supply apparatus 20S1 in this embodiment, each assist rib 80 is caused to abut against the third film 523 that forms the bottom portion of the corresponding liquid containing portion 52, and transmits the up-and-down movement of this assist rib 80 to the bottom portion of the liquid containing portion 52. Incidentally, the pigment, which is a precipitating component in the ink, often tends to precipitate due to its own weight and accumulate on the bottom portion. With the liquid supply apparatus 20S1 in this embodiment, the up-and-down movement can be directly applied to the bottom portion on which the pigment tends to accumulate, and therefore the pigment can also be efficiently dispersed to the upper side of the liquid containing portion 52. The third film 523 forms a gusset in the bottom portion of the liquid containing portion 52 with a crease 523*m* (see FIG. 7) thereof, and this gusset is folded to the inside along the crease 523*m* as the ink is consumed. Accordingly, if no movement is applied to the liquid containing portion 52, the pigment, which is the precipitating component, may possibly remain together with the ink at the folded portion of the gusset. However, with the liquid supply apparatus 20S1 in this embodiment, the up-and-down movement is directly applied to the gusset, and it is therefore possible to reduce the remaining ink on the side of the bottom portion of the liquid containing portion 52, as well as to disperse the pigment with the stirring. This effect can also be achieved by the liquid supply apparatus 20S1 that pivots the assist rib 80.

In the liquid supply apparatus 20S1 in this embodiment, the up-and-down movement or the pivoting is transmitted to the bottom portion of the liquid containing portion 52, while the liquid containing body 50 is supported at the upper end side thereof by the attachment/detachment unit 30, as shown in FIG. 27. Accordingly, in the liquid supply apparatus 20S1 in this embodiment, the portion at which the movement is applied to the liquid containing portion 52 by the assist rib 80 is separated from the liquid supply portion 57 (see FIG. 9) of the liquid containing body 50. Accordingly, the up-and-down movement or the pivoting of the assist rib 80 is applied to the liquid containing portion 52, and even if the ink pressure increases with this up-and-down movement or the pivoting, this ink pressure causes expansion of the liquid containing portion 52 up to the liquid supply portion 57, and is then applied to the liquid supply portion 57. For this reason, with the liquid supply apparatus 20S1 in this embodiment in which the portion at which the movement is applied to the liquid containing portion 52 is separated from the liquid supply portion 57, it is possible to suppress breakage of the liquid supply portion 57 and leakage of the ink from the liquid supply portion 57.

C. Third Embodiment

C-1. Configuration of Liquid Supply Apparatus

Figure 29:
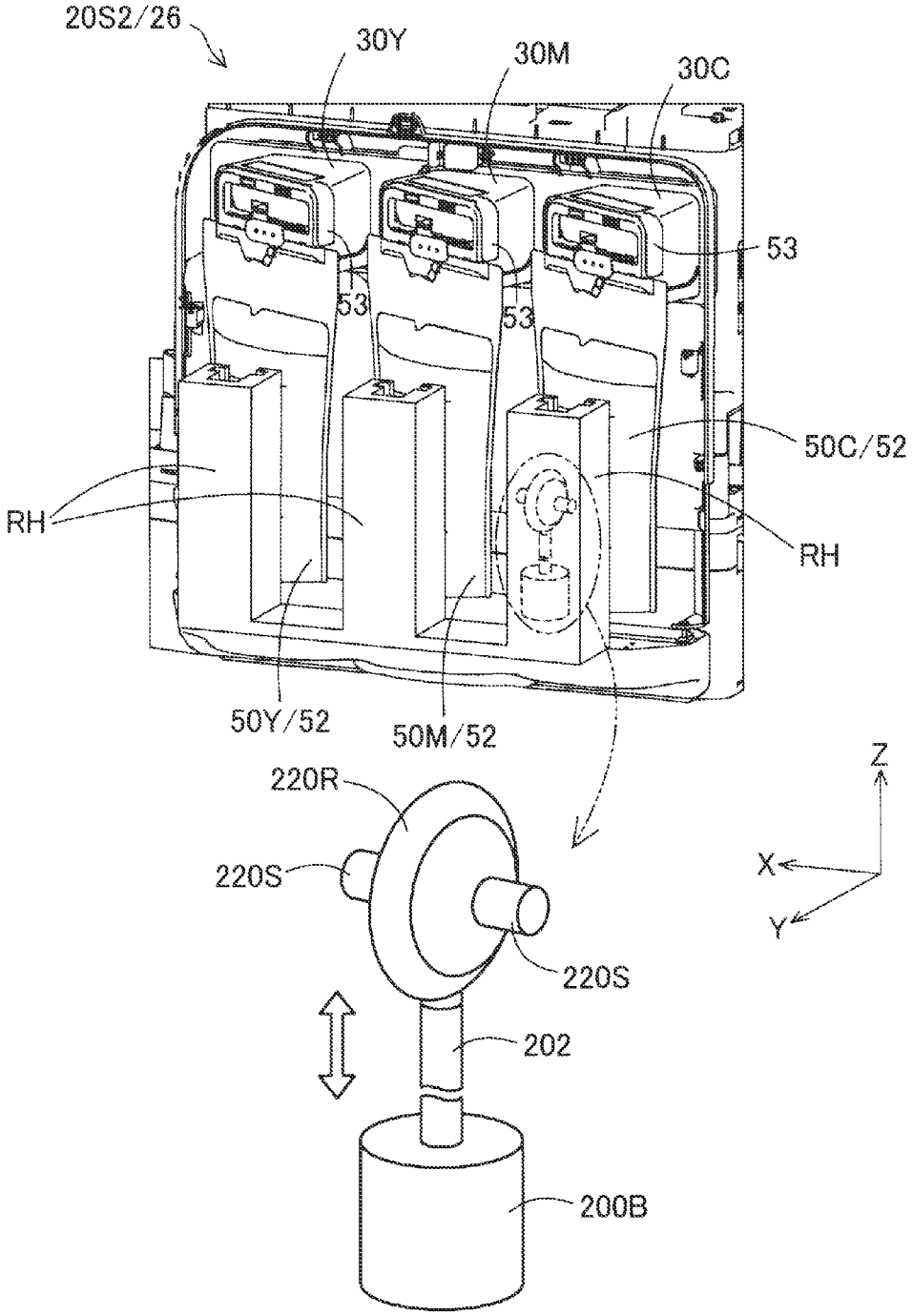
FIG. 29 is an illustrative view for illustrating a liquid supply apparatus 20S2 in a third embodiment.
Figure 30:
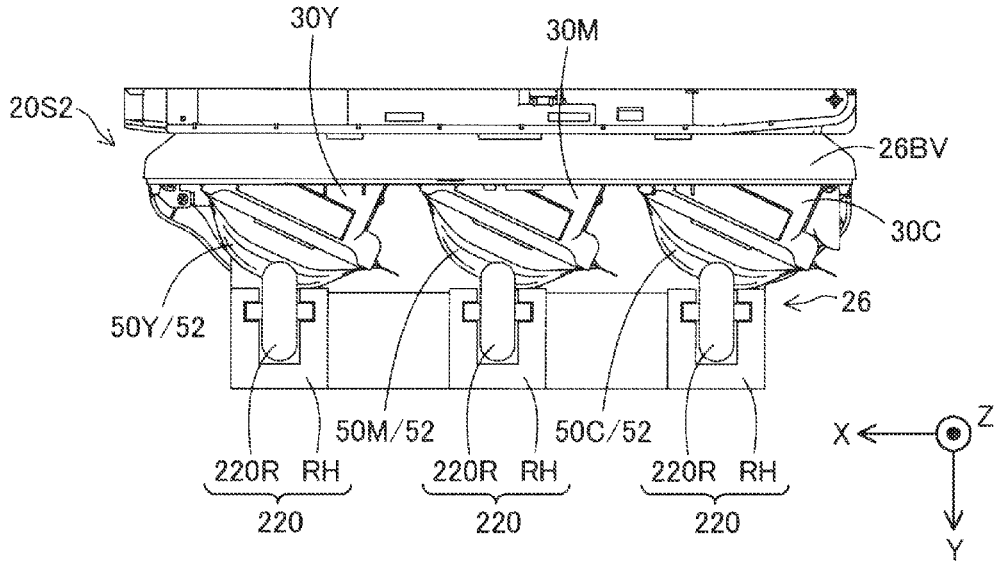
FIG. 30 is an illustrative view showing a positional relationship between a roller 220R and a liquid containing portion 52 when a main part of the liquid supply apparatus 20S2 is viewed from the front in a Z-axis direction.
Figure 31:
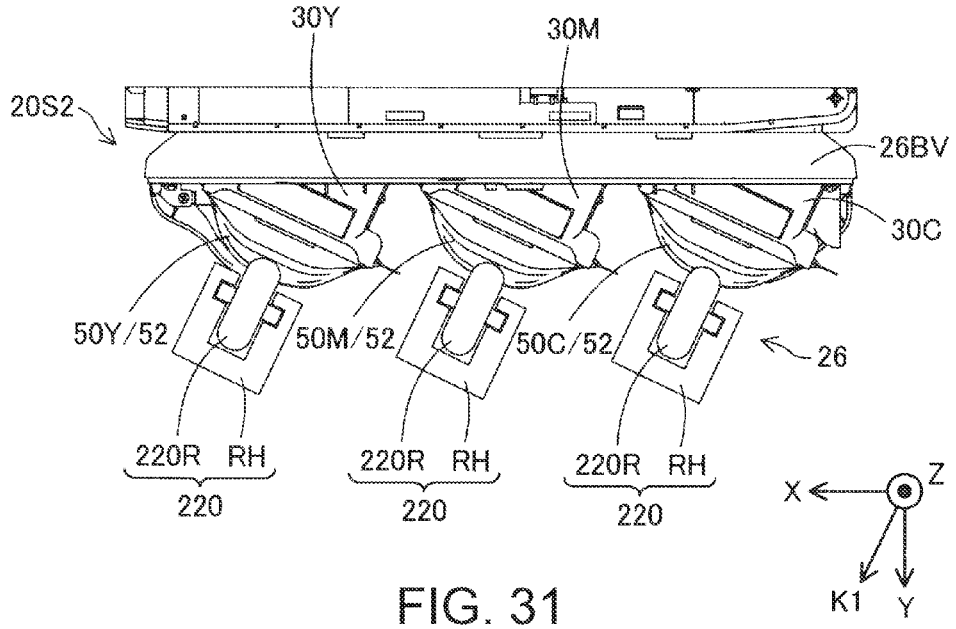
FIG. 31 is an illustrative view showing another positional relationship between the roller 220R and the liquid containing portion 52.

FIG. 29 is an illustrative view for illustrating a liquid supply apparatus 20S2 in a third embodiment. FIG. 30 is an illustrative view showing a positional relationship between a roller 220R and a liquid containing portion 52 when a main part of the liquid supply apparatus 20S2 is viewed from the front in the Z-axis direction. FIG. 31 is an illustrative view showing another positional relationship between the roller 220R and the liquid containing portion 52.

As shown in the drawings, the liquid supply apparatus 20S2 in this embodiment includes roller mechanisms 220 in the housing space portion 26. These roller mechanisms 220 are prepared for the respective color ink, and are attached to and installed on a cover member 22 (see FIG. 2). Each roller mechanism 220 presses the roller 220R against the liquid containing portion 52 in the corresponding liquid containing body 50 and brings the roller 220R into contact with the liquid containing portion 52 in a state where the cover member 22 is closed. In this case, in the roller mechanism 220, the roller 220R is obliquely pressed against the liquid containing portion 52 in the Y-axis direction as shown in FIG. 30. In FIG. 31, the roller 220R is pressed so as to directly face the liquid containing portion 52 in the aforementioned K1-axis direction. This roller mechanism 220 includes a roller holder RH for each roller, and enables the roller 220R to move up and down in the Z-axis direction by guiding up and down, i.e., in the Z-axis direction, a shaft 220S that supports the roller 220R around the axis thereof. In addition, the roller mechanism 220 includes an axis direction drive unit 200B and a joint shaft 202 extending from this unit, and moves the roller 220R up and down via the joint shaft 202 by the axis direction drive unit 200B. The axis direction drive unit 200B performs the driving in the procedure shown in FIG. 24 under the control of the control apparatus MC as in the already-described liquid supply apparatus 20, and moves the roller 220R up and down along a linear trajectory in the Z-axis direction while causing the roller 220R to be in contact with the liquid containing portion 52. The liquid containing portion 52, which is flexible, thereby receives the up-and-down movement of the roller 220R and stirs the contained ink at an ink stirring timing. As described above, in this embodiment, the roller mechanism 220, the joint shaft 202, the axis direction drive unit 200B, and the like function as an operating portion that applies a movement to the liquid containing portion 52.

C-2. Effects

In the liquid supply apparatus 20S2 in this embodiment, the roller 220R is directly pressed against and brought into contact with the flexible liquid containing portion 52, this roller 220R is moved up and down along a linear trajectory in the Z-axis direction, which is the vertical direction, and this up-and-down movement is directly transmitted to the liquid containing portion 52. Accordingly, with the liquid supply apparatus 20S2 in this embodiment, the portion at which the movement of the roller 220R is applied to the liquid containing portion 52 can be moved up and down along a linear trajectory by driving the roller, and therefore the pigment, which is a precipitating component, can be efficiently stirred and dispersed. Moreover, since the trajectory of the roller 220R is an upward and downward linear trajectory in the Z-axis direction, the pigment can also be reliably dispersed to the upper side in the liquid containing portion 52 by causing the moving direction of the roller 220R to coincide with the precipitating direction of the pigment that is the precipitating component.

D. Fourth Embodiment

D-1. Configuration of Liquid Supply Apparatus

Figure 32:
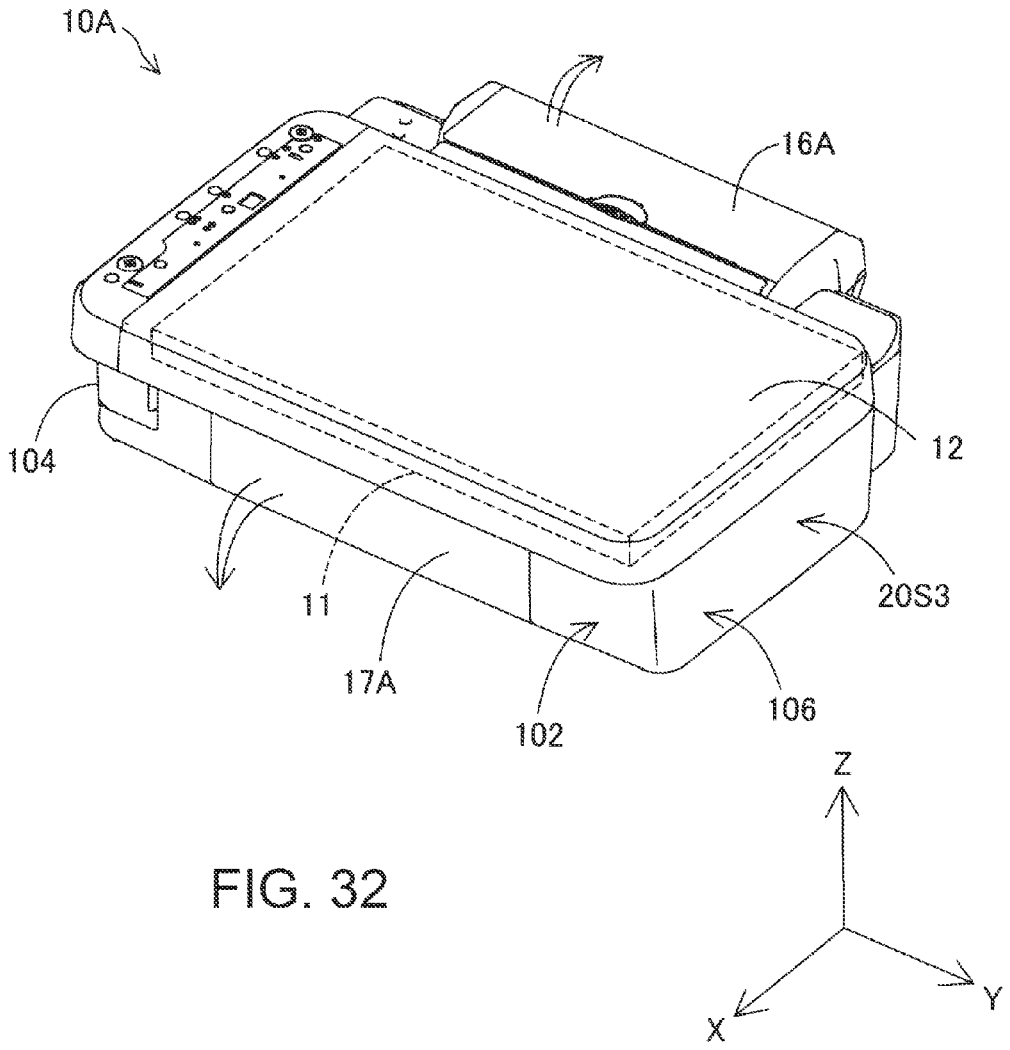
FIG. 32 is a perspective view showing an outline configuration of a printer 10A including a liquid supply apparatus 20S3 in a fourth embodiment.
Figure 33:
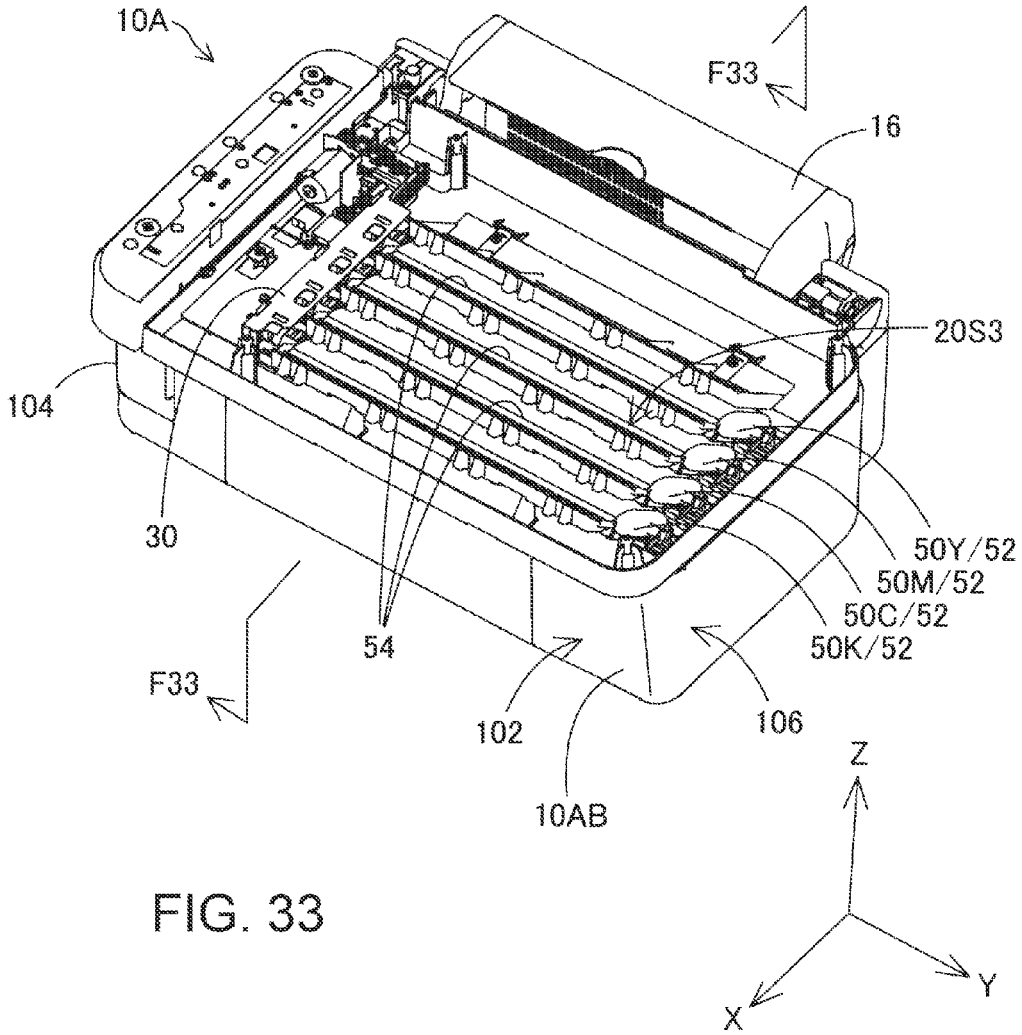
FIG. 33 is a perspective view showing a state of housing of the liquid containing body 50 in the liquid supply apparatus 20S3.
Figure 34:
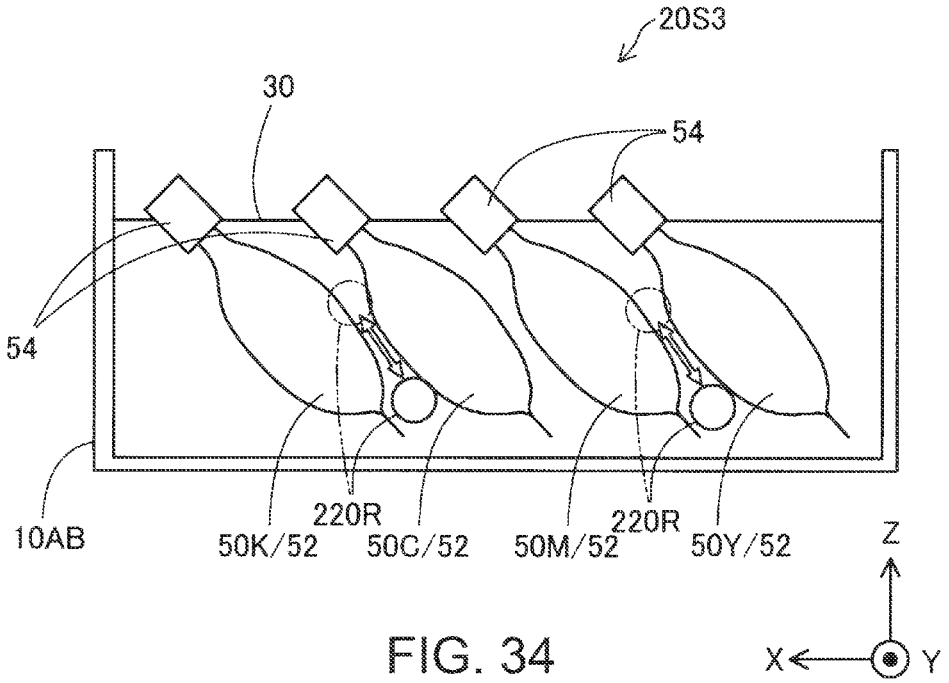
FIG. 34 is an illustrative view schematically showing a state of housing of the liquid containing body 50 and a positional relationship between the roller 220R and the liquid containing portion 52 as viewed in a cross-section taken along line F33-F33 in FIG. 33.
Figure 35:
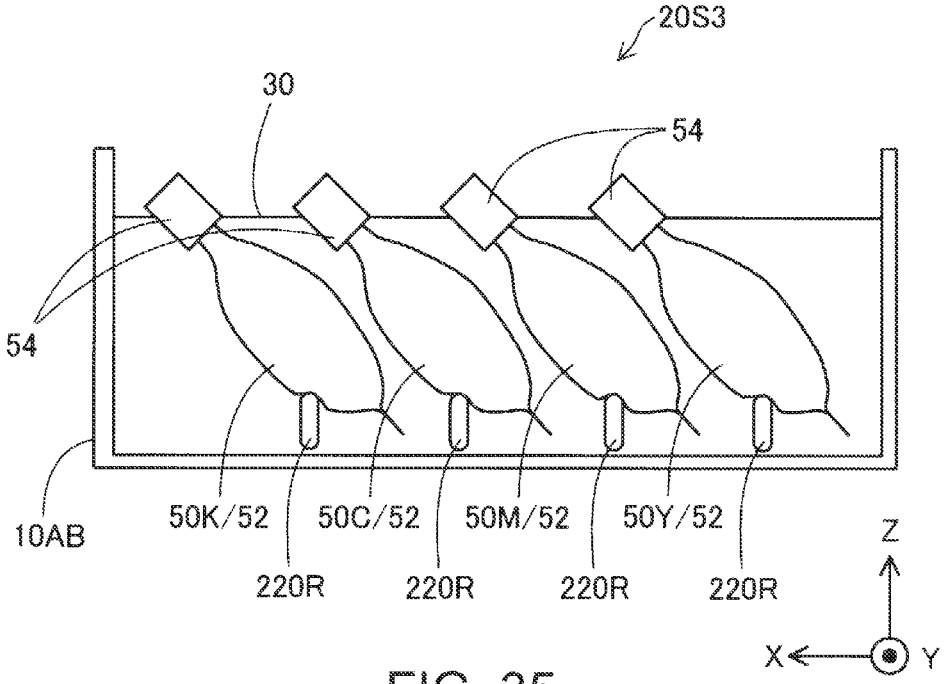
FIG. 35 is an illustrative view schematically showing another positional relationship between the roller 220R and the liquid containing portion 52.

FIG. 32 is a perspective view showing an outline configuration of a printer 10A including a liquid supply apparatus 20S3 in a fourth embodiment. FIG. 33 is a perspective view showing a state of housing of liquid containing bodies 50 in the liquid supply apparatus 20S3. FIG. 34 is an illustrative view schematically showing a state of housing of the liquid containing bodies 50 and a positional relationship between rollers 220R and liquid containing portions 52 as viewed in a cross-section taken along line F33-F33 in FIG. 33. FIG. 35 is an illustrative view schematically showing another positional relationship between the rollers 220R and the liquid containing portions 52. Note that, in the following description, members having the same functions as those in the liquid supply apparatus 20 in the already-described embodiment will be given the same reference numerals even if the shape is different.

As shown in the drawings, in this embodiment, the printer 10A includes a bottom portion casing 10AB having an apparatus first face 102, an apparatus second face 104, and an apparatus third face 106 that are continuous with a paper feed portion 16A, as well as a bottom face (not shown), and an upper casing 12. The upper casing 12 contains the recording mechanism 11, is fixed to the bottom portion casing 10AB by a lock mechanism (not shown), and is removed from the bottom portion casing 10AB by releasing the lock mechanism when replacing the liquid containing bodies 50. A state where the upper casing 12 is removed is schematically shown in FIG. 33. The printer 10A includes the liquid supply apparatus 20S3, which is surrounded by the bottom portion casing 10AB, and the liquid supply apparatus 20S3 houses all of the liquid containing bodies 50 of black, cyan, magenta, and yellow. The liquid supply apparatus 20S3 supplies the respective color ink from the liquid containing bodies 50 to the recording mechanism 11. The paper feed portion 16A functions as the already-described paper feed tray 16 by opening an openable/closable cover. A discharge portion 17A is formed substantially at the center of the apparatus first face 102, and functions as the already-described discharge tray 17 by opening the openable/closable cover.

The liquid containing body 50 of each color includes a pillow-type flexible liquid containing portion 52 so as to fix an end thereof to a corresponding holding portion 54. In this embodiment, each holding portion 54 has an elongated bar structure, and includes a liquid supply portion 57 and a board unit 58 that are similar to those in the already-described embodiments, on one end side in the longitudinal direction. In this embodiment, all of the liquid containing bodies 50 of black, cyan, magenta, and yellow are housed in the liquid supply apparatus 20S3, and each holding portion 54 is supported on one end side (in the −Y direction along the Y axis in FIG. 33) thereof by the attachment/detachment unit 30. The other end of each holding portion 54 is auxiliarily supported on the other end side (in the +Y direction along the Y axis in FIG. 33) of the holding portions 54. The attachment/detachment unit 30 includes a liquid introduction mechanism 36 that is connected to a liquid supply portion 57 provided in the holding portion 54 in the liquid containing body 50 of each color, and a contact point mechanism 38 that is electrically connected to the board unit 58.

The liquid supply apparatus 20S3 in this embodiment also includes a roller mechanism 220 that is similar to that in the above-described liquid supply apparatus 20S2. In FIG. 34, rollers 220R in the roller mechanism 220 are shown together with a state of movement of the rollers 220R, and each roller 220R reciprocates in a space between adjoining liquid containing bodies 50 while coming into contact with the liquid containing portions 52 along an oblique linear trajectory on the XZ plane shown in FIG. 34. In FIG. 35, the roller 220R is prepared for the liquid containing body 50 of each color, comes into contact with the corresponding liquid containing portion 52 on the side of the bottom portion of the liquid containing body 50, and reciprocates along a linear trajectory along the Y axis extending from the proximal side toward the distal side of the drawing. The liquid supply apparatus 20S3 may employ either of the modes in FIG. 34 or FIG. 35. As in the already-described liquid supply apparatus 20S2, the roller 220R performs the driving in the procedure shown in FIG. 24 under the control of the control apparatus MC, and reciprocates along the above-described linear trajectory while being in contact with the liquid containing portion 52. The flexible liquid containing portion 52 thereby receives the reciprocating movement of the roller 220R and stirs the contained ink at an ink stirring timing. As described above, in this embodiment, the roller mechanism 220, the control apparatus MC, and the like function as an operating portion that applies a movement to the liquid containing portion 52.

D-2. Effects

In the liquid supply apparatus 20S3 in this embodiment as well, each roller 220R is directly pressed against and brought into contact with the corresponding flexible liquid containing portion 52, the roller 220R is caused to reciprocate along the above-described linear trajectory, and this reciprocating movement is directly transmitted to the liquid containing portion 52. Accordingly, the same effects as those of the already-described liquid supply apparatus 20S2 can be achieved.

E. Fifth Embodiment

E-1. Configuration of Liquid Supply Apparatus

Figure 36:
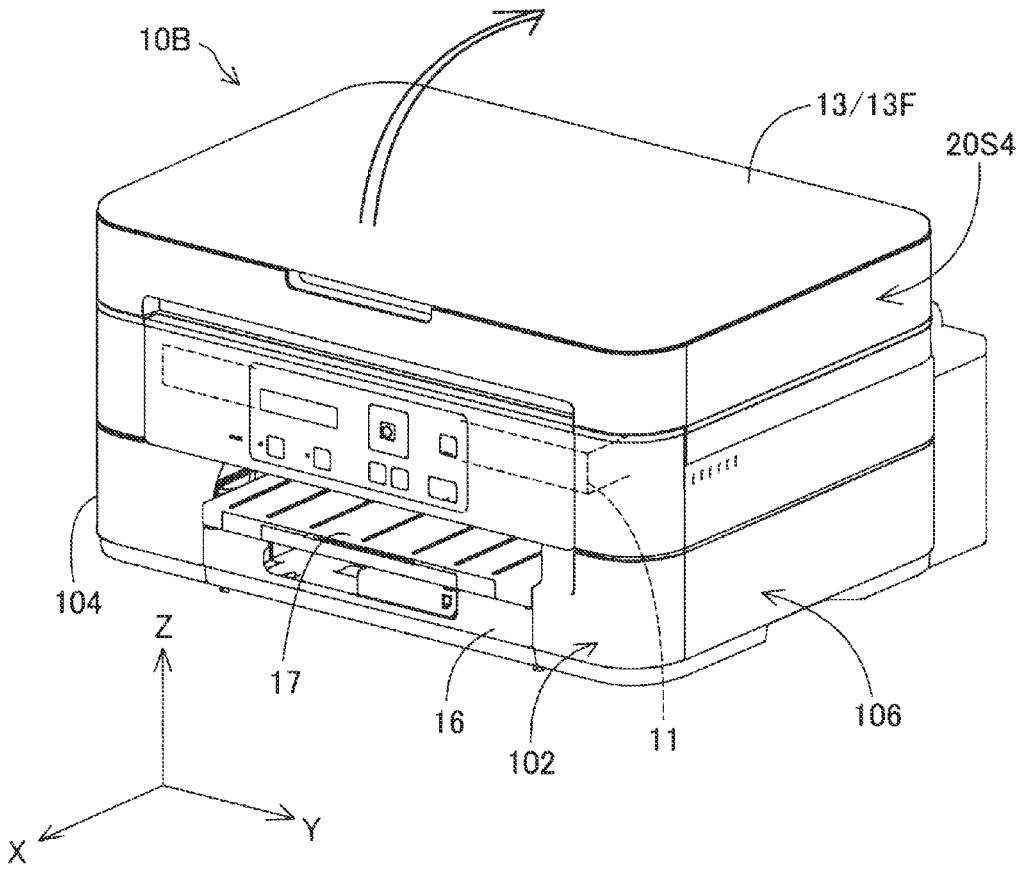
FIG. 36 is a perspective view showing an outline configuration of a printer 10B including a liquid supply apparatus 20S4 in a fifth embodiment.
Figure 37:
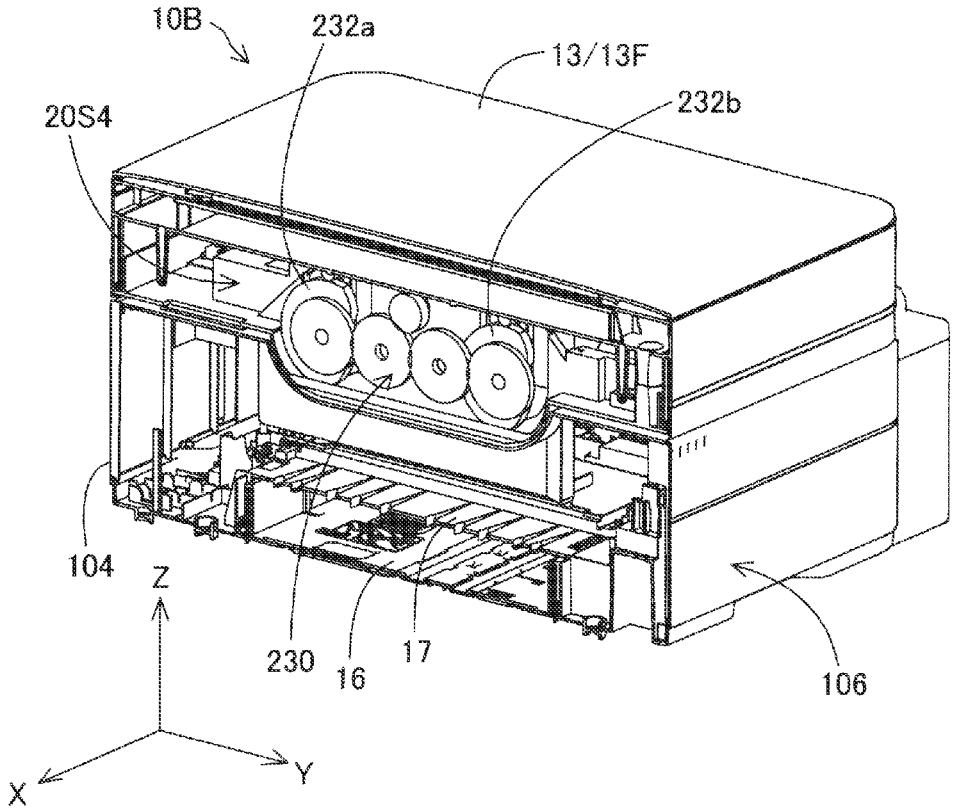
FIG. 37 is an illustrative view schematically showing a stirring drive mechanism 230 in the liquid supply apparatus 20S4 while omitting an apparatus first face 102.
Figure 38:
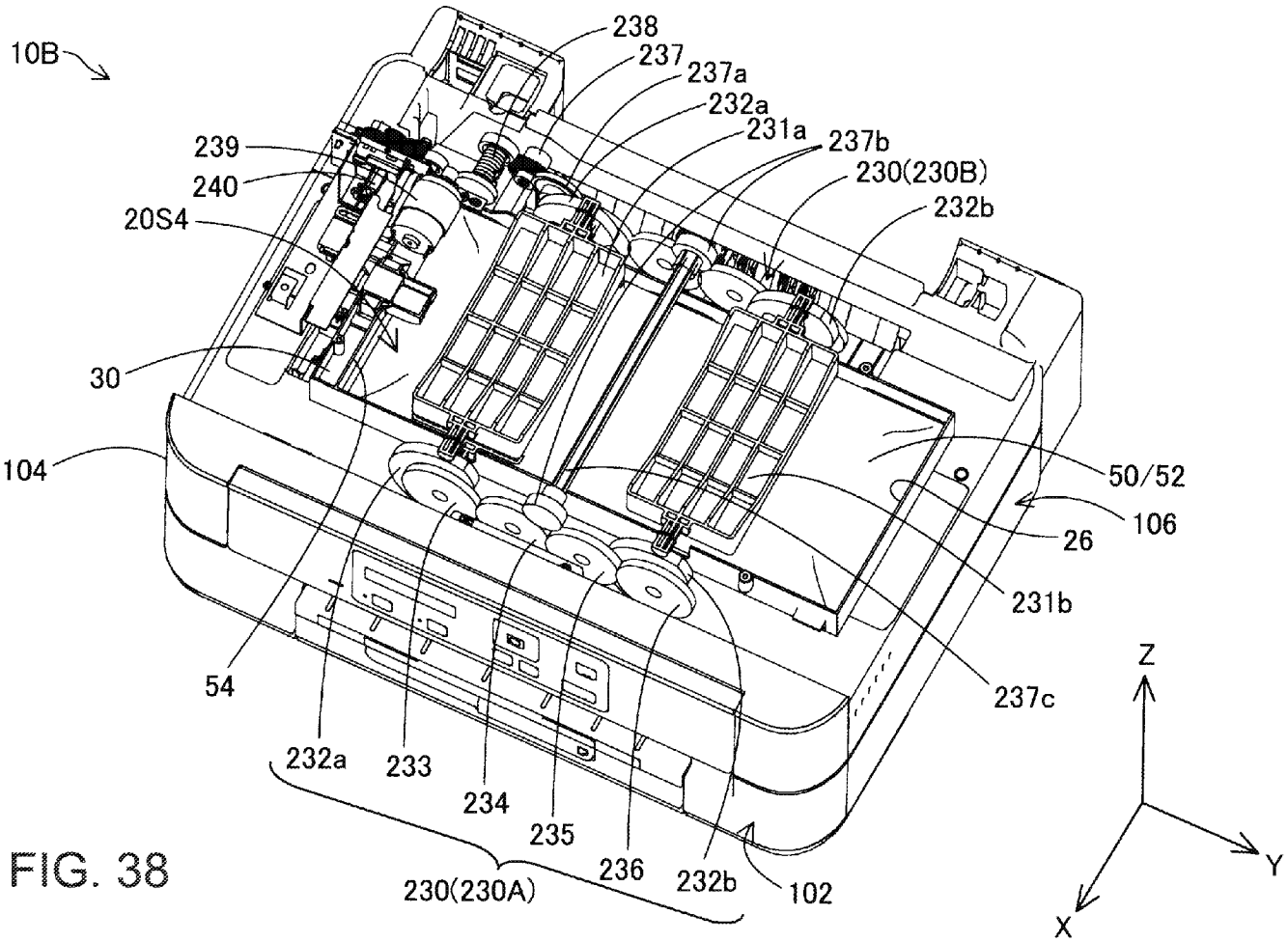
FIG. 38 is an illustrative view schematically showing a main part of device arrangement of the liquid supply apparatus 20S4 while omitting a scanner portion 13.

FIG. 36 is a perspective view showing an outline configuration of a printer 10B including a liquid supply apparatus 20S4 in a fifth embodiment. FIG. 37 is an illustrative view schematically showing a stirring drive mechanism 230 in the liquid supply apparatus 20S4 while omitting an apparatus first face 102. FIG. 38 is an illustrative view schematically showing a main part of device arrangement of the liquid supply apparatus 20S4 while omitting a scanner portion 13. Note that, in the following description, members having the same functions as those in the liquid supply apparatus 20 in the already-described embodiment will be given the same reference numerals even if the shape is different.

As shown in the drawings, in this embodiment, the printer 10B includes a paper feed tray 16 and a discharge tray 17 in a vertically stacked manner, and includes a recording mechanism 11 and a scanner portion 13 above the discharge tray 17. The scanner portion 13 is usually blocked by a lid 13F that is operated so as to open and close. A state where the scanner portion 13 is removed is shown in FIG. 38. The printer 10B includes the liquid supply apparatus 20S4 on the lower side of the scanner portion 13 so as not to interfere with the recording mechanism 11 and the paper feed tray 16. Note that the scanner portion 13 is not directly related to the gist of this application, and accordingly a description thereof will be omitted.

The printer 10B in this embodiment is configured to perform monochrome printing using only black ink. As shown in FIG. 38, in the liquid supply apparatus 2054, a dent-shaped housing space portion 26 is formed in a center region thereof, and the liquid supply apparatus 20S4 supports the liquid containing body 50 of the black ink that has entered this housing space portion 26. Since the housing space portion 26 has a dent shape, the liquid supply apparatus 20S4 supports the liquid containing portion 52 of the liquid containing body 50 from the lower side so as to provide underlying support on a bottom plate 26DB of the housing space portion 26. In the liquid supply apparatus 20S4, the black ink is supplied from the liquid containing body 50 to the recording mechanism 11 through the attachment/detachment unit 30.

The liquid containing body 50 includes a pillow-type flexible liquid containing portion 52 so as to fix an end thereof to a holding portion 54. In this embodiment, the holding portion 54 has an elongated bar structure, and includes a liquid supply portion 57 and a board unit 58 that are similar to those in the already-described embodiments, on one end side in the longitudinal direction. The attachment/detachment unit 30 includes a liquid introduction mechanism 36 connected to a liquid supply portion 57 provided in the holding portion 54 in the liquid containing body 50, and a contact point mechanism 38 that is electrically connected to the board unit 58.

The liquid supply apparatus 20S4 in this embodiment includes a one-way clutch 237, a time lag mechanism 238, a drive motor 239, and a feed/discharge valve mechanism 240, in addition to the attachment/detachment unit 30 and stirring drive mechanisms 230. The feed/discharge valve mechanism 240 is driven by receiving driving force of the drive motor 239, and opens and closes an ink flow path spanned from the attachment/detachment unit 30 to the recording mechanism 11. A state where the flow path is opened and closed by the feed/discharge valve mechanism 240 with the driving of the drive motor 239 will be described later.

As shown in FIG. 38, the stirring drive mechanisms 230 constituting the liquid supply apparatus 20S4 each include a first press member 231*a* and a second press member 231*b*, as well as a first cam 232*a* and a second cam 232*b*, first to fourth gears 233 to 236, a first drive transmission gear 237*a*, and a drive shaft 237*c* connecting two second drive transmission gears 237*b*. These stirring drive mechanisms 230 are arranged respectively in the +X direction and the −X direction with the housing space portion 26 therebetween, except the aforementioned press members, drive shaft 237*c*, and first drive transmission gear 237*a*. In the following description, when distinguishing between the stirring drive mechanisms 230 arranged in the +X direction and the −X direction, the stirring drive mechanism 230 arranged in the +X direction will be referred to as a first stirring drive mechanism 230A, and the stirring drive mechanism 230 arranged in the −X direction will be referred to as a second stirring drive mechanism 230B.

The stirring drive mechanisms 230 each support the first to fourth gears 233 to 236 around respective axes so as to mesh one another, and support the first cam 232*a* around the axis thereof coaxially with the first gear 233 so as to rotate in the same manner as the first gear 233. Also, the stirring drive mechanisms 230 each supports the second cam 232*b* around the axis thereof coaxially with the fourth gear 236 so as to rotate in the same manner as the fourth gear 236. Both the first stirring drive mechanism 230A and the second stirring drive mechanism 230B have this configuration, and each drive shaft 237*c* causes the second drive transmission gears 237*b* on both sides thereof to mesh with the aforementioned gear group in the first stirring drive mechanism 230A and the second stirring drive mechanism 230B. In this case, although the first cam 232*a* and the second cam 232*b* are formed while cam profiles thereof are shifted, the first cam 232*a* in the first stirring drive mechanism 230A and the first cam 232*a* in the second stirring drive mechanism 230B have the same cam profile as viewed from the front in the X-axis direction. The same applies to the second cam 232*b* in the first stirring drive mechanism 230A and the second cam 232*b* in the second stirring drive mechanism 230B. Note that the shift in the cam profile between the first cams 232*a* and between the second cams 232*b* will be described later.

The first drive transmission gear 237*a* meshes with the first gear 233 and the one-way clutch 237 on the side of the second stirring drive mechanism 230B, and transmits a rotation of the one-way clutch 237 to the first gear 233 in the second stirring drive mechanism 230B. The rotation of the first gear 233 that thereby rotates is sequentially transmitted to the second gear 234, the third gear 235, and the fourth gear 236 on the side of the second stirring drive mechanism 230B, and is also transmitted to the second drive transmission gear 237*b* of the drive shaft 237*c* on the side of the second stirring drive mechanism 230B. Then, this drive shaft 237*c* transmits the rotation of the second drive transmission gear 237*b* on the side of the first stirring drive mechanism 230A to the second gear 234 and the third gear 235 in the first stirring drive mechanism 230A, and accordingly the gears in the first stirring drive mechanism 230A rotate synchronously with the second stirring drive mechanism 230B. Thereby, the first cam 232*a* in the first stirring drive mechanism 230A and the first cam 232*a* in the second stirring drive mechanism 230B also synchronously rotate in terms of the cam profile, and the second cam 232*b* in the first stirring drive mechanism 230A and the second cam 232*b* in the second stirring drive mechanism 230B synchronously rotate in terms of the cam profile.

The first press member 231*a* is pressed at both ends thereof along the X axis against the first cam 232*a* in the first stirring drive mechanism 230A and the first cam 232*a* in the second stirring drive mechanism 230B by a spring (not shown). The second press member 231*b* is pressed against the second cam 232*b* in the first stirring drive mechanism 230A and the second cam 232*b* in the second stirring drive mechanism 230B by a spring (not shown). Accordingly, the first press member 231*a* and the second press member 231*b* repeat the up-and-down movement in the Z-axis direction in FIG. 38 while following the cam profiles of the respective cams. The first press member 231*a* and the second press member 231*b* are located above the liquid containing portion 52 of the liquid containing body 50 supported by the housing space portion 26, and therefore press the liquid containing portion 52 from above with the aforementioned up-and-down movement in the Z-axis direction. The aforementioned pressing of the liquid containing portion 52 by both press members will be described later.

The one-way clutch 237 meshes with the time lag mechanism 238, and transmits only forward rotation of the drive motor 239 transmitted via this time lag mechanism 238, to the first drive transmission gear 237*a* in the second stirring drive mechanism 230B. The time lag mechanism 238 contains a spring, and rotates upon receiving the rotation of the drive motor 239. If the drive motor 239 rotates in the forward direction, the time lag mechanism 238 transmits the forward rotation of the drive motor 239 to the one-way clutch 237 while delaying by a predetermined time during which the contained spring is wound around a rotation shaft (not shown) from a free state. Accordingly, the second stirring drive mechanism 230B and the first stirring drive mechanism 230A operate after the forward rotation of the drive motor 239 is started, while delaying by the predetermined time defined in the time lag mechanism 238, and move the first press member 231*a* and the second press member 231*b* up and down as mentioned above. Backward rotation of the drive motor 239 is also transmitted to the one-way clutch 237 through the time lag mechanism 238, but the backward rotation of the drive motor 239 is not transmitted to the second stirring drive mechanism 230B by the one-way clutch 237.

The feed/discharge valve mechanism 240, upon receiving the forward rotation of the drive motor 239, closes the ink flow path spanned from the attachment/detachment unit 30 to the recording mechanism 11 such that the ink contained in the liquid containing body 50 does not flow toward the side of the recording mechanism 11. Also, the feed/discharge valve mechanism 240, upon receiving the backward rotation of the drive motor 239, opens the aforementioned ink flow path that has been closed so far so as to enable ink supply from the liquid containing body 50 to the recording mechanism 11.

E-2. Ink Stirring Control of Liquid Containing Body 50

Ink stirring in the liquid supply apparatus 20S4 in this embodiment is performed by the already-described forward and backward rotation of the drive motor 239 as follows. First, the control apparatus MC (not shown) in the liquid supply apparatus 20S4 determines whether or not printing is being performed (step S100) and determines whether or not a stirring timing has come (step S105), as in the processing shown in FIG. 24 in the previous embodiment. If the stirring timing has come, the control apparatus MC drives the drive motor 239 so as to rotate in the forward direction. This forward rotation driving is continued for predetermined driving time. This continuation time will be described later.

Figure 39A:
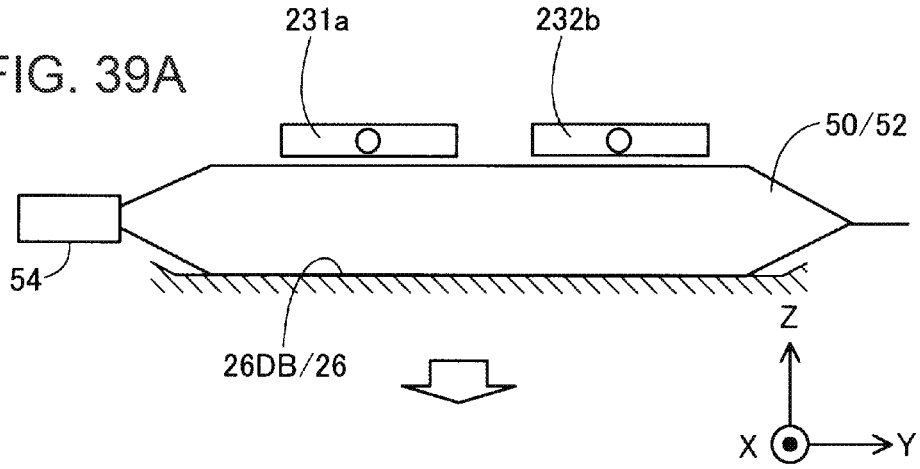
FIGS. 39A to 39C are illustrative views each schematically showing a state of pressing of the liquid containing portion 52 by a first press member 231*a* and a second press member 231*b* in the liquid supply apparatus 20S4.
Figure 39B:
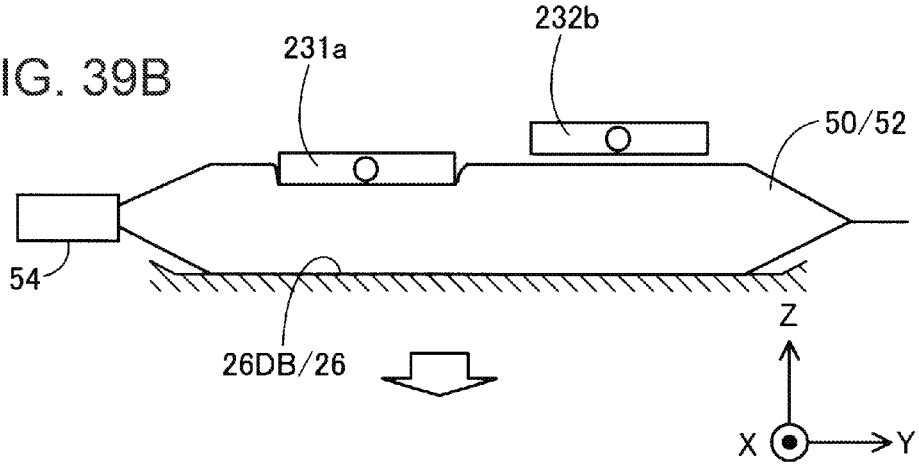
Figure 39C:
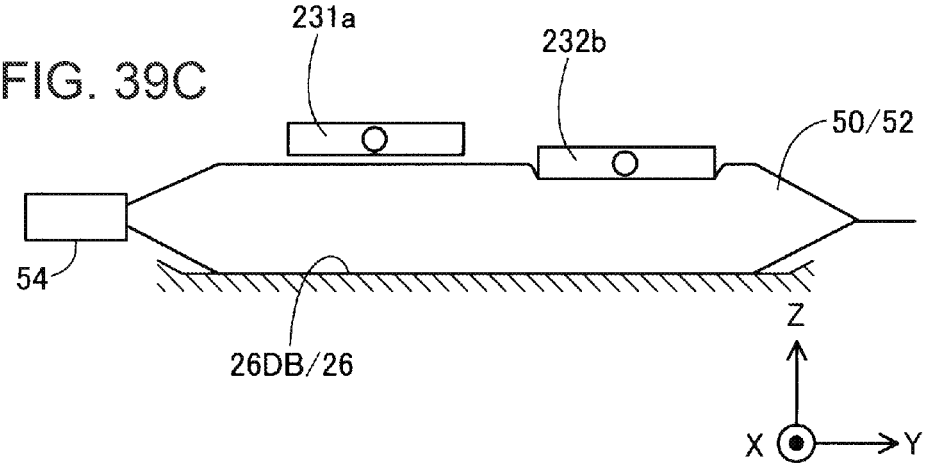

When the drive motor 239 thus rotates in the forward direction, the feed/discharge valve mechanism 240, upon receiving this forward rotation, closes the ink flow path as mentioned above. Also, the time lag mechanism 238 transmits the forward rotation to the one-way clutch 237 after a lapse of a predetermined delay time. Accordingly, the second stirring drive mechanism 230B and the first stirring drive mechanism 230A respectively move the second press member 231*b* and the first press member 231*a* up and down with respect to the liquid containing portion 52 of the liquid containing body 50. FIGS. 39A to 39C are illustrative views schematically showing a state where the liquid containing portion 52 is pressed by the first press member 231*a* and the second press member 231*b* in the liquid supply apparatus 20S4.

Before the driving of the stirring drive mechanism 230, as shown in FIG. 39A, the first press member 231*a* and the second press member 231*b* are located above the liquid containing portion 52 and are not in contact with the liquid containing portion 52 (FIG. 39A). These positions are home positions of the two press members. Then, the first cam 232*a* and the second cam 232*b* in the stirring drive mechanism 230 (see FIG. 38) have cam profiles with which both press members are at the home positions thereof before the stirring drive mechanism 230 performs the driving. Upon the delay time defined in the time lag mechanism 238 elapsing, the forward rotation of the drive motor 239 is transmitted to the stirring drive mechanism 230 through the one-way clutch 237. This stirring drive mechanism 230 lowers only the first press member 231*a* to press the liquid containing portion 52, and the second press member 231*b* remains at the home position thereof (FIG. 39B). That is to say, the first cam 232*a* and the second cam 232*b* in the stirring drive mechanism 230 have cam profiles with which only the first press member 231*a* lowers and the second press member 231*b* remains at the home position thereof at the first stage of the initial driving of the stirring drive mechanism 230.

If the transmission of the forward rotation of the drive motor 239 to the stirring drive mechanism 230 is continued, the stirring drive mechanism 230 restores the first press member 231*a* to the home position thereof, and lowers the second press member 231*b* from the home position thereof to press the liquid containing portion 52 (FIG. 39C). That is to say, the first cam 232*a* and the second 232*b* in the stirring drive mechanism 230 have cam profiles with which the first press member 231*a* is restored to the home position thereof and the second press member lowers at the second stage at which the driving of the stirring drive mechanism 230 is continued. If the transmission of the forward rotation of the drive motor 239 to the stirring drive mechanism 230 is further continued, the stirring drive mechanism 230 also restores the second press member 231*b* to the home position thereof and causes both press members to be located at the home positions thereof (FIG. 39A), and both of the aforementioned two cams have the cam profiles that cause the above-described up-and-down movement of the press member. In a period in which the forward rotation of the drive motor 239 is transmitted, i.e., in the first driving time in which the control apparatus MC continues the forward rotation of the drive motor 239, the stirring drive mechanism 230 repeats the above-described alternate up-and-down movement of the first press member 231*a* and the second press member 231*b*. In this embodiment, the cam profiles and the first driving time are defined such that the first press member 231*a* and the second press member 231*b* are both located at the home positions (FIG. 39A) thereof at a time point when the first driving time has elapsed.

The control apparatus MC drives the drive motor 239 so as to rotate in the backward direction upon the first driving time elapsing. The feed/discharge valve mechanism 240, upon receiving this backward rotation, opens the ink flow path as mentioned above. After the opening of the flow path by the feed/discharge valve mechanism 240 ends, the control apparatus MC controls the drive motor 239 so as to stop. Since the backward rotation of the drive motor 239 is also transmitted to the time lag mechanism 238, this time lag mechanism 238 restores the contained spring to a free state. After the opening of the flow path by the feed/discharge valve mechanism 240 and the restoration of the spring in the time lag mechanism 238 to the free state are completed, the control apparatus MC controls the drive motor 239 so as to stop, and ends the stirring control. Note that the backward rotation of the drive motor 239 is not transmitted to the stirring drive mechanism 230 by the one-way clutch 237. As described above, in this embodiment, the control apparatus MC, the drive motor 239, the time lag mechanism 238, the stirring drive mechanism 230, the first press member 231*a*, the second press member 231*b*, and the like function as an operating portion that applies a movement to the liquid containing portion 52.

E-3. Effects

As shown in FIG. 38, the liquid supply apparatus 20S4 in this embodiment supports the liquid containing body 50 below the liquid containing portion 52 by the housing space portion 26. Thereafter, in the liquid supply apparatus 20S4 in this embodiment, the first press member 231*a* and the second press member 231*b* are moved up and down with respect to the liquid containing portion 52 by the stirring drive mechanisms 230 to press the liquid containing portion 52 from above as shown in FIGS. 39A to 39C. Accordingly, with the liquid supply apparatus 20S4 in this embodiment, the housing space portion 26, the liquid containing portion 52 supported thereby, and the two press members that are the first press member 231*a* and the second press member 231*b* are overlaid as seen in a plan view in the Z-axis direction. Thereby, a reduction of the device arrangement space in a plan view direction is achieved, and an increase in the size of the system is suppressed.

In the liquid supply apparatus 20S4 in this embodiment, the first press member 231*a* and the second press member 231*b* are arranged side-by-side along the liquid containing portion 52 as shown in FIG. 39, and these two press members are moved up and down at different timings. Accordingly, with the liquid supply apparatus 20S4 in this embodiment, the pigment, which is an exemplary precipitating component of the ink contained in the liquid containing portion 52, can be efficiently stirred and dispersed.

In the liquid supply apparatus 20S4 in this embodiment, the ink flow path spanned from the attachment/detachment unit 30 is closed by the feed/discharge valve mechanism 240 with the forward rotation of the drive motor 239, and the first press member 231*a* and the second press member 231*b* are moved up and down in the stirring drive mechanism 230, while ensuring the delay time defined in the time lag mechanism 238. Then, in the liquid supply apparatus 20S4 in this embodiment, after the up-and-down movement of the above two press members is completed, the ink flow path is opened by the feed/discharge valve mechanism 240 with the backward rotation of the drive motor 239. Accordingly, with the liquid supply apparatus 20S4 in this embodiment, even if the up-and-down movement of the above two press members is applied to the liquid containing portion 52, it is possible to prevent leakage of the ink to the ink flow path on the downstream side of the feed/discharge valve mechanism 240 and the side of the recording mechanism 11 that receives a supply of the liquid from this flow path. Furthermore, with the avoidance of ink leakage, it is possible with the liquid supply apparatus 20S4 in this embodiment to prevent a movement of the ink contained in the liquid containing portion 52 from being transmitted to the recording mechanism 11 through the ink flow path. In addition, with the liquid supply apparatus 20S4 in this embodiment, the liquid containing portion 52 is made as an independent region by closing the flow path by the feed/discharge valve mechanism 240. Accordingly, the pigment, which is the precipitating component of the contained ink, is actively stirred and dispersed, and therefore the precipitation of the precipitating component can be effectively suppressed.

The liquid supply apparatus 20S4 in this embodiment executes, as a series of operations, the closing of the ink flow path, the ink stirring with the up-and-down movement of the first press member 231*a* and the second press member 231*b*, and the opening of the ink flow path, using the feed/discharge valve mechanism 240, the time lag mechanism 238, and the one-way clutch 237. Accordingly, with the liquid supply apparatus 20S4 in this embodiment, detection of the stirring timing and the forward and backward rotation control of the drive motor 239 that accompanies the detection need only be performed, which is convenient.

F. Modifications

Note that the invention is not limited to the above examples and embodiments, and may be implemented in various modes without departing from the gist of the invention. For example, the following modifications are possible.

F-1. First Modification:

In the above-described first second embodiments, the overall region of each liquid containing portion 52 is formed by a flexible member. However, the invention is not limited thereto, and the liquid containing portion 52 need only be able to function as a liquid containing portion capable of containing liquid inside. For example, the liquid containing portion 52 may be partially formed by a flexible member, or may be formed by a rigid member whose volume does not change regardless of the amount of consumed liquid. In the third and subsequent embodiments, the liquid containing portion 52 may be partially formed by a flexible member.

F-2. Second Modification:

In the above embodiments, the operation member 53 has a frame shape (FIG. 13). However, the shape thereof is not limited thereto, and may be a shape that can be held by the user. For example, the operation member 53 may be a bar shape (plate shape) extending in the Z-axis direction.

F-3. Third Modification:

The invention is applicable not only to an inkjet printer and a liquid containing body 50 thereof, but also to any printer (liquid consuming apparatus) that ejects liquid other than ink, and a liquid containing body for containing this liquid. For example, the invention is applicable to various liquid consuming apparatuses as listed below and liquid containing bodies thereof.

(1) Image recording apparatuses such as a facsimile apparatus (2) Color material ejection apparatuses used to manufacture color filters for image display apparatuses such as a liquid crystal display (3) Electrode material ejection apparatuses used to form electrodes for organic EL (Electro Luminescence) displays, field emission displays (FED), and the like (4) Liquid consuming apparatuses that eject liquid containing biological organic matter used to manufacture biochips (5) Sample ejection apparatuses serving as precision pipettes (6) Lubricating oil ejection apparatuses (7) Resin solution ejection apparatuses (8) Liquid consuming apparatuses that perform pinpoint ejection of lubricating oil to precision machines such as a watch and a camera (9) Liquid consuming apparatuses that eject transparent resin solution such as UV-cured resin solution onto substrates in order to form micro-hemisphere lenses (optical lenses) used in optical communication elements and the like

(10) Liquid consuming apparatuses that eject acid or alkaline etchant in order to etch substrates and the like

(11) Liquid consuming apparatuses including liquid ejection heads for discharging a very small amount of any other kinds of droplet Note that the "droplet" refers to a state of the liquid discharged from a liquid consuming apparatus, and includes droplets having a granular shape, a tear-drop shape, and a shape having a thread-like trailing end. Furthermore, the "liquid" mentioned here need only be any kind of material that can be ejected by a liquid consuming apparatus. For example, the "liquid" need only be a material in a state where a substance is in a liquid phase, and a liquid material having a high or low viscosity, sol, gel water, and other liquid materials such as inorganic solvent, organic solvent, solution, liquid resin, and liquid metal (metallic melt) are also included in the "liquid". Furthermore, the "liquid" is not limited to being a one-state substance, and also includes particles of a functional material made from solid matter, such as pigment or metal particles, that are dissolved, dispersed, or mixed in a solvent, and the like. Representative examples of the liquid include ink such as that described in the above embodiments, liquid crystal, and the like. Here, the "ink" encompasses general water-based ink and oil-based ink, as well as various types of liquid compositions such as gel ink and hot melt-ink. When UV ink that can be cured by radiating ultraviolet thereto is contained in this liquid containing body and connected to a printer, the liquid containing portion is separate from the installation surface, and accordingly it is less likely that heat on the installation surface is transmitted to the liquid containing portion and cures the UV ink.

F-4. Fourth Modification:

In the above-described third embodiment, the roller mechanism 220 is attached to and installed on the cover member 22 (see FIG. 2). However, the roller mechanism 220 may be installed on the side of the back board 26BV on which the attachment/detachment unit 30 is provided. In addition, in the third to fifth embodiments, a balloon may be provided in place of the roller mechanism 220, the first press member 231*a*, and the second press member 231*b*. If the balloon is provided, the balloon expands and shrinks due to feed and discharge of the air, and therefore the liquid containing portion 52 is pressed by the expansion of the balloon. This operation causes the contained ink to be stirred as in the case of the pressing of the liquid containing portion 52 by the roller 220R and the pressing caused by the up-and-down movement of the first press member 231*a* and the second press member 231*b*.

Figure 40:
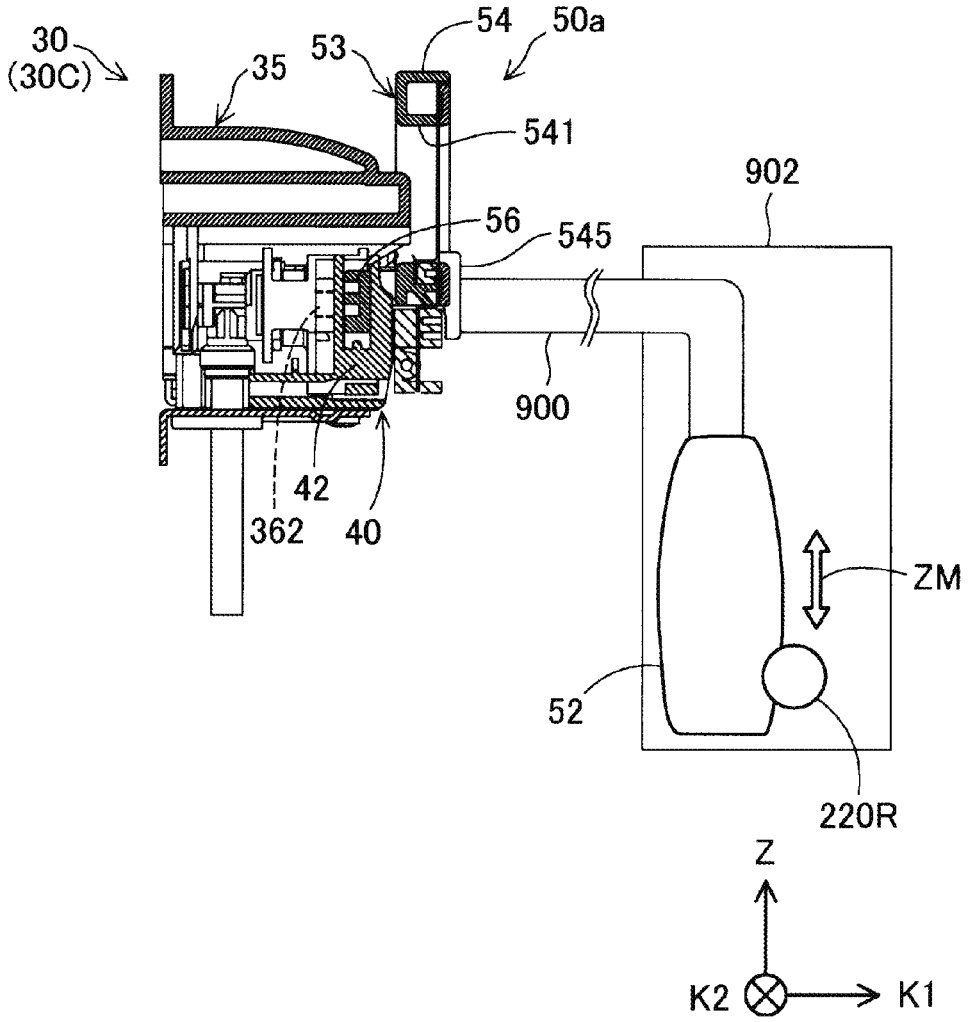
FIG. 40 is a diagram for illustrating a modification in which the liquid containing portion 52 is separately provided.

F-5. Fifth Modification:

FIG. 40 is a diagram for illustrating a modification in which the liquid containing portion 52 is separately provided. In the above embodiments, in the liquid containing body 50, the liquid containing portion 52 is fixed to the operation member 53 (holding portion 54) (FIGS. 7 and 9). However, the liquid containing portion 52 is connected to the holding portion 54 via a hose 900, and this liquid containing portion 52 is installed in a containing portion case at the bottom portion of the printer 10 shown in FIG. 1, for example. In this containing portion case, the liquid containing portion 52 is pressed by the roller 220R, for example. With this configuration as well, the effect such as the dispersion of the precipitating component can be achieved as in the above embodiments.

F-6. Sixth Modification:

In the above embodiments, the containing body-side electric connection portion 58 includes the circuit board 582. However, the invention is not limited thereto, and the containing body-side electric connection portion 58 need only have the contact portion cp that can come into contact with the apparatus-side electric connection portion 382. For example, the circuit board 582 may not include the storage device 583. For example, the containing body-side electric connection portion 58 may include a contact portion of a terminal that is used to detect attachment and detachment of the liquid containing body 50. Furthermore, the containing body-side electric connection portion 58 may include a general circuit board including a flexible cable, such as a flexible print board (FPC). This circuit board has, on one end side, a contact portion that can come into contact with the apparatus-side electric connection portion 382. The other end side is connected to a reset apparatus, for example. The above modification may be employed in place of the circuit board 582, or may be employed together with the circuit board 582.

The invention is not limited to the above embodiments, examples, and modifications, and can be achieved in various configurations without departing from the gist of the invention. For example, the technical features in the embodiments, examples, and modifications corresponding to the technical features in the modes described in the summary of the invention can be replaced or combined as appropriate in order to solve a part of or the entire problem described above, or in order to achieve some or all of the aforementioned effects. A technical feature that is not described as essential in the specification can be deleted as appropriate.

What is claimed is:

1. A liquid supply system comprising:

a liquid containing body including a liquid containing portion having a flexible portion that contains liquid containing a precipitating component, and a liquid supply portion that guides the liquid contained in the liquid containing portion from the liquid containing portion to the outside; and a liquid containing body attachment portion to which the liquid containing body is attached in a detachable manner, wherein the liquid containing body attachment portion includes:

a support portion that supports a part of the liquid containing body other than the liquid containing portion, at a position which is higher than the liquid containing portion when attaching the liquid containing body; and an operating portion that applies a movement to the liquid containing portion of the liquid containing body supported by the support portion, wherein the operating portion includes an abutting portion that abuts against a bottom portion of the liquid containing portion to apply an up-and-down movement to the liquid containing portion.

2. The liquid supply system according to claim 1, wherein the operating portion applies a movement to the liquid containing portion along a linear trajectory.

3. The liquid supply system according to claim 1, wherein the support portion supports the liquid containing body such that the liquid supply portion of the liquid containing body is separate from a portion at which a movement is applied to the liquid containing portion by the operating portion.

4. The liquid supply system according to claim 1, wherein the operating portion applies a movement to the liquid containing portion by moving the support portion.

5. The liquid supply system according to claim 1, further comprising:

a valve that is provided in the middle of a flow path through which the liquid supply portion guides the liquid from the liquid containing portion to the outside, the valve opening and closing the flow path; and a valve opening/closing portion that closes the valve before the operating portion operates, and opens the valve after an operation of the operating portion is completed.

6. A liquid supply system comprising:

a liquid containing body including a liquid containing portion that contains liquid containing a precipitating component, and a liquid supply portion that guides the liquid contained in the liquid containing portion from the liquid containing portion to the outside; and a liquid containing body attachment portion to which the liquid containing body is attached in a detachable manner, wherein the liquid containing body attachment portion includes:

a support portion that supports a part of the liquid containing body in a state where the liquid containing portion is exposed, when attaching the liquid containing body; and an operating portion that applies a movement to the liquid containing portion of the liquid containing body supported by the support portion, wherein the operating portion includes a roller that moves along a predetermined trajectory at the flexible portion.

7. A liquid supply system comprising:

a liquid containing body including a liquid containing portion that contains liquid containing a precipitating component, and a liquid supply portion that guides the liquid contained in the liquid containing portion from the liquid containing portion to the outside; and a liquid containing body attachment portion to which the liquid containing body is attached in a detachable manner, wherein the liquid containing body attachment portion includes:

a support portion that supports a part of the liquid containing body in a state where the liquid containing portion is exposed, when attaching the liquid containing body; and an operating portion that applies a movement to the liquid containing portion of the liquid containing body supported by the support portion, wherein the support portion supports the liquid containing portion from a lower side so as to provide underlying support, and the operating portion includes a press member that presses the liquid containing portion from above.

8. The liquid supply system according to claim 7, wherein a plurality of the press members are arranged along the liquid containing portion, and the plurality of press members operate at different operation timings.

* * * * *